US010190451B2

(12) United States Patent
Meneely et al.

(10) Patent No.: US 10,190,451 B2
(45) **Date of Patent: *Jan. 29, 2019**

(54) COMPRESSION-RELEASE ENGINE BRAKE SYSTEM FOR LOST MOTION ROCKER ARM ASSEMBLY AND METHOD OF OPERATION THEREOF

(71) Applicant: Pacbrake Company, Blaine, WA (US)

(72) Inventors: Vincent Meneely, Gibsons (CA); Robert Price, Manchester, CT (US)

(73) Assignee: Pacbrake Company, Blaine, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/889,545

(22) Filed: Feb. 6, 2018

(65) Prior Publication Data

US 2018/0187580 A1 Jul. 5, 2018

Related U.S. Application Data

(63) Continuation of application No. 15/695,627, filed on Sep. 5, 2017, now Pat. No. 9,885,263, which is a (Continued)

(51) Int. Cl.
*F02D 13/04* (2006.01)
*F01L 13/06* (2006.01)

(Continued)

(52) U.S. Cl.
CPC ..... *F01L 13/065* (2013.01); *F01L 1/18* (2013.01); *F01L 1/181* (2013.01); *F01L 1/26* (2013.01);

(Continued)

(58) Field of Classification Search
CPC ..... F01L 13/06; F01L 1/26; F01L 1/18; F01L 13/065; F01L 1/181; F02D 13/04
See application file for complete search history.

(56) References Cited

U.S. PATENT DOCUMENTS 4,399,787 A 8/1983 Cavanagh
5,460,131 A 10/1995 Usko (Continued)

FOREIGN PATENT DOCUMENTS

WO 0118373 A1 3/2001
WO 2012109780 A1 8/2012
WO WO2016041600 A1 3/2016

*Primary Examiner* — Hung Q Nguyen
(74) *Attorney, Agent, or Firm* — Berenato & White, LLC

(57) ABSTRACT

A compression-release brake system is provided that includes a lost motion exhaust rocker assembly, an actuation piston, and a reset device. The actuation piston includes an actuation piston body that is slidably received by the rocker arm to define a piston cavity in the rocker arm and is movable between piston retracted and extended positions. The actuation piston is configured to be operatively associated with the exhaust valve to permit unseating of the exhaust valve from the seated state. An actuation piston check valve is configured to move between closed and open positions to permit hydraulic fluid flow through an actuation piston communication port to the piston cavity. The reset device includes a reset check valve and a reset pressure control spring for applying a biasing force to the reset check valve to urge the reset check valve toward an open position.

15 Claims, 46 Drawing Sheets

Related U.S. Application Data continuation of application No. 15/241,609, filed on Aug. 19, 2016, now Pat. No. 9,752,471, which is a continuation-in-part of application No. 14/553,177, filed on Nov. 25, 2014, now Pat. No. 9,429,051.

(60) Provisional application No. 62/001,392, filed on May 21, 2014, provisional application No. 61/908,272, filed on Nov. 25, 2013.

(51) Int. Cl.

| | |
|---|---|
| ***F01L 1/18*** | (2006.01) |
| ***F02B 75/02*** | (2006.01) |
| ***F01L 1/26*** | (2006.01) |
| *F01L 13/00* | (2006.01) |
| *F01L 1/08* | (2006.01) |
| *F01L 1/14* | (2006.01) |
| *F01L 1/20* | (2006.01) |
| *F01L 1/047* | (2006.01) |

(52) U.S. Cl.

CPC ..... *F01L 13/06* (2013.01); *F02B 75/02* (2013.01); *F02D 13/04* (2013.01); *F01L 1/08* (2013.01); *F01L 1/146* (2013.01); *F01L 1/20* (2013.01); *F01L 2001/054* (2013.01); *F01L 2013/105* (2013.01); *F01L 2105/00* (2013.01); *F01L 2820/01* (2013.01); *F02B 2075/027* (2013.01)

(56) References Cited

U.S. PATENT DOCUMENTS

| | | | | |
|---|---|---|---|---|
| 5,564,385 | A | 10/1996 | Hakansson | |
| 5,829,397 | A | 11/1998 | Vorih et al. | |
| 5,890,469 | A | 4/1999 | Hakansson et al. | |
| 6,000,374 | A | 12/1999 | Cosma et al. | |
| 6,253,730 | B1 | 7/2001 | Gustafson | |
| 6,334,429 | B1 | 1/2002 | Little, Jr. | |
| 6,386,160 | B1 | 5/2002 | Meneely et al. | |
| 6,394,067 | B1 | 5/2002 | Usko et al. | |
| 6,422,186 | B1 | 7/2002 | Vanderpoel | |
| 6,439,195 | B1 | 8/2002 | Warner | |
| 6,450,144 | B2 | 9/2002 | Janak et al. | |
| 6,594,996 | B2 | 7/2003 | Yang | |
| 6,691,674 | B2 | 2/2004 | McCarthy et al. | |
| 6,694,933 | B1 | 2/2004 | Lester | |
| 6,718,940 | B2 | 4/2004 | Usko | |
| 6,866,017 | B2 | 3/2005 | Ruggiero et al. | |
| 6,904,892 | B1 | 6/2005 | Afjeh et al. | |
| 6,925,976 | B2 | 8/2005 | Israel et al. | |
| 7,520,262 | B2 | 4/2009 | Jeong et al. | |
| 7,789,065 | B2 | 9/2010 | Yang | |
| 7,823,553 | B2 | 11/2010 | Meistrick | |
| 7,909,015 | B2 | 3/2011 | Yang | |
| 7,909,017 | B2 | 3/2011 | Yang | |
| 7,984,705 | B2 | 7/2011 | Yang | |
| 8,065,987 | B2 | 11/2011 | yang | |
| 8,146,566 | B2 | 4/2012 | Lee et al. | |
| 8,161,936 | B2 | 4/2012 | Kraft | |
| 8,225,769 | B2 | 7/2012 | Dilly | |
| 8,240,278 | B2 | 8/2012 | Jeon et al. | |
| 8,887,679 | B2 | 11/2014 | Girard et al. | |
| 8,991,341 | B2 | 3/2015 | LeForestier | |
| 8,991,350 | B2 | 3/2015 | Yang | |
| 9,016,249 | B2 | 4/2015 | Roberts et al. | |
| 9,068,479 | B2 | 6/2015 | Hansson et al. | |
| 9,163,534 | B2 | 10/2015 | Girard et al. | |
| 9,163,566 | B2 | 10/2015 | LeForestier | |
| 9,249,698 | B2 | 2/2016 | Gustafson et al. | |
| 9,885,263 | B2 * | 2/2018 | Meneely ..... | F01L 13/065 |
| 2001/0027773 | A1 | 10/2001 | Janak et al. | |
| 2002/0174849 | A1 | 11/2002 | Ruggiero | |
| 2003/0024501 | A1 | 2/2003 | McCarthy et al. | |
| 2005/0211206 | A1 * | 9/2005 | Ruggiero ..... | F01L 1/08 123/90.16 |
| 2006/0081213 | A1 | 4/2006 | Yang et al. | |
| 2010/0319657 | A1 | 12/2010 | Dodi et al. | |
| 2011/0073068 | A1 | 3/2011 | Yoon et al. | |
| 2012/0024260 | A1 | 2/2012 | Groth et al. | |
| 2013/0319370 | A1 | 12/2013 | Yang | |
| 2014/0130774 | A1 | 5/2014 | LeForestier et al. | |
| 2014/0238324 | A1 | 8/2014 | Janak et al. | |
| 2015/0101567 | A1 | 4/2015 | Park | |
| 2015/0122220 | A1 | 5/2015 | Cecur | |
| 2015/0144096 | A1 | 5/2015 | Meneely | |
| 2016/0025018 | A1 * | 1/2016 | Gustafson ..... | F01L 1/181 123/321 |

* cited by examiner

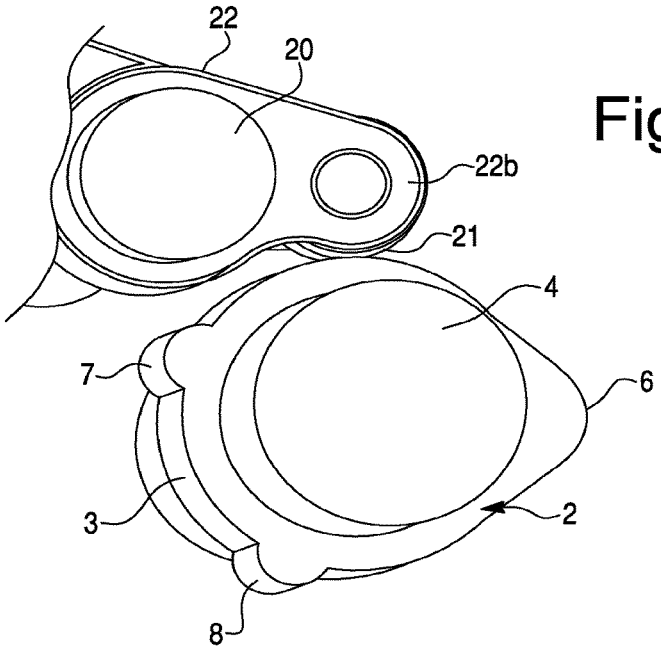
Fig. 2
Fig. 3
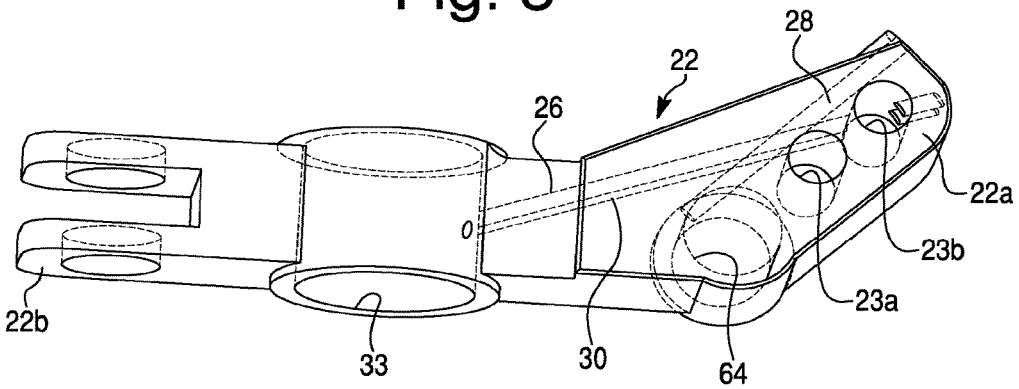

COMPRESSION-RELEASE ENGINE BRAKE SYSTEM FOR LOST MOTION ROCKER ARM ASSEMBLY AND METHOD OF OPERATION THEREOF

CROSS REFERENCE TO RELATED APPLICATIONS AND CLAIM TO PRIORITY

This application is a continuation of U.S. application Ser. No. 15/695,627, filed Sep. 5, 2017, now U.S. Pat. No. 9,885,263, which is a continuation of U.S. application Ser. No. 15/241,609, filed Aug. 19, 2016, now U.S. Pat. No. 9,752,471, which is a continuation-in-part of U.S. application Ser. No. 14/553,177, filed Nov. 25, 2014, now U.S. Pat. No. 9,429,051, which claims the benefit of U.S. Provisional Application No. 61/908,272 filed on Nov. 25, 2013 by V. Meneely and K. Price, and of U.S. Provisional Application No. 62/001,392 filed on May 21, 2014 by V. Meneely and R. Price, each of which are hereby incorporated herein by reference in their entireties and to which priority is claimed.

BACKGROUND OF THE INVENTION

1. Field of the Invention

The present invention relates to compression-release engine brake systems in general, and more particularly to a compression-release engine brake system and method comprising a lost motion type engine brake rocker arm assembly incorporating structure implementing a valve reset function.

2. Description of the Related Art

Compression release engine brake systems (or retarders) for diesel engines were designed and developed in North America starting in the early 1960's. There have been many changes that have been implemented that have increased retarding performance, reduced cost, reduced engine loading and reduced engine valve train loading.

Conventionally, the engine brake compression release retarders change a power producing diesel engine to a power absorbing air compressor. The air in the cylinder is compressed on the compression stroke and is released near top dead center (TDC) of the compression stroke just prior to the expansion stroke to reduce the cylinder pressure and prevent it from pushing the piston down on the expansion stroke. In the so-called exhaust brake systems, work on the air is done on the exhaust stroke when the piston is moving up and there may be a pressure increase in the exhaust manifold from turbocharger restriction or other exhaust restriction.

The opening of the exhaust valve(s) near TDC to vacate cylinder pressure can be accomplished by a number of different approaches. Some of the most common methods used are add-on housings that hydraulically transfer intake or exhaust cam motion from a neighboring cylinder, or fuel injector motion from the same cylinder to provide a method of timing the exhaust valve(s) to open near TDC of the compression stroke to optimize the release of compressed air in the cylinder.

Other engine brake systems have a rocker arm brake that utilizes an exhaust rocker arm (or lever) to open the exhaust valve(s) near TDC of the compression stroke. A term used to identify a type of rocker arm brake is a lost motion concept. This concept adds an additional small lift profile to the exhaust cam lobe that opens the exhaust valve(s) near TDC of the compression stroke when excess exhaust valve lash is removed from the valve train.

Rocker arm brake systems using the lost motion principle have been known for many years. One problem with the conventional rocker arm brake system is that valve overlap at exhaust/intake is extended and thus braking performance decreased. Moreover, a problem with opening a single valve is that exhaust/intake overlap is extended and valve opening by an exhaust bridge may be unbalanced during the initial normal exhaust lift and may result in engine overhead damage. Extended overlap allows exhaust gas to flow backwards into the engine from the exhaust manifold and through the inlet valve into the inlet manifold. In other words, the extended valve overlap causes an undesired exhaust manifold air mass flow into the engine intake system, thus reducing exhaust stroke work and decreasing braking performance.

Embodiments disclosed herein can operate to open an exhaust valve late in the expansion stroke, to open an exhaust valve at a faster rate, and to evacuate the cylinder quickly to provide a very high performance engine brake.

SUMMARY OF THE INVENTION

A first aspect of the invention provides a compression-release brake system for effectuating a compression-release engine braking operation in connection with an internal combustion engine including an engine cylinder that is associated with a four-stroke piston cycle including a compression stroke and an expansion stroke and is provided with at least one intake valve, at least one exhaust valve, and at least one exhaust valve return spring exerting a closing force on the exhaust valve to urge the exhaust valve into a seated state. The compression-release brake system includes a lost motion exhaust rocker assembly, an actuation piston, and a reset device. The lost motion rocker assembly includes a rocker arm. The actuation piston includes an actuation piston body that is slidably received by a first pocket of the rocker arm to define a piston cavity in the rocker arm and is movable between a piston retracted position and a piston extended position. The actuation piston is configured to be operatively associated with the exhaust valve to permit unseating of the exhaust valve from the seated state. The actuation piston body contains an actuation piston communication port and an actuation piston check valve configured to move between a first closed position and a first open position to provide a first hydraulic fluid flow pathway through the actuation piston communication port to the piston cavity. The reset device is received by a second pocket of the rocker arm, operatively associated with the actuation piston through at least one connecting conduit, and includes a reset check valve configured to move between a second closed position and a second open position to provide a second hydraulic fluid flow pathway through the at least one connecting conduit to the piston cavity, and a reset pressure control spring for applying a biasing force to the reset check valve to urge the reset check valve toward a second open position.

A second aspect of the invention provides a compression-release brake system for effectuating a compression-release engine braking operation in connection with an internal combustion engine including an engine cylinder that is associated with a four-stroke piston cycle including a compression stroke and an expansion stroke and is provided with at least one intake valve, at least one exhaust valve, and at least one exhaust valve return spring exerting a closing force on the exhaust valve to urge the exhaust valve into a seated state. The compression-release brake system includes a lost motion exhaust rocker assembly, an actuation piston, and a reset device. The lost motion rocker assembly includes a rocker arm. The actuation piston is slidably received by the rocker arm to define a piston cavity in the rocker arm and movable between a piston retracted position and a piston extended position. The actuation piston is configured to be operatively associated with the exhaust valve to permit unseating of the exhaust valve from the seated state. The actuation piston includes an actuation piston body containing a variable-volume accumulator cavity.

A third aspect of the invention provides a lost motion exhaust rocker assembly including a rocker arm and an actuation piston slidably received by the rocker arm to define a piston cavity in the rocker arm and movable between a piston retracted position and a piston extended position. The actuation piston is configured to be operatively associated with an exhaust valve of an engine cylinder of an internal combustion engine to permit unseating of the exhaust valve from the seated state. The actuation piston includes an actuation piston body containing a variable-volume accumulator cavity configured to feed hydraulic fluid to the piston cavity.

A fourth aspect of the invention provides an engine including the compression-release brake system of the first aspect of the invention.

A fifth aspect of the invention provides an engine including the compression-release brake system of the second aspect of the invention.

A sixth aspect of the invention provides an engine including the compression-release brake system of the third aspect of the invention.

A seventh aspect of the invention provides a method of effectuating a compression-release engine braking operation in connection with an internal combustion engine using the compression-release brake system of the first aspect of the invention.

A eighth aspect of the invention provides a method of effectuating a compression-release engine braking operation in connection with an internal combustion engine using the compression-release brake system of the second aspect of the invention.

A ninth aspect of the invention provides a method of effectuating a compression-release engine braking operation in connection with an internal combustion engine using the compression-release brake system of the third aspect of the invention.

Compression-release brake systems disclosed herein may be low cost and integrated into the overall engine design. Moreover, the compression-release brake systems may be lightweight, avoid mechanical and thermal overload of the engine system, exhibit quiet operation and high retarding power over the entire engine speed range where the engine brake is used.

Other aspects of the invention, including systems, assemblies, subassemblies, units, engines, processes, and the like which constitute part of the invention, will become more apparent upon reading the following detailed description of the exemplary embodiments.

The various aspects and embodiments of the invention described herein may be combined with one another. Such combinations would be within the purview of a skilled art having reference to this patent application.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In these drawings:

FIG. 2 is a fragmentary perspective view of an exhaust cam shaft and an exhaust rocker arm assembly according to the first exemplary embodiment of the present invention;

FIG. 3 is a perspective view of an exhaust rocker arm according to the first exemplary embodiment of the present invention with portions shown in phantom;

Figure 1:
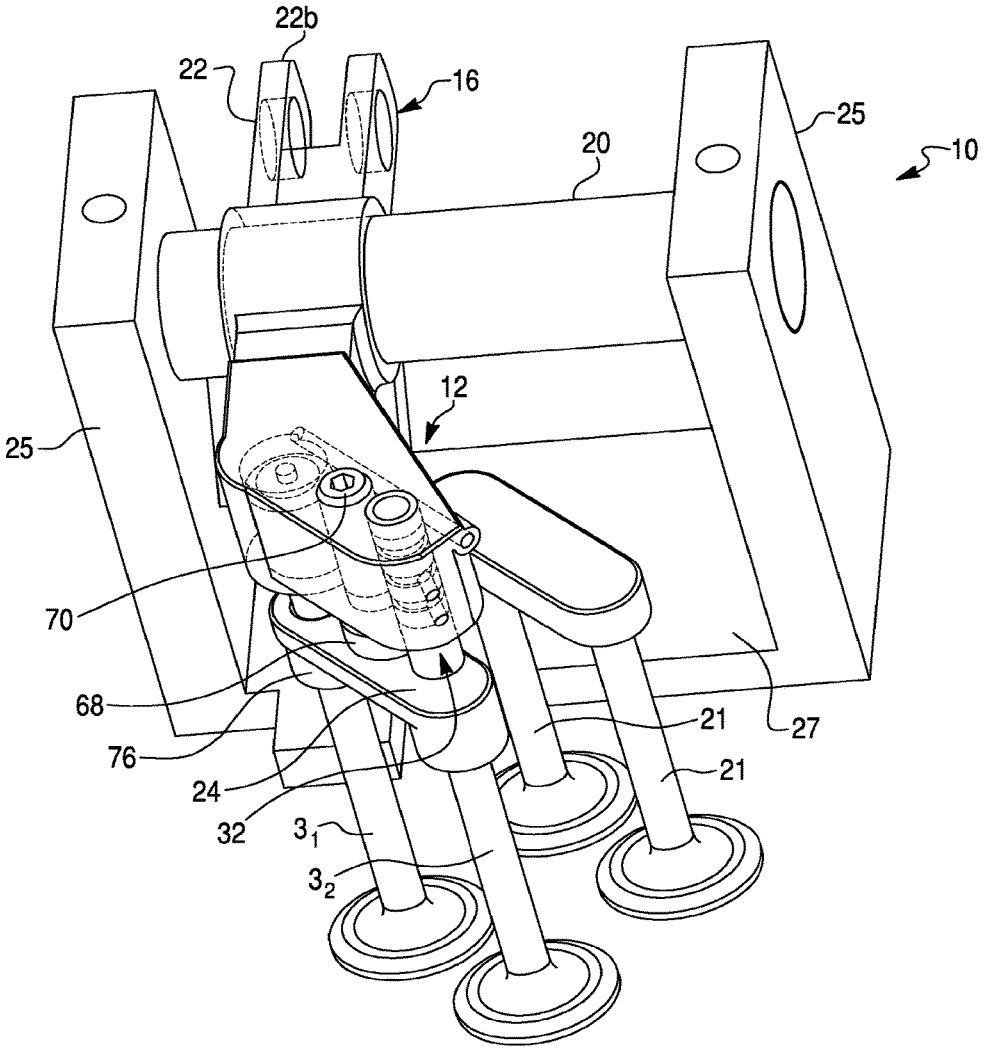
FIG. 1 is a perspective view of a valve train assembly including a rocker arm compression-release engine brake system according to a first exemplary embodiment of the present invention.

DETAILED DESCRIPTION OF EXEMPLARY EMBODIMENT(S) AND EMBODIED METHOD(S) OF THE INVENTION

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "front," "rear," "upper," "lower," "top," and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the words "a" and/or "an" as used in the claims mean "at least one".

In summary, exemplary embodiments disclosed herein utilize a reset mechanism carried by or integrated into an engine rocker arm which actuates one of two exhaust valves. The disclosed exhaust valve reset device can eliminate the opening of an unbalanced exhaust valve bridge and additionally minimize exhaust/intake valve overlap near the start of the intake stroke. Actuating one of two exhaust valves results in reducing valve train loading and provides the ability to delay exhaust valve opening resulting in increased charge for better braking performance. The reduced valve overlap increases exhaust manifold back pressure by reducing the exhaust manifold air mass flowing back into the intake manifold. The increased exhaust stroke pressure creates additional engine work by the engine brake during the exhaust stroke.

During brake operation, a reset check valve in the reset device is hydraulically locked due to the increasing cylinder pressure during the compression stroke. As the cylinder pressure drops after top dead center of the compression stroke, the hydraulic pressure applied to the reset check valve begins to correspondingly fall. Eventually the hydraulic pressure drops sufficiently so that a biasing force applied to the reset check valve overcomes the hydraulic force and the reset check valve opens and allows engine oil to flow and thus resets the exhaust valve and allows both exhaust valves to move during the exhaust cycle.

Figure 36:
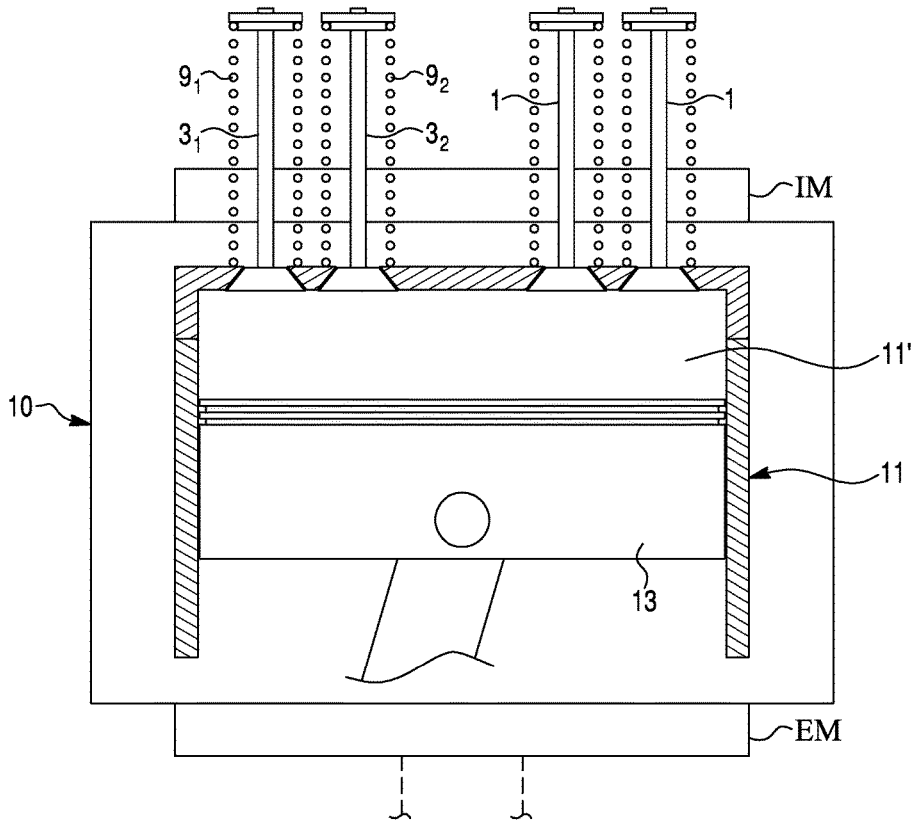
FIG. 36 is a schematic view of an internal combustion engine.

FIG. 36 illustrates an internal combustion (I/C) engine 10 that may be used with the rocker arm compression-release engine brake systems of the embodiments described herein. The engine 10 typically is a four-stroke diesel engine, comprising a cylinder block 11 including a plurality of cylinders 11'. For the sake of simplicity, only one cylinder 11' is shown in FIG. 36. The other cylinders are identical to the cylinder 11'. Each cylinder 11' is provided with a piston 13 that is reciprocatingly movable therein. Each cylinder 11' is also provided with two intake valves (both labeled with reference numeral 1) and two exhaust valves $\mathbf{3}_1$ and $\mathbf{3}_2$, each provided with a return spring. The return springs of the exhaust valves $\mathbf{3}_1$ and $\mathbf{3}_2$ are designated by reference numerals $\mathbf{9}_1$ and $\mathbf{9}_2$. A valve train is provided for lifting and closing the intake valves 1 and the exhaust valves $\mathbf{3}_1$ and $\mathbf{3}_2$.

It will be appreciated that each cylinder 11' may be provided with one or more intake valve(s) and one or more exhaust valve(s), although two of each are shown in FIG. 36. The engine also includes an intake manifold IM and an exhaust manifold EM both in fluid communication with the cylinder 11'. The IC engine 10 is capable of performing a positive power operation (normal engine cycle) and an engine brake operation (engine brake cycle). The compression-release brake systems operate in a compression brake mode during the engine brake operation and a compression brake deactivation mode during the positive power operation. When in engine brake mode, no fuel is provided to the cylinder, as is well known.

FIGS. 1-12 illustrate a first exemplary embodiment of a valve train assembly of an internal combustion engine, generally depicted by the reference character 10. The valve train assembly 10 includes a rocker arm compression-release engine brake system 12 according to the first exemplary embodiment of the present invention, provided for an internal combustion (IC) engine. Preferably, the IC engine is a four-stroke diesel engine, comprising a cylinder block including a plurality of cylinders. However, for the sake of simplicity, the valve train assembly 10 for only one cylinder is shown in FIG. 1. Each cylinder is provided with a piston that reciprocates therein. Each cylinder is further provided with at least one intake valve and at least one exhaust valve, each provided with a return spring and a valve train provided for lifting and closing the intake and exhaust valves. The IC engine is capable of performing a positive power operation (normal engine cycle) and an engine brake operation (engine compression-release brake cycle). The compression-release brake system 12 operates in a compression brake mode or brake-on mode (during the engine compression brake operation) and a compression brake deactivation mode or brake-off mode (during the positive power operation). A switch in the vehicle cab is typically used to shift between modes and to control fuel flow to the cylinders depending upon the mode.

The rocker arm compression-release engine brake system 12 according to the exemplary embodiment of the present invention is a lost motion engine brake system that, as best shown in FIG. 2, incorporates an exhaust cam 2 with a normal (conventional) engine exhaust cam profile 6, an engine brake lift profile 7 for a compression-release engine braking event during the engine brake operation, and a pre-charge lift profile 8. The cam lift profiles 7 and 8 are stylized for purposes of explanation. The normal engine powering mode (i.e., the normal engine cycle) incorporates sufficient clearance in the exhaust valve train to eliminate the additional cam lift profiles 7 and 8 during normal positive power engine operation.

The rocker arm compression-release engine brake system 12 according to the first exemplary embodiment of the present invention includes a conventional intake rocker assembly (not shown) for operating two intake valves 1, and an exhaust rocker assembly 16 for operating first and second exhaust valves $\mathbf{3}_1$ and $\mathbf{3}_2$. The exhaust rocker assembly 16 according to the first exemplary embodiment of the present invention is of a lost motion type provided with automatic hydraulic adjusting and resetting functions. The exhaust rocker assembly 16 includes an exhaust rocker arm 22 pivotally mounted about a rocker shaft 20 and provided to open the first and second exhaust valves $\mathbf{3}_1$ and $\mathbf{3}_2$ through an exhaust valve bridge 24. The rocker shaft 20 is supported by rocker arm supports (or rocker arm pedestals) 25 and extends through a rocker arm bore 33 formed in the exhaust rocker arm 22 (as best shown in FIGS. 1, 3 and 5B). The rocker arm pedestals 25 are in turn mounted to a pedestal support 27.

The exhaust rocker arm 22, as best shown in FIG. 3, has two ends: a driving (first distal) end 22*a* controlling the engine exhaust valves $\mathbf{3}_1$ and $\mathbf{3}_2$ and a driven (second distal) end 22*b* adapted to contact the exhaust cam 2, which is mounted to a rotating exhaust camshaft 4 (as best shown in FIG. 2). The exhaust cam 2 is provided with an exhaust lift profile 6, an engine brake lift profile 7, and a pre-charge lift profile 8.

The driven end 22*b* of the exhaust rocker arm 22 includes an exhaust cam lobe follower 21, as best shown in FIG. 2. The exhaust cam lobe follower 21 is adapted to contact the exhaust lift profile 6, the engine brake lift profile 7 and the pre-charge lift profile 8 of the exhaust cam 2.

Figure 4:
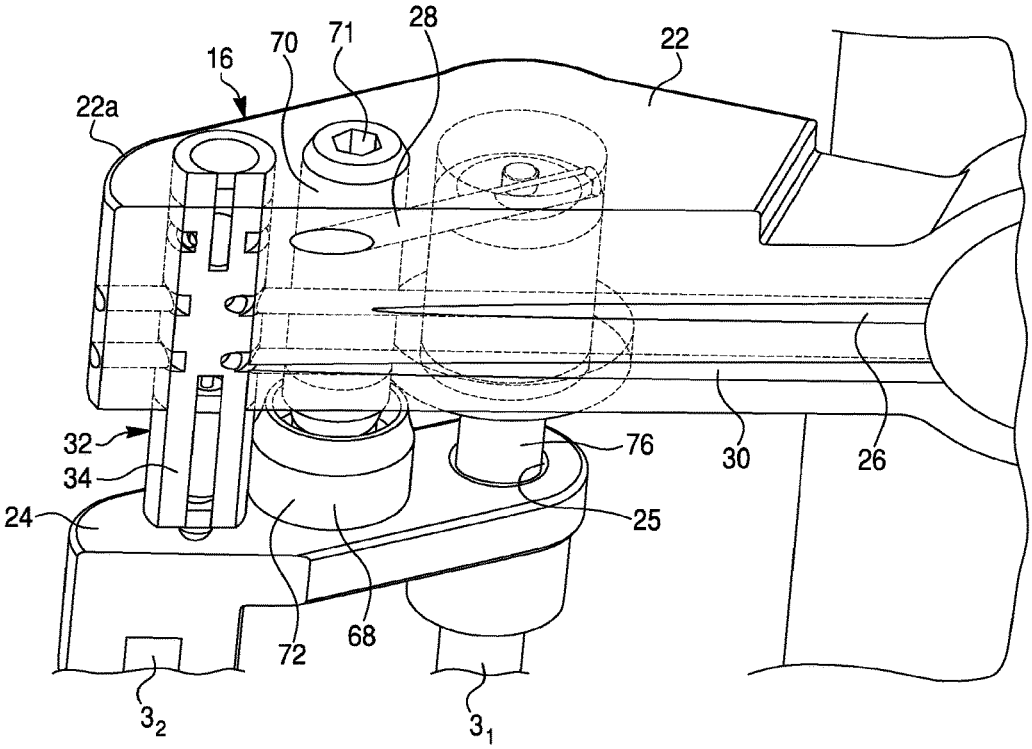
FIG. 4 is a partial perspective view of the rocker arm compression-release engine brake system according to the first exemplary embodiment of the present invention with portions shown in phantom.

Moreover, the exhaust rocker arm 22 also includes a rocker arm adjusting screw assembly 68 (as best shown in FIGS. 1, 3 and 4) adjustably, such as threadedly, mounted in a substantially cylindrical threaded screw bore 23*a* (FIG. 3) in the driving end 22*a* of the exhaust rocker arm 22. As best illustrated in FIGS. 1, 3 and 4, the rocker arm adjusting screw assembly 68 is provided to engage the exhaust valve bridge 24 in order to simultaneously open the exhaust valves $\mathbf{3}_1$ and $\mathbf{3}_2$. The rocker arm adjusting screw assembly 68 includes an adjustment screw 70 adjustably, such as threadedly, mounted in the substantially cylindrical threaded screw bore 23*a* in the driving end 22*a* of the exhaust rocker arm 22, and a contacting (so called "elephant") foot 72 swivelably mounted on one end of the adjustment screw 70 adjacent to the exhaust valve bridge 24.

The adjustment screw 70 is provided with a hexagonal socket 71 accessible from above the exhaust rocker arm 22 for setting a predetermined valve lash (or clearance) 8 between the contacting foot 72 of the adjusting screw assembly 68 and the exhaust valve bridge 24 when the exhaust rocker roller follower 21 is in contact with a lower base circle 5 on the exhaust cam 2, i.e., when the exhaust cam 2 is not acting (pressing) on the exhaust rocker arm 22. The predetermined valve lash δ is set to provide a normal exhaust valve motion during positive power operation with clearance for valve train component growth at engine operating temperatures. In an engine brake operation all lash (except the predetermined valve lash δ) is removed from the valve train and the brake cam profile determines the opening timing, profile and lift of the exhaust valves.

The lost motion engine brake rocker arm assembly 16 is part of the rocker arm compression-release engine brake system 12 provided for the internal combustion (IC) engine. Pressurized hydraulic fluid, such as engine oil, is supplied to the exhaust rocker arm 22 under high pressure through a high pressure hydraulic circuit, as best illustrated in FIGS. 1-3, to remove valve train lash (except the predetermined valve lash δ). As best illustrated in FIG. 4, the high pressure hydraulic circuit includes a continuous supply conduit (or passageway) 26, a high-pressure conduit 28 and a brake-on supply conduit 30. The brake-on supply conduit 30 is controlled by a solenoid valve, not shown, that selectively operates to supply the pressurized hydraulic fluid, e.g., engine oil, to the brake-on conduit 30. Throughout the embodiments discussed herein, it should be understood that the circuits shown in the drawings may include fewer or more conduits than shown. For example, functions of two or more conduits may be combined into a single conduit.

The exhaust rocker arm 22 further includes a substantially cylindrical actuation piston bore 64 (best shown in FIGS. 3 and 4) in the exhaust rocker arm 22 at the driving end 22*a* thereof for slidably receiving an actuation piston 62 (best shown in FIGS. 5A and 5B) therein. The actuation piston 62 is moveable between retracted and extended positions relative to the actuation piston bore 64 and is adapted to contact a top end surface 76*a* of a single-valve actuation pin 76 (best shown in FIGS. 5A, 5B and 6B). The single-valve actuation pin 76 is slidably movable relative to the exhaust valve bridge 24 through an opening 25 in the exhaust valve bridge 24 (best shown in FIG. 6A).

Figure 5A:
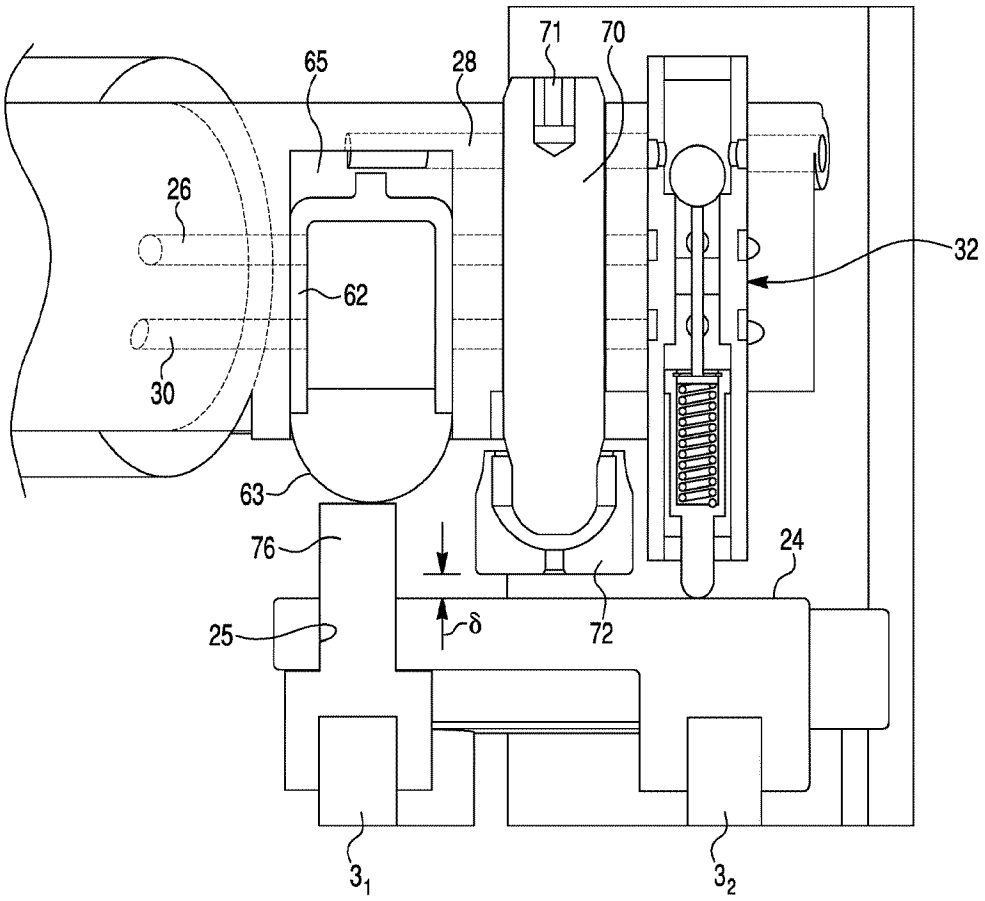
FIG. 5A is a fragmentary sectional view of the rocker arm compression-release engine brake system according to the first exemplary embodiment of the present invention in a brake-on mode.
Figure 5B:
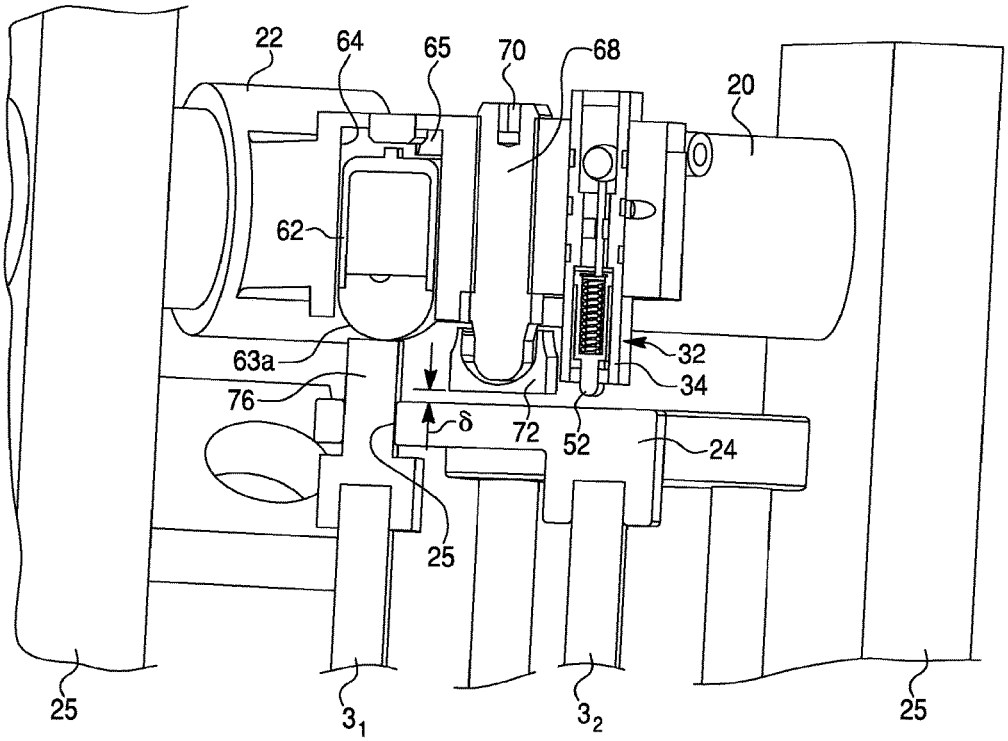
FIG. 5B is a fragmentary sectional view of the rocker arm compression-release engine brake system according to the first exemplary embodiment of the present invention in a brake-off mode.

The actuation piston 62 defines an actuation (or reset) piston cavity 65 within the actuation piston bore 64 in the exhaust rocker arm 22 (best shown in FIGS. 5A and 5B). The actuation piston 62, shown in detail in FIG. 7, includes a hemispherical bottom surface 63*a* provided to engage the single-valve actuation pin 76, and a rear extension 63*b* provided to contact a closed end of the actuation piston bore 64 so as to limit the rearward movement of the actuation piston 62 in the actuation piston bore 64 and prevent the actuation piston 62 from covering a hole in the actuation piston bore 64 fluidly connecting the actuation piston cavity 65 with the high-pressure conduit 28. In the extended position the rear extension 63*b* of the actuation piston 62 is spaced from the closed end of the actuation piston bore 64 by a piston clearance $k_1$ (shown in FIGS. 5C and 14), such as 0.15".

Moreover, the hemispherical bottom surface 63*a* of the actuation piston 62 of the exhaust rocker arm 22, which faces the exhaust valve bridge 24, is adapted to contact the top end surface 76*a* of the single-valve actuation pin 76. A bottom end surface 76*b* of the single-valve actuation pin 76, axially opposite to the first surface 76*a* thereof, engages a proximal end of the first exhaust valve $\mathbf{3}_1$. The exhaust single-valve actuation pin 76 allows the actuation piston 62 to apply sufficient pressing force against the first exhaust valve $\mathbf{3}_1$ to open the first exhaust valve $\mathbf{3}_1$ (only one of the two exhaust valves 3) during the compression-release engine braking operation (i.e., in the brake-on mode). In other words, the single-valve actuation pin 76 is reciprocatingly movable relative to the exhaust valve bridge 24 so as to make the first exhaust valve $\mathbf{3}_1$ movable relative to the second exhaust valve $\mathbf{3}_2$ and the exhaust valve bridge 24. Consequently, a bridge surface 76*c* of the single-valve actuation pin 76 (best shown in FIG. 6B) is spaced from the exhaust valve bridge 24 by an actuation pin clearance $k_2$ (best shown in FIGS. 5C and 14), such as 0.05", during the compression-release engine braking event of the engine compression brake operation.

Figure 10:
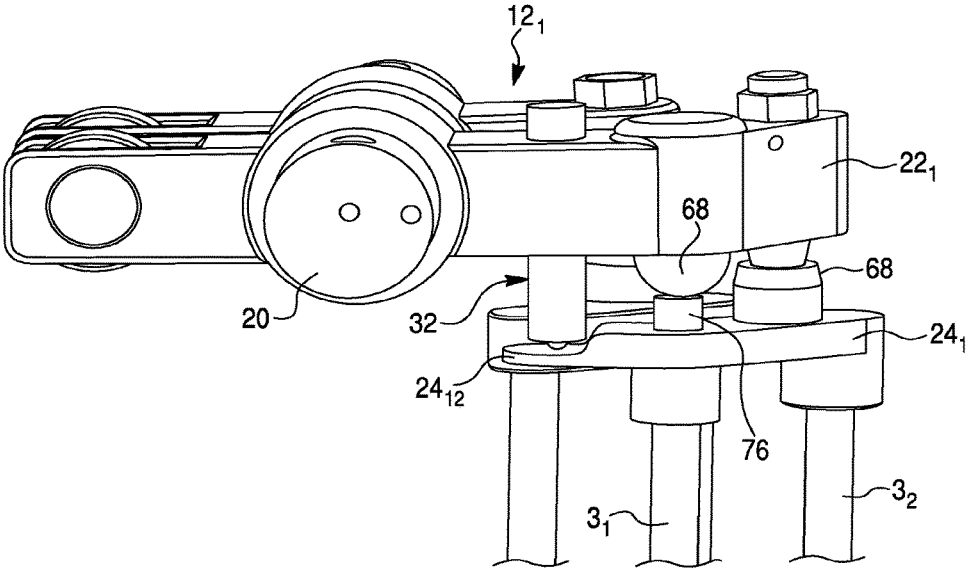
FIG. 10 is a perspective view of a valve train assembly including a rocker arm compression-release engine brake system according to an alternative to the first exemplary embodiment of the present invention.

The rocker arm compression-release brake system 12 further comprises an exhaust valve reset device 32 disposed in the exhaust rocker arm 22. The reset device 32 according to the first exemplary embodiment of the present invention (shown in detail FIGS. 8-98) is in the form of a substantially cylindrical, hollow cartridge and comprises a substantially cylindrical cartridge body 34 provided with an annular supply groove 36 fluidly connected with the continuous supply conduit 26, an annular brake-on groove 38 fluidly connected with the brake-on supply conduit 30, and an annular piston groove 40 fluidly connected with the high-pressure conduit 28. As best illustrated in FIGS. 1, 4, 5A and 5B, the cylindrical cartridge body 34 of the reset device 32 is disposed outboard of the adjusting screw assembly 68 at the driven (second distal) end 22*b* of the exhaust rocker arm 22. Alternatively, as illustrated in FIG. 10, the cartridge of the reset device 32 is located inboard of the adjusting screw assembly 68. An exhaust valve bridge $\mathbf{24}_1$ has a bridge extender $\mathbf{24}_{12}$ for trigger contact. As further shown in FIG. 10, the elongated distal end 52 of the reset trigger 50 is slightly spaced from the bridge extender $\mathbf{24}_{12}$ of the exhaust valve bridge $\mathbf{24}_1$ when the reset trigger 50 is in the extended position. Thus, the cartridge of the reset device 32 can be located both inboard and outboard or parallel to the rocker shaft with a fixed cam profile to the rocker supports.

Each of the supply groove 36, the brake-on groove 38, and the piston groove 40 are on an outer peripheral cylindrical surface of the cartridge body 34 and axially spaced from each other. Moreover, the supply groove 36 is provided with at least one continuous supply port 37 through the cartridge body 34, the brake-on groove 38 is provided with at least one brake-on supply port 39 through the cartridge body 34, and the piston groove 40 is provided with at least one piston supply port 41 through the cartridge body 34. The cylindrical cartridge body 34 is non-movably disposed within a substantially cylindrical reset bore 23*b* in the exhaust rocker arm 22. Thus, the high-pressure conduit 28 fluidly connects the actuation piston bore 64 (the piston cavity 65) with the piston groove 40 of the cartridge body 34 of the reset device 32. An inner cavity 42 within the cylindrical cartridge body 34 is enclosed between an upper cartridge plug 35*a* and a lower cartridge plug 35*b*. In other words, the annular grooves 36, 38 and 40 are fluidly connected to the inner cavity 42 of the cartridge body 34 through one or more ports (or drillings) 37, 39 and 41. As best illustrated in FIGS. 4-5B, the cartridge body 34 is axially spaced from the exhaust valve bridge 24.

Figure 9A:
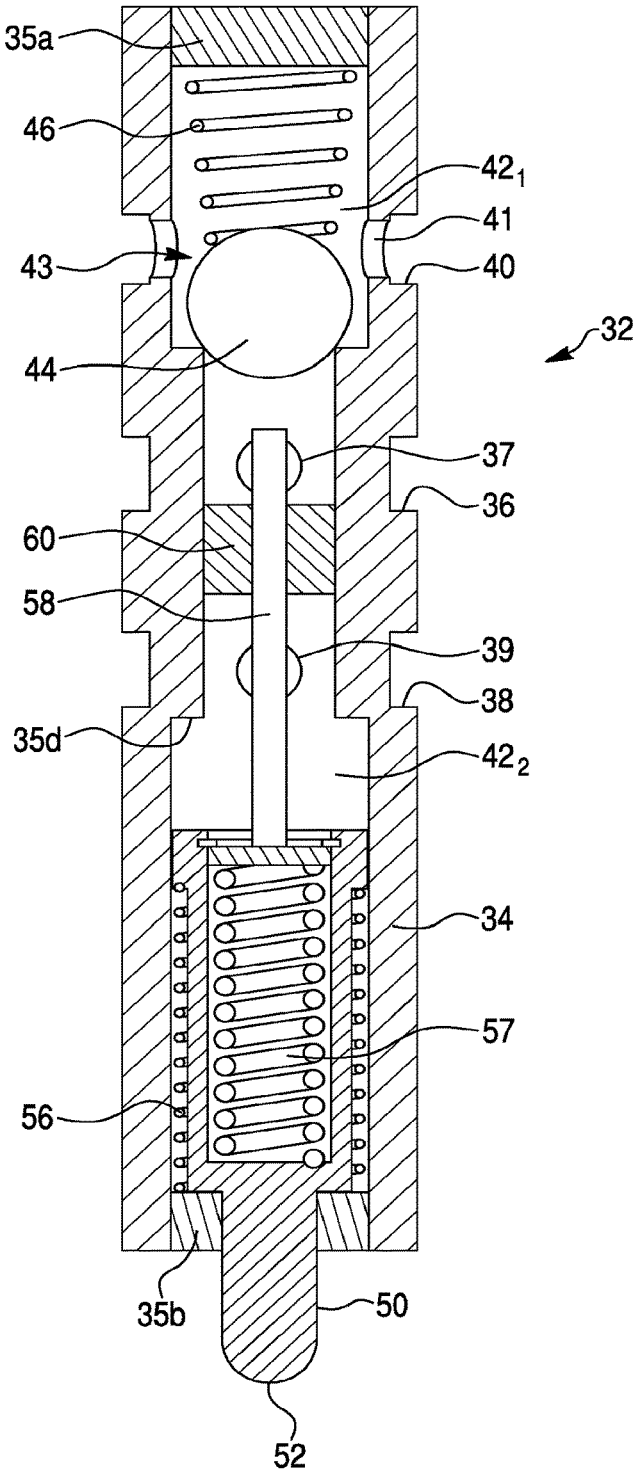
FIG. 9A is a sectional view of an exhaust valve reset device according to the first exemplary embodiment of the present invention in the brake-on mode.
Figure 9B:
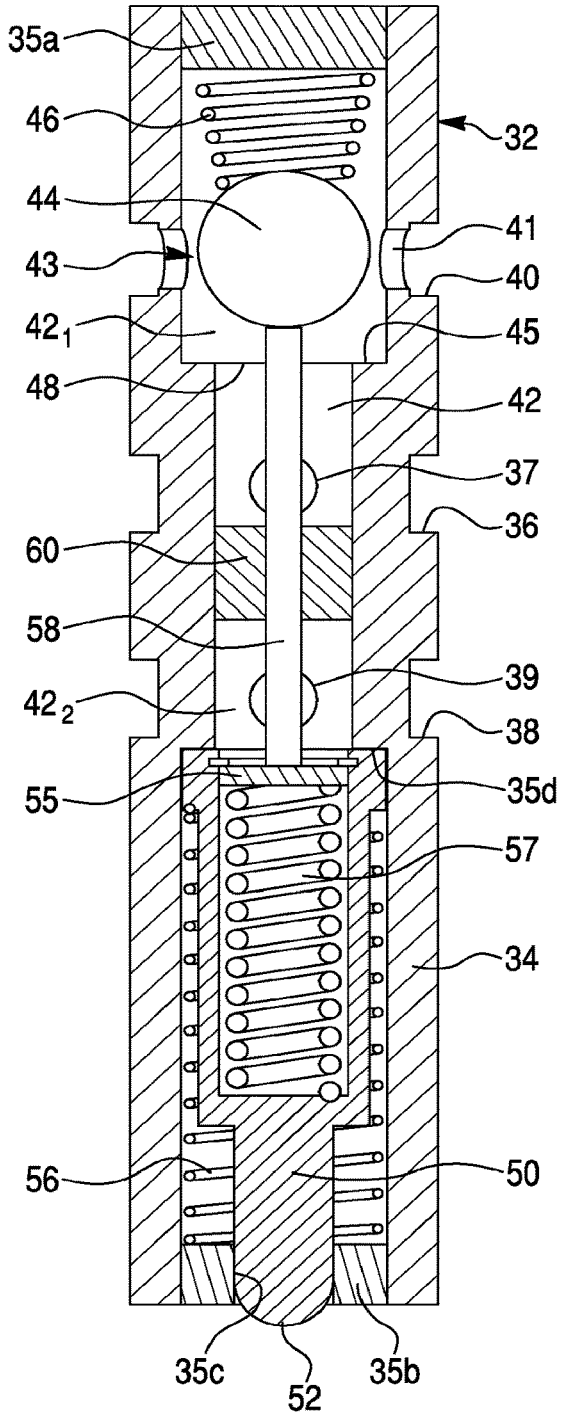
FIG. 9B is a sectional view of the exhaust valve reset device according to the first exemplary embodiment of the present invention in the brake-off mode.

The reset device 32, as best shown in FIGS. 9A and 9B, further comprises a ball-valve member 44, a check-valve seat 45, and a ball-check spring 46 disposed between the ball-valve member 44 and the upper cartridge plug 35*a*. The ball-valve member 44 is urged toward the ball-check seat 45 by a biasing spring force of the ball-check spring 46. When the ball-valve member 44 is seated on the check-valve seat 45, communication port 48 in the cartridge body 34 is closed. When open, the communication port 48 fluidly connects the continuous supply port 37 and the piston supply port 41 of the cartridge body 34. The ball-valve member 44, the ball-check seat 45, and the ball-check spring 46 define a reset check valve 43 normally biased closed by the ball-check spring 46. The reset check valve 43 is disposed between the continuous supply conduit 26 and the actuation piston cavity 65, and provides selective fluid communication between the continuous supply conduit 26 and the high-pressure conduit 28. It will be appreciated that any appropriate type of the check valve is within the scope of the present invention.

The exhaust valve reset device 32 further comprises a reset trigger 50 axially slidable within the cartridge body 34. The reset trigger 50 has an elongated distal end 52 shown in retracted and extended positions as at least partially extending from the cartridge body 34 through a bore 35*c* in the lower cartridge plug 35*b*. In the retracted position, the distal end 52 may be stowed within the cartridge body 34. The reset trigger 50 is movable relative to the cartridge body 34 between an extended position shown in FIGS. 5A and 9A, and a retracted position shown in FIGS. 5B and 9B. The reset trigger 50 is normally biased toward the retracted position by trigger return spring 56 disposed between a proximal end of the reset trigger 50 (axially opposite the distal end 52 thereof) and the lower cartridge plug 35*b*. The reset trigger 50 is configured to lift, through the resilient biasing action of the trigger return spring 56, an upset pin 58, which contacts, lifts and holds the ball-valve member 44 off the ball-check seat 45 during non-engine brake operations. An upper end of the upset pin 58 is disposed adjacent to the ball-valve member 44, while a lower end of the upset pin 58 engages the reset trigger 50 through a spring retainer 55 and a reset pressure spring 57 disposed inside the reset trigger 50 between the distal end 52 thereof and the spring retainer 55.

When the reset trigger 50 is in the trigger retracted position (as best shown in FIGS. 5B and 9B), the reset pressure spring 57 applies an upward biasing force against the ball-valve member 44 through the upset pin 58. Whether the upward biasing force is sufficient to move the ball-valve member 44 into an open position depends on the pressure differential across the ball-valve member 44, as discussed further below. On the other hand, in the extended position of the reset trigger 50 (shown in FIGS. 5A and 9A), the upward biasing force of the reset pressure spring 57 is removed from the ball-valve member 44 by spacing the upset pin 58 from the ball-valve member 44. Depending upon pressure differences across the ball-valve member 44, the ball-valve member 44 may be returned to a closed position and held on the ball-check seat 45 by the biasing force of the ball-check spring 46 so as to close the communication port 48 in the cartridge body 34, and thus fluidly disconnect the continuous supply port 37 and the piston supply port 41 of the cartridge body 34.

As further shown in FIG. 5A, the elongated distal end 52 of the reset trigger 50 is in contact with the exhaust valve bridge 24 when the reset trigger 50 is in the extended position thereof. Moreover, when the reset trigger 50 is in the extended position, the reset trigger 50 engages the lower cartridge plug 35*b*, which limits the outward axial movement of the reset trigger 50 in the direction toward the exhaust valve bridge 24. However, when the reset trigger 50 is in the retracted position thereof (FIG. 5B), the elongated distal end 52 of the reset trigger 50 is axially spaced from the exhaust valve bridge 24, as best illustrated in FIG. 5B.

The trigger return spring 56 biases the reset trigger 50 upwardly to a counter-bore stop 35*d* in the cartridge body 34. The reset pressure spring 57, used only during the engine brake-on mode, has a higher spring force than the conical ball-check spring 46 enabling the upset pin 58 to keep the ball check 44 off the ball-check seat 45, thus allowing oil from the continuous supply conduit 26 to flow unrestricted into and out of the actuation piston cavity 65 to remove the actuation piston lash during the positive power engine operation to eliminate valve train clatter.

As best illustrated in FIGS. 9A and 9B, the upset pin 58 extends through a guide pin sleeve 60 supporting and guiding the reciprocal, linear movement of the upset pin 58. As further illustrated in FIGS. 9A and 9B, the inner cavity 42 of the cartridge body 34 is divided by the guide pin sleeve 60 into a check-valve cavity $\mathbf{42}_1$ and a reset cavity $\mathbf{42}_2$. According to the first exemplary embodiment of the present invention, the reset cavity $\mathbf{42}_2$ is in fluid communication with the brake-on oil supply conduit 30 through the brake-on groove 38 and the brake-on supply port 39. The reset check valve 43 selectively provides fluid communication between the continuous supply conduit 26 and the high-pressure conduit 28, i.e., between the continuous supply conduit 26 and the actuation piston cavity 65.

Figure 5C:
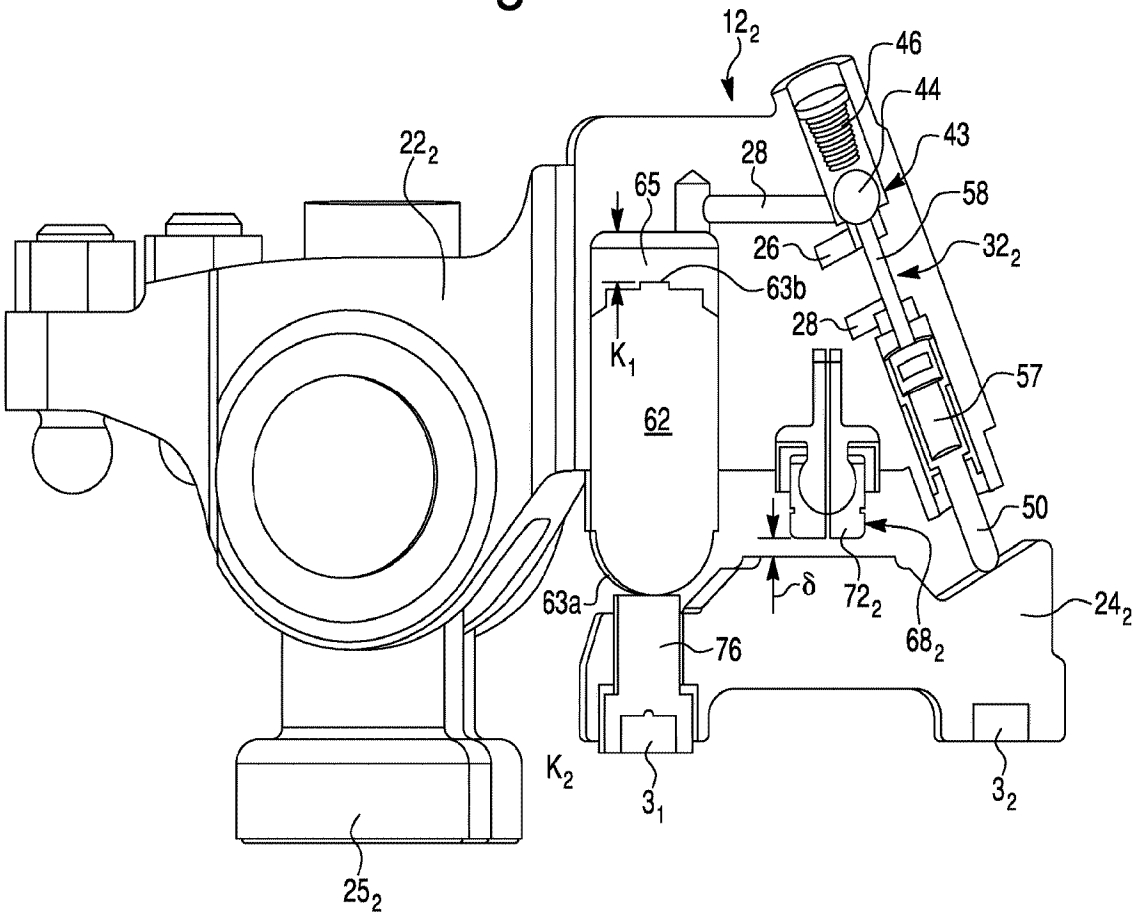
FIG. 5C is a fragmentary sectional view of the rocker arm compression-release engine brake system according to alternative exemplary embodiment of the present invention in a brake-off mode.

FIG. 5C illustrates an alternative embodiment of a rocker arm compression-release engine brake system $\mathbf{12}_2$. The rocker arm compression-release engine brake system $\mathbf{12}_2$ is structurally and functionally substantially similar to the compression-release engine brake system 12 according to the first exemplary embodiment, and differs primarily by reset device $\mathbf{32}_2$. The alternative reset device $\mathbf{32}_2$ is structurally substantially similar to the reset device 32 according to the first exemplary embodiment. A difference between these two reset devices is that the alternative reset device $\mathbf{32}_2$, contrary to the reset device 32 according to the first exemplary embodiment, does not include the cylindrical cartridge body 34 of the reset device 32 disposed within the cylindrical reset bore 23*b* in the exhaust rocker arm 22. Instead, the reset device 322 is machined directly into a rocker arm $\mathbf{22}_2$, as illustrated in FIG. 5C. In other words, the cylindrical reset bore 23*b* in the exhaust rocker arm $\mathbf{22}_2$ is machined to imitate the cartridge body 34 of the reset device 32. The alternative reset device $\mathbf{32}_2$ operates substantially similarly to the reset device 32 according to the first exemplary embodiment.

Figure 5D:
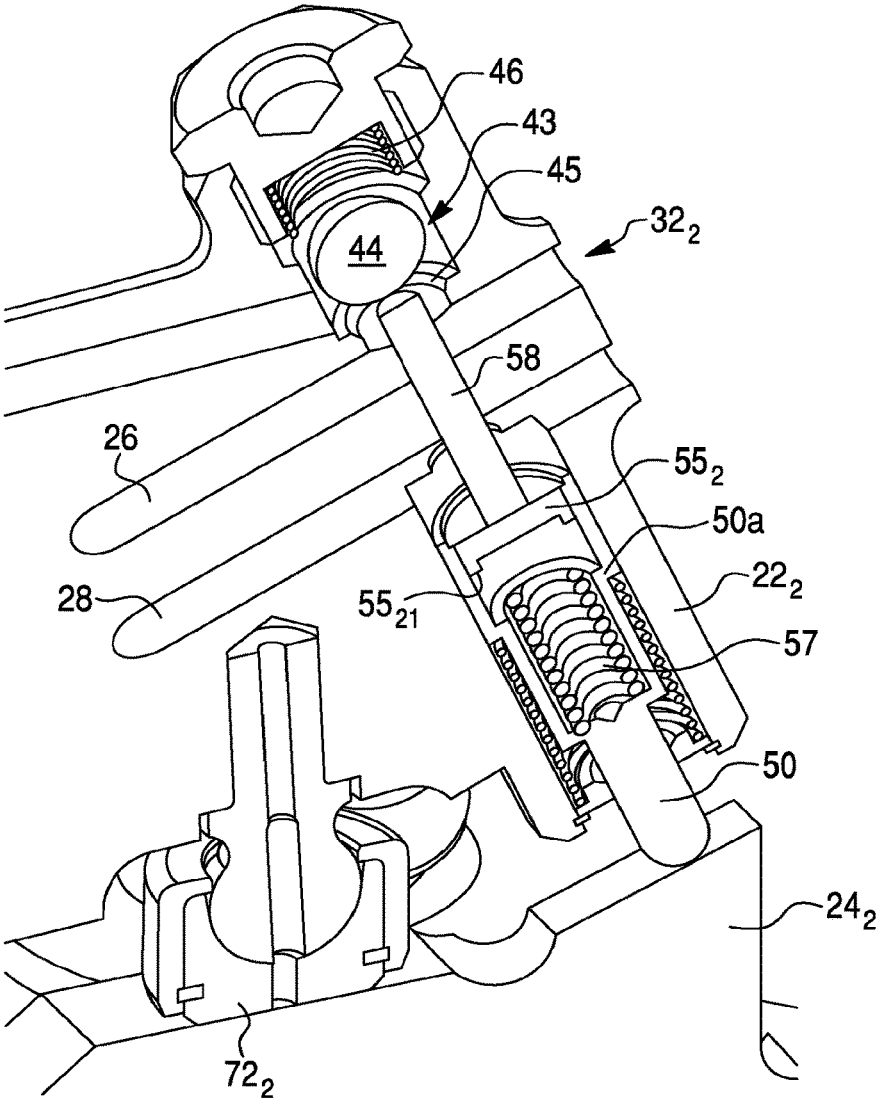
FIG. 5D is an enlarged fragmentary sectional view of a reset device of the rocker arm compression-release engine brake system of FIG. 5C.
Figure 6A:
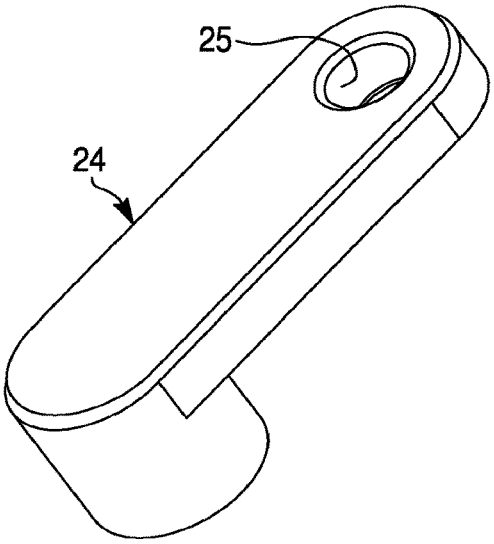
FIG. 6A is a perspective view of an exhaust valve bridge according to the first exemplary embodiment of the present invention.
Figure 6B:
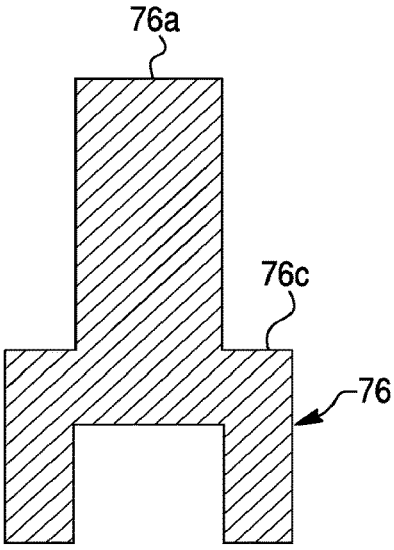
FIG. 6B is a sectional view of a single-valve actuation pin according to the first exemplary embodiment of the present invention.
Figure 8:
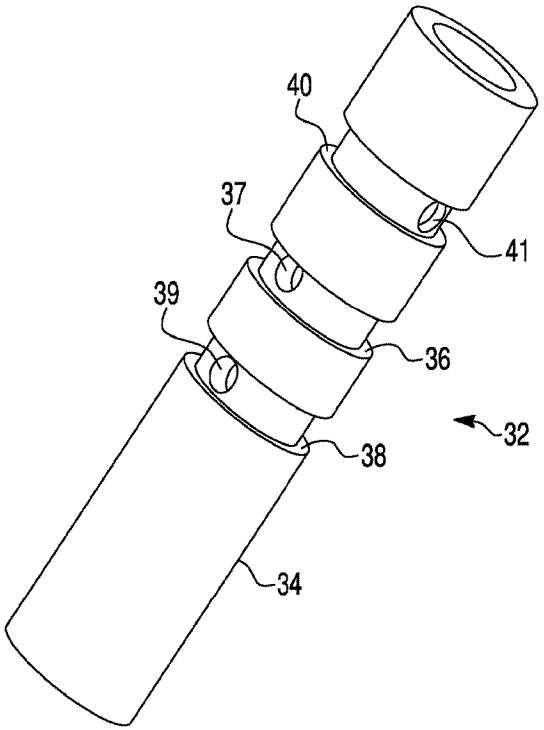
FIG. 8 is a perspective view of a cartridge body according to the first exemplary embodiment of the present invention.
Figure 7:
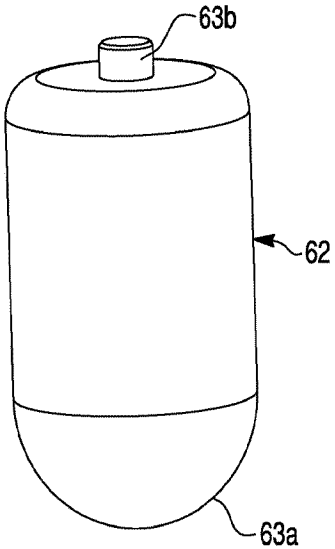
FIG. 7 is a perspective view of an actuation piston according to the first exemplary embodiment of the present invention.

As further illustrated in FIG. 5D, a reset trigger 50 of the reset device $\mathbf{32}_2$ has an annular internal stop portion 50*a* facing a cup-shaped spring retainer $\mathbf{55}_2$. In turn, the spring retainer $\mathbf{55}_2$ has an annular stop portion $\mathbf{55}_{21}$ facing the internal stop portion 50*a* of the reset trigger 50. The stop portion 50*a* of the reset trigger 50 and the stop portion $\mathbf{55}_{21}$ of the spring retainer $\mathbf{55}_2$ define a reset failsafe mechanism provided for protecting against failure of the pressure spring 57 internal to the reset trigger 50 resulting in the single engine brake exhaust valve $\mathbf{3}_1$ not being reset prior to the normal exhaust motion resulting in an unbalanced exhaust valve bridge and possible engine damage.

Specifically, the stop portion $\mathbf{55}_{21}$ of the spring retainer $\mathbf{55}_2$ defines a mechanical stop activated by exceeding additional upward stroke of the reset trigger 50 than normal maximum stroke of the reset trigger 50. This additional stroke of the reset trigger 50 would occur should the pressure spring 57 fail and does not force the ball check 44 off its seat 45 and the single engine brake exhaust valve $\mathbf{3}_1$ does not reset prior to normal exhaust valve lift with a balanced bridge. The additional stroke of the elephant foot $72_2$ pressing on a center of the exhaust valve bridge $24_2$ results in a small unbalance of the exhaust valve bridge $24_2$ until the addition of the trigger stroke resulting from the rocker rotation during the normal exhaust valve motion forces the stop portion $55_{21}$ of the spring retainer $55_2$ to contact the internal stop portion 50*a* of the reset trigger 50. Then the reset trigger 50 through the upset pin 58 mechanically forces the ball check 44 off the seat 45 of the reset check valve 43 during the beginning of the exhaust valve stroke. This mechanical forcing of the ball check 44 off its seat 45 during the beginning of the normal exhaust lift profile continues until engine brake operation.

Figure 11A:
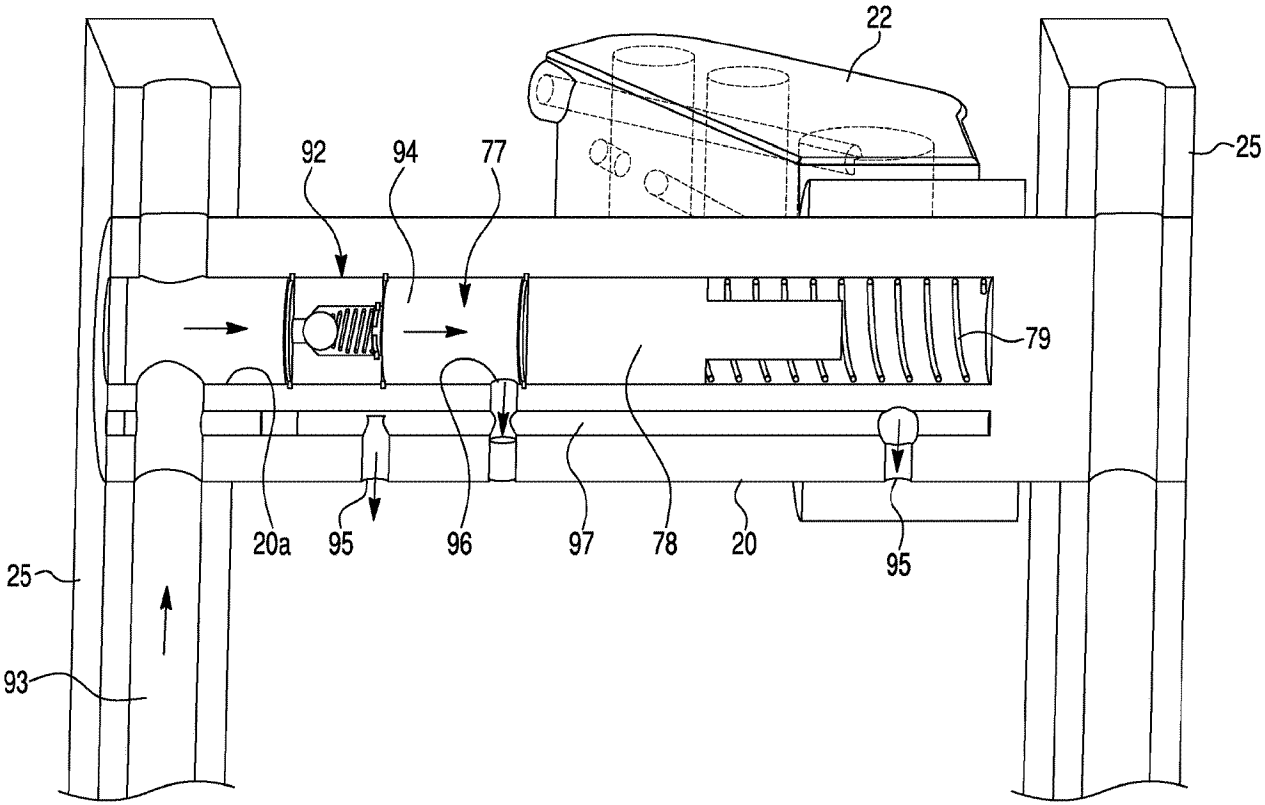
FIG. 11A shows pressurized hydraulic fluid supply to the rocker arm compression-release engine brake system according to the exemplary embodiment of the present invention with portions shown in phantom.
Figure 11B:
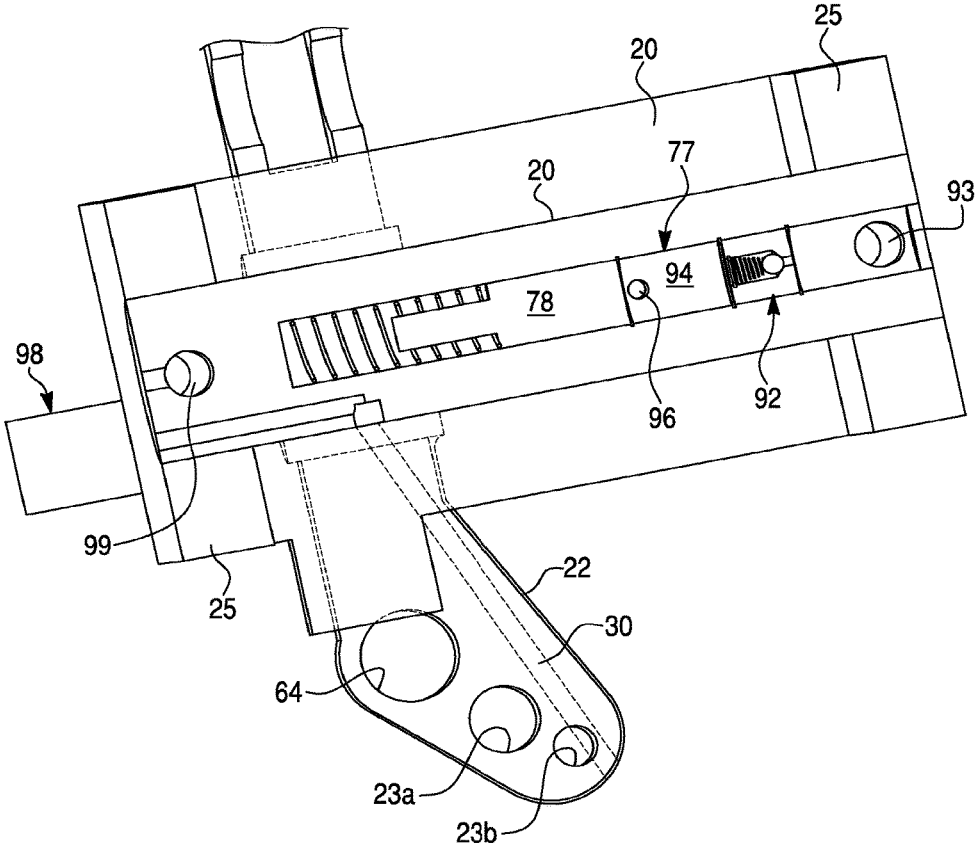
FIG. 11B is an alternative view of the pressurized hydraulic fluid supply to the rocker arm compression-release engine brake system according to the exemplary embodiment of the present invention with portions shown in phantom.

The rocker shaft 20 according the exemplary embodiment of the present invention, shown in FIGS. 11A and 11B, includes a substantially cylindrical accumulator bore 20*a* therein, and a rocker shaft accumulator 77. The rocker shaft accumulator 77 comprises a substantially cylindrical accumulator piston 78 slidingly movable within the accumulator bore 20*a*, an accumulator ball-check valve 92 and an accumulator cavity 94 defined between the accumulator piston 78 and the accumulator ball-check valve 92. The accumulator piston 78 is spring loaded by accumulator spring 79 so as to be biased toward the accumulator ball-check valve 92. The accumulator ball-check valve 92 is oriented so as to allow the hydraulic fluid only into the accumulator cavity 94, but prevents flow of the hydraulic fluid from the accumulator cavity 94 through the accumulator ball-check valve 92. In other words, the accumulator ball-check valve 92 prevents oil flow back into oil supply. The accumulator ball-check valve 92 is biased into a closed position by a ball check spring. The rocker shaft accumulator 77 stores the return hydraulic fluid under pressure for the next refilling of the actuation piston cavity 65 for next engine exhaust cam motion.

As further shown in FIGS. 11A-11D, pressurized hydraulic fluid is supplied through hydraulic fluid supply passage 93 formed in one or more of the rocker arm supports 25 (preferably, in hold down bolts of the rocker arm supports 25). The hydraulic fluid supply passage 93 is fluidly connected to the accumulator bore 20*a*. The rocker shaft 20 further includes a connecting passage 97 fluidly connected to the accumulator cavity 94 through connecting port 96. The connecting passage 97 is provided with at least one supply port 95 fluidly connected to the continuous supply conduit 26 in the exhaust rocker arm 22.

In operation, the pressurized hydraulic fluid is supplied to the accumulator cavity 94 through the supply passage 93 and the accumulator ball-check valve 92. Then, the pressurized hydraulic fluid flows from the accumulator cavity 94 to the continuous supply conduit 26 of the exhaust rocker arm 22 through the connecting port 96, the connecting passage 97 and the supply port 95. During engine braking reset operation, the pressurized hydraulic fluid is dumped back into the rocker shaft accumulator cavity 94. The accumulator ball-check valve 92 prevents hydraulic fluid flow back into the hydraulic fluid supply passage 93.

Figure 11C:
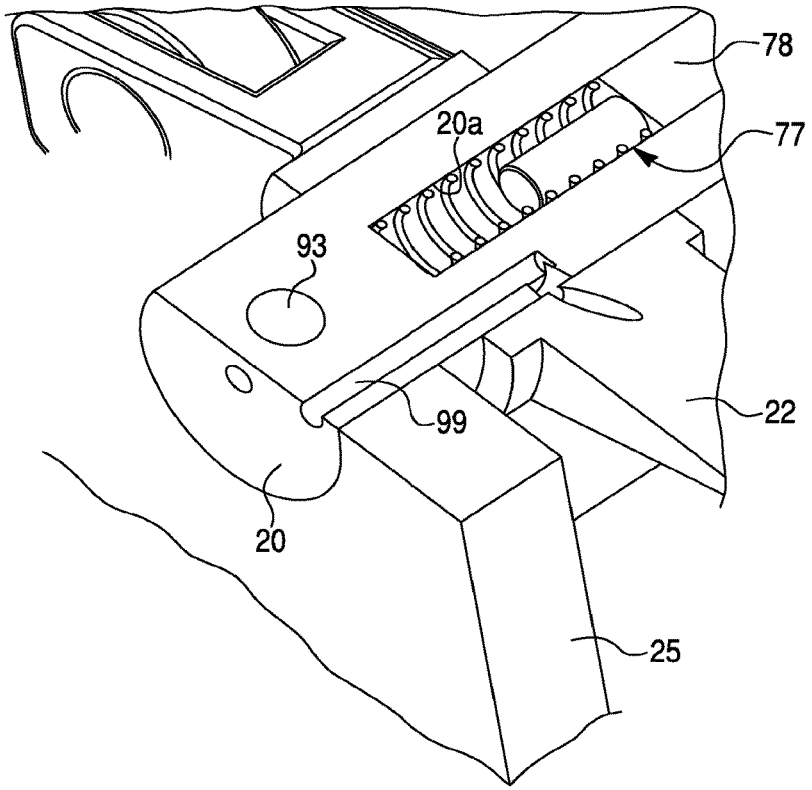
FIG. 11C is a perspective view of a rocker arm pedestal supporting a rocker shaft.
Figure 11D:
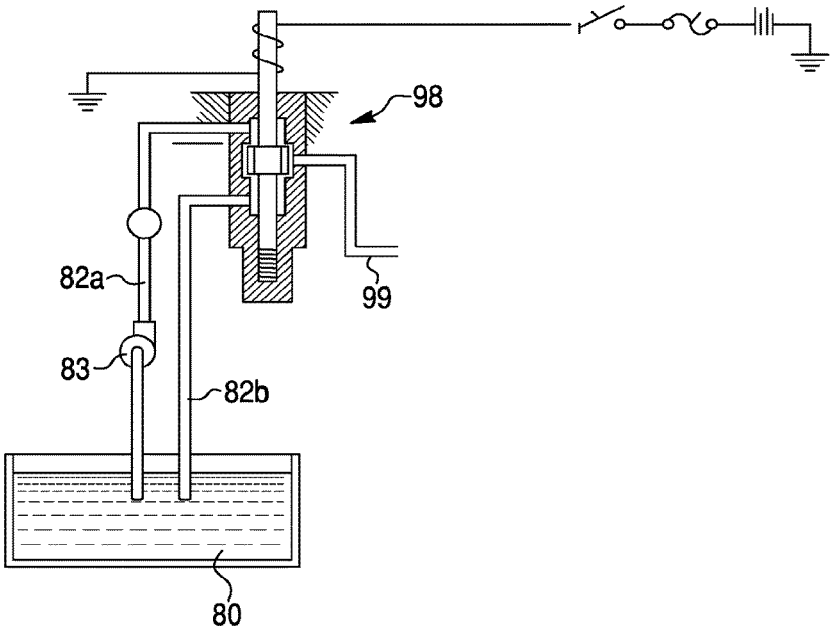
FIG. 11D is a schematic view of brake-on supply passageway.

The rocker arm compression-release brake system 12 further comprises an on-off solenoid valve 98, shown in FIGS. 11B and 11D, selectively providing the brake-on supply conduit 30 of the rocker arm compression-release brake system 12 with pressurized hydraulic fluid. The brake-on pressurized hydraulic fluid is selectively supplied to the brake-on supply conduit 30 through operation of the on-off solenoid valve 98 mounted on one of the rocker arm pedestals 25, and a brake-on oil supply passage 99 formed in the exhaust rocker arm 22 and fluidly connected to the brake-on supply conduit 30, as best shown in FIGS. 11B and 11C. As further illustrated in FIG. 11D, the pressurized hydraulic fluid, such as engine oil, is supplied from a sump 80 to the on-off solenoid valve 98 by fluid pump 83 through a brake supply passage 82*a*, and returned (or dumped) back to the sump 80 through brake-off dump passage 82*b*.

The positive power operation of the engine is as follows. During positive power operation, i.e., when the engine brake is not activated, the hydraulic fluid continuous supply conduit 26 provides continuous flow of hydraulic fluid, such as motor oil, to the check-valve cavity $42_1$ through the continuous supply groove 36 and the continuous supply port 37. Moreover, during positive power operation, the reset trigger 50 is in the retracted position due to the biasing force of the trigger return spring 56. In this position, the ball-valve member 44 is lifted off the ball-check seat 45 (to an open position of the reset check valve 43) by the reset trigger 50. Specifically, the reset trigger 50 lifts, through the resilient biasing action of the trigger return spring 56 and the upset pin 58, which contacts, lifts and holds the ball-valve member 44 off the ball-check seat 45 for all non-engine brake operation. As the reset check valve 43 is open, the pressurized hydraulic fluid flows past the check valve 43 from the check-valve cavity $42_1$ through the piston supply port 41 and into the high-pressure conduit 28. Then, the pressurized hydraulic fluid flows through the high-pressure conduit 28 into the actuation piston bore 64. The pressurized hydraulic fluid completely fills the actuation piston cavity 65, thus eliminating valve train lash (except the predetermined valve lash δ), such as actuation piston lash, i.e., lash between the actuation piston 62 and the single-valve actuation pin 76. The increase in the volume of the hydraulic fluid in the actuation piston cavity 65 also allows the exhaust rocker roller follower 21 to maintain contact with the exhaust camshaft brake lift profile 7 and with the added displacement created by the actuation piston 62, eliminates the brake lift and provides a normal exhaust valve profile for the exhaust stroke marked in FIG. 12 as an exhaust valve lift profile 85, i.e., a brake-off valve lift.

In the engine brake-off mode, with the valve train lash eliminated (except the predetermined valve lash δ), the exhaust rocker arm 22 then proceeds from the lower base circle 5 on the exhaust cam 2 to the engine brake lift profile 7. When the engine brake lift profile 7 acts on the driven end 22*b* of the exhaust rocker arm 22 and pivotally rotates the exhaust rocker arm 22, and a distal end of the actuation piston 62 presses on the single-valve actuation pin 76, in turn pressing on an exhaust valve stem of the exhaust valve $3_1$ only. Subsequently, the actuation piston 62 is forced to move upwardly so as to reduce the volume of the actuation piston cavity 65 without opening the exhaust valve $3_1$. This results in increased pressure in the actuation piston cavity 65 created by a force of an exhaust valve spring $9_1$ (shown in FIG. 19), inertia forces and cylinder pressure. This upward travel (movement) of the actuation piston 62 causes displacement of the hydraulic fluid from the actuation piston cavity 65 back into the continuous supply conduit 26 through the open check valve 43. The volume of the hydraulic fluid below the actuation piston cavity 65 flows through the continuous supply conduit 26 back to the accumulator cavity 94 in the rocker shaft 20. Moreover, due to the predetermined valve lash δ, the adjusting screw assembly 68 does not press onto the exhaust valve bridge 24. Thus, the exhaust valves $3_1$ and $3_2$ remain closed throughout the compression stroke during the positive power operation of the engine.

During the exhaust stroke of the positive power operation, when the exhaust cam profile 6 acts on the driven end 22*b* of the exhaust rocker arm 22 and pivotally rotates the exhaust rocker arm 22, the single-valve actuation pin 76 presses on the actuation piston 62. Subsequently, the actuation piston 62 is forced to move upwardly so as to reduce the volume of the actuation piston cavity 65. This results in increased pressure in the actuation piston cavity 65 created by the force of the exhaust valve spring $\mathbf{9}_1$ (shown in FIG. 19) of the exhaust valve $\mathbf{3}_1$, inertia forces and cylinder pressure. Again, the upward travel (movement) of the actuation piston 62 causes the displacement of the hydraulic fluid from the actuation piston cavity 65 back into the continuous supply conduit 26 through the open check valve 43. The volume of the hydraulic fluid below the actuation piston cavity 65 flows through the continuous supply conduit 26 back to the accumulator cavity 94. Then, when the predetermined valve lash δ is taken up and the rocker arm adjusting screw assembly 68 presses on the exhaust valve bridge 24, the exhaust valve bridge 24 presses on and opens the exhaust valves $\mathbf{3}_1$ and $\mathbf{3}_2$ as during the conventional engine exhaust stroke illustrated as the exhaust valve lift profile 85 in FIG. 12. Specifically, when the rocker arm adjusting screw assembly 68 presses on the exhaust valve bridge 24, the exhaust valve bridge 24 presses on the second exhaust valve $\mathbf{3}_2$ directly on a bridge surface 76*c* of the single-valve actuation pin 76, which, in turn, presses and opens the first exhaust valve $\mathbf{3}_1$.

When the engine brake is not activated (brake-off mode) and the exhaust cam is on the lower base circle 5, the actuation piston 62 extends in the actuation piston bore 64 in the exhaust rocker arm 22 to remove all valve train lash (except the predetermined valve lash δ). The engine brake profile 7 of the exhaust cam 2 cannot open the exhaust valve $\mathbf{3}_1$ for compression release braking because the reset check valve 43 is held open by the upset pin 58. The hydraulic fluid flows out of the actuation piston cavity 65 and into the rocker shaft accumulator 77 located in the rocker shaft 20 (as shown in FIGS. 11A and 11B). This added hydraulic fluid removes all of the valve train clearance in the valve train assembly. The removal of this clearance by the hydraulic fluid eliminates valve train noise and possible valve train damage.

During the brake-on mode, the solenoid valve 98 is energized, allowing the brake-on pressurized hydraulic fluid to be supplied to the brake-on supply conduit 30. The pressurized hydraulic fluid from the brake-on supply conduit 30 enters the reset cavity $\mathbf{42}_2$ in the cartridge body 34 of the exhaust valve reset device 32. The pressurized hydraulic fluid in the reset cavity $\mathbf{42}_2$ overcomes the biasing force of the trigger return spring 56 and moves the reset trigger 50 to the extended position. In this position, as best shown in FIGS. 5A and 9A, the elongated distal end 52 of the reset trigger 50 engages the exhaust valve bridge 24. Moreover, in the extended position of the reset trigger 50 (shown in FIGS. 5A and 9A), the ball-valve member 44 is returned to a closed position and is held on the ball-check seat 45 by the biasing force of the ball-check spring 46 so as to close the communication port 48 in the cartridge body 34, and fluidly disconnects the continuous supply port 37 and the piston supply port 41 of the cartridge body 34. Now the pressurized hydraulic fluid fills the actuation piston cavity 65 and removes all of the exhaust valve train clearance by entering the check-valve cavity $\mathbf{42}_1$ through the continuous supply conduit 26 and the high-pressure conduit 28 and through the reset check valve 43 by overcoming the biasing force of the ball-check spring 46 when the hydraulic pressure in the continuous supply conduit 26 is higher than the hydraulic pressure in the actuation piston cavity 65. However, if the hydraulic pressure in the continuous supply conduit 26 is lower than the hydraulic pressure in the actuation piston cavity 65, the hydraulic fluid is checked in the high pressure hydraulic circuit and the engine brake cam profile and engine brake cycle is activated.

The engine braking operation is described hereafter.

The rocker shaft 20 that supplies the pressurized hydraulic fluid is designed with two passageways 97 and 99 to supply pressurized hydraulic fluid to the continuous supply conduit 26 and the brake-on supply conduit 30, respectively, of the engine brake rocker arm assembly 16. The brake-on supply conduit 30 is controlled by the solenoid valve 98 that supplies the pressurized hydraulic fluid to the brake-on supply conduit 30, which displaces the reset trigger 50 downwardly allowing the reset check valve 43 to seat (i.e., in the closed position) and functions as a check valve to lock the hydraulic fluid in the high-pressure conduit 28 and the actuation piston cavity 65. The hydraulic pressure within the actuation piston cavity 65 assures that all lash is removed (including the actuation piston lash) from the valve train assembly (except the predetermined valve lash δ) and the exhaust rocker roller follower 21 of the exhaust rocker arm 22 is kept in contact with the exhaust cam 2.

To start the engine brake-on mode, the solenoid valve 98 is energized to flow oil through the brake-on oil supply conduit 30 to the reset cavity $\mathbf{42}_2$ and bias the reset trigger 50 downward and provide a clearance between the ball-valve member 44 and the upset pin 58, allowing the ball-check spring 46 to bias the ball-valve member 44 against the ball-check seat 45. The pressurized engine oil is supplied to the rocker arm continuous supply port 37 through the reset check valve 43 and the high-pressure conduit 28 and into the actuation piston cavity 65, removing all valve train lash between the single-valve actuation pin 76 and the actuation piston 62, and the cam follower 21 and the lobe of the exhaust cam 2.

With all valve train lash eliminated (except the predetermined valve lash δ) and the hydraulic fluid locked in the actuation piston cavity 65, the roller follower 21 proceeds from the lower base circle 5 on the exhaust cam 2 to the engine brake lift profile 7 to open only the exhaust valve $\mathbf{3}_1$ through the single-valve actuation pin 76 just prior to a Top Dead Center (TDC) of the compression stroke to evacuate the highly compressed air in the cylinder resulting from the compression stroke. When the engine brake lift profile 7 acts on the driven end 22*b* of the exhaust rocker arm 22 and pivotally rotates the exhaust rocker arm 22, a distal end of the actuation piston 62 presses on the single-valve actuation pin 76, in turn pressing on an exhaust valve stem of the first exhaust valve $\mathbf{3}_1$ only. When the actuation piston 62 presses the single-valve actuation pin 76 towards the first exhaust valve $\mathbf{3}_1$ just prior to TDC of the compression stroke during the compression-release engine braking event, the fluid pressure in the actuating piston cavity 65 becomes higher than the fluid pressure in the check-valve cavity $\mathbf{42}_1$, thus forcing the ball-valve member 44 of the check valve 43 to be seated on the ball-check seat 45, and thus hydraulically locking the engine oil (hydraulic fluid) in the actuating piston cavity 65.

Figure 12:
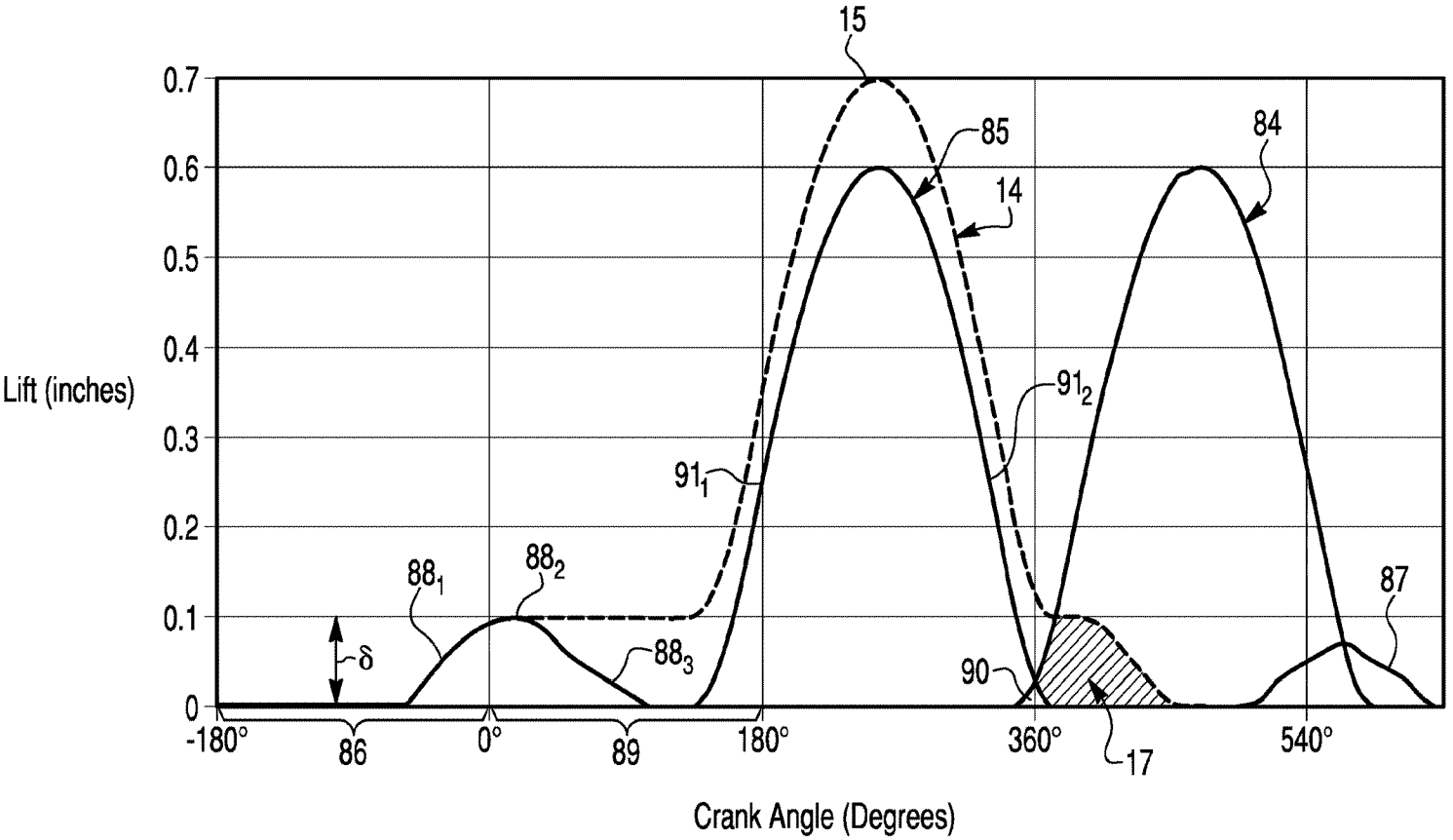
FIG. 12 is a graph illustrating inlet and exhaust valve lift vs. crank angle under a positive power operation and during an engine brake operation of the rocker arm compression-release engine brake system according to the exemplary embodiment of the present invention.

With all the valve train lash (except the predetermined valve lash δ) removed and hydraulically locked, the brake lift profile 7 of the exhaust cam member 2 opens only the first exhaust valve $\mathbf{3}_1$ just prior to TDC of the compression stroke during the compression-release engine braking event, as illustrated by a portion $\mathbf{88}_1$ of the exhaust valve lift profile 85 in FIG. 12. Due to the predetermined valve lash δ, the adjusting screw assembly 68 does not press against the exhaust valve bridge 24. Thus, the second exhaust valve $3_2$ remains closed throughout the compression-release engine braking event of the engine compression brake operation.

During the opening of the single exhaust valve $3_1$ with the single-valve actuation pin 76, the cylinder pressure is increasing and rapidly reaches peak cylinder pressure just prior to TDC compression, and then cylinder pressure drops rapidly just after TDC compression. Because of the compression release near TDC and the engine piston in the cylinder moving downwardly in the engine cylinder, the cylinder pressure is decreasing rapidly and so does the pressure in the actuation piston cavity 65, resulting in lower pressure biasing the ball-valve member 44 against the ball-check seat 45.

During the compression-release engine braking event during the power stroke of the braking mode, i.e., the compression stroke, resetting the exhaust valve $3_1$ is accomplished by the elongated distal end 52 of the reset trigger 50 coming in contact with a top surface 24*a* of the exhaust valve bridge 24, which acts as a preset stop member as the exhaust valve bridge 24 is not movable relative to the rocker shaft 20 during the compression-release braking operation due to the predetermined valve lash δ.

Upon the contact of the elongated distal end 52 of the reset trigger 50 with the exhaust valve bridge 24, as the driving end 22*a* of the exhaust rocker arm 22 rotates downwardly by the action of the brake lift profile 7 of the exhaust cam member 2, the reset trigger 50, which is biased downwardly by the fluid pressure of the brake-on supply conduit 30, is forced upward relative to the cartridge body 34 toward the reset check valve 43 (against the biasing force of the pressurized hydraulic fluid in the reset cavity $42_2$) by the exhaust valve bridge 24. As a result, the reset pressure spring 57 is compressed and the upset pin 58 contacts the ball-valve member 44 in the seated position. The reset pressure spring 57 in the compressed state creates an upward force on the ball-valve member 44 and the hydraulic pressure in the actuation piston cavity 65 biases the ball-valve member 44 into the seated position. When the biasing force of the reset pressure spring 57 exceeds the force created by the decreasing pressure in the actuation piston cavity 65, the ball-valve member 44 is forced off its seat 45, thereby unseating the ball-valve member 44 of the check valve 43 (i.e., moving the ball-valve member 44 to the open position) against the biasing force of the ball-check spring 46 by the upset pin 58.

In other words, reset occurs when the reset trigger 50 is forced upwardly by rotation of the exhaust rocker arm 22 causing the reset pressure spring 57 to be compressed and apply a high force to the ball-valve member 44 of the check valve 43 that is initially not capable of moving the ball off its seat 45 until cylinder pressure and pressure in the actuation piston cavity 65 is reduced to the point that the reset pressure spring 57 will force the ball-valve member 44 off its seat 45. This occurs toward the end of the expansion stroke 89 when cylinder pressure is low.

Opening of the check valve 43 results in releasing a portion of the hydraulic fluid from the actuation piston cavity 65, i.e., allowing the pressurized hydraulic fluid in the actuation piston cavity 65 to return to the continuous supply conduit 26 in the exhaust rocker arm 22. This causes the actuation piston 62 and the single-valve actuation pin 76 to move upwardly, thus permitting the single exhaust valve $3_1$ to reset and return the first exhaust valve $3_1$ back to its valve seat.

During engine brake operation of an engine without the exhaust valve reset device 32, with all valve train lash removed (except the predetermined valve lash δ), a normal exhaust valve lift profile 14 will be increased in a lift 15 and duration, as shown in FIG. 12. The increased exhaust valve lift 15 requires increased piston/valve clearance to eliminate possible exhaust valve and engine piston contact at TDC exhaust/intake without the valve reset device. With the valve lash δ removed, the exhaust valve increased lift 15 will extend the intake and exhaust valve overlap 17 at TDC, as shown in FIG. 12. The extended valve overlap 17 allows flow of the high pressure exhaust gas in the exhaust manifold back into the engine cylinder and then into the air intake manifold. This can result in inlet noise, damage to inlet air components and reduced engine braking retarding power. For the reasons above, an exhaust valve reset device is desirable on an engine brake rocker arm lost motion system. Portion 87 of the exhaust valve lift profile 14 illustrates an optimal pre-charging event caused by the action of the pre-charge lift profile 8 of the exhaust cam member 2 (shown in FIG. 12). A normal intake valve lift profile 84 is also shown in FIG. 12.

During engine brake operation of the engine with the exhaust valve reset device 32 (shown at 88 in FIG. 12), the reset trigger 50 is positioned to start releasing hydraulic oil located in the actuating piston cavity 65 back into the high-pressure conduit 28 and the rocker shaft accumulator 77 at approximately 50% of the compression-release engine braking event (shown at $88_2$ in FIG. 12). As a result, the first exhaust valve $3_1$ is closed, thus resetting the first exhaust valve $3_1$ back to the closed position, illustrated by a portion $88_3$ of an exhaust valve braking lift profile 88 in FIG. 12. This will resume a normal positive power exhaust valve lift profile (85 in FIG. 12) eliminating the extended exhaust valve lift and extended overlap at TDC, as illustrated at 90 in FIG. 12. Now both the exhaust valves $3_1$ and $3_2$ will be opened by the exhaust cam profile 6 and by the rocker arm adjusting screw assembly 68 contacting the exhaust bridge 24.

As illustrated in FIG. 12, the exhaust/intake valve overlap 90 at TDC during the operation of the compression-release engine brake system 12 with the exhaust valve reset device 32 is substantially smaller than the intake and exhaust valve overlap 17 during the operation of the compression-release engine brake system without the exhaust valve reset device 32 according to exemplary embodiments of the present invention. In other words, because the pressurized hydraulic fluid is released from the actuating piston cavity 65, the exhaust valves $3_1$ and $3_2$ will resume the normal positive power exhaust valve lift profile 85, eliminating the extended exhaust valve lift (15 in FIG. 12) and the extended overlap (17 in FIG. 12). Therefore, resetting the exhaust valves $3_1$ and $3_2$ back to the closed positions (i.e., releasing the pressurized hydraulic fluid from the actuating piston cavity 65 during the compression-release engine braking event) eliminates extended intake/exhaust valve overlap that results in reduced exhaust manifold back pressure and reduced engine brake retarding power.

Make-up hydraulic fluid to refurbish the reset hydraulic fluid is supplied from the rocker shaft accumulator 77 that, according to the exemplary embodiment of the present invention, is located in the rocker arm shaft 20. Alternatively, the rocker shaft accumulator 77 can be located in the rocker arm shaft support. This accumulated hydraulic fluid is stored in the rocker shaft accumulator 77 in close proximity and at a higher pressure to assist in completely filling the actuating piston cavity 65 and the high-pressure conduit 28 for the next pre-charge lift profile 8 or the engine brake exhaust lift profile 7. The pre-charge lift profile 8 of the exhaust cam lobe 2 opens the first exhaust valve $3_1$ near the end of the intake stroke. This adds a high pressure air charge and additional boost from the exhaust manifold to the cylinder at the start of the exhaust stroke to enable more work to be done on the air during the compression stroke and potentially on the exhaust stroke and, depending on high exhaust manifold backpressure, may produce a reduced engine brake exhaust sound level.

Therefore, the lost motion rocker arm compression-release engine brake system according to the first exemplary embodiment of the present invention opens only one of two exhaust valves during the engine compression release event and resets the one exhaust valve prior to the normal exhaust stroke valve motion. In the first exemplary embodiment of the present invention, the engine compression release single exhaust valve lift opening is approximately 0.100 inches and the lift starts just prior to TDC compression stroke.

Contemporary diesel engines are usually equipped with an exhaust valve bridge and two exhaust valves. A reset device according to the exemplary embodiments of the present invention is desirable to close the single braking exhaust valve prior to the opening of both exhaust valves during the normal exhaust stroke, so that the exhaust valve bridge is not in an unbalanced condition. An unbalanced condition is where the single-valve actuation pin has not returned the single braking exhaust valve to the seated position resulting in an unbalanced force on the bridge during normal exhaust valve opening.

The reset device 32, according to the first exemplary embodiment of the present invention, is located further away from the center of rotation of the exhaust rocker arm 22 (or the rocker arm shaft 20) than the center of the exhaust valve bridge 24 and the adjusting screw assembly 68 to provide the maximum trigger motion to allow the reset trigger 50 to move upwardly in the cartridge body 34, removing lash between the ball-valve member 44 and the upset pin 58, and to provide compression of the reset pressure spring 57. Compression release cylinder pressure results in biasing the reset check valve 43 closed by the high hydraulic circuit pressure. During the beginning of the expansion stroke, the cylinder pressure decreases rapidly to a value that the reset pressure spring 57 that is being compressed can lift the ball-valve member 44 off the seat 45 thereof.

At the time when the ball-valve member 44 is forced off its seat 45, the hydraulic fluid in the actuation piston cavity 65 will be released, thereby resetting the single engine brake exhaust valve $3_1$. The resetting function occurs prior to the normal exhaust stroke, resulting in both exhaust valves $3_1$ and $3_2$ being seated and the exhaust valve bridge 24 can now be opened by the exhaust rocker arm 22 with the exhaust bridge 24 in a balanced condition.

Present lost motion rocker brakes are commercially available without resetting and are accomplished by incorporating increased strength bridge guide pins to solve the unbalanced bridge loading problem. The prior art approach is more costly and provides less retarding performance because of the extended intake/exhaust valve overlap condition. Extended intake/exhaust valve overlap results in the loss of exhaust manifold air mass and pressure back into the cylinder and inlet manifold. The loss of exhaust manifold pressure decreases engine brake retarding performance.

The single valve rocker arm lost motion compression-release engine brake system with reset, according to exemplary embodiments of the present invention, reduces cost of a conventional engine brake system or even a dedicated cam brake. The rocker arm compression-release engine brake system of exemplary embodiments the present invention provides better performance than an exhaust cam driven brake or even an injector driven one. The performance of the single valve rocker arm compression-release engine brake system of exemplary embodiments of the present invention compared to a dedicated cam engine brake in most circumstances will be close. Compared to other engine brake configurations, the single valve rocker arm lost motion compression-release engine brake system with reset of exemplary embodiments of the invention is better in weight, cost of development, requirements to make fundamental changes to existing engines, engine height and manufacturing cost per engine.

FIGS. 13-15B illustrate a second exemplary embodiment of a valve train assembly of internal combustion engine, generally depicted by the reference character 110. Components, which are unchanged from the first exemplary embodiment of the present invention, are labeled with the same reference characters. Components, which function in the same way as in the first exemplary embodiment of the present invention depicted in FIGS. 1-12 are designated by the same reference numerals to some of which 100 has been added, sometimes without being described in detail since similarities between the corresponding parts in the two embodiments will be readily perceived by the reader.

The valve train assembly 110 includes a rocker arm compression-release engine brake system 112 according to the second exemplary embodiment of the present invention, provided for an internal combustion (IC) engine. Preferably, the IC engine is a four-stroke diesel engine.

Figure 13:
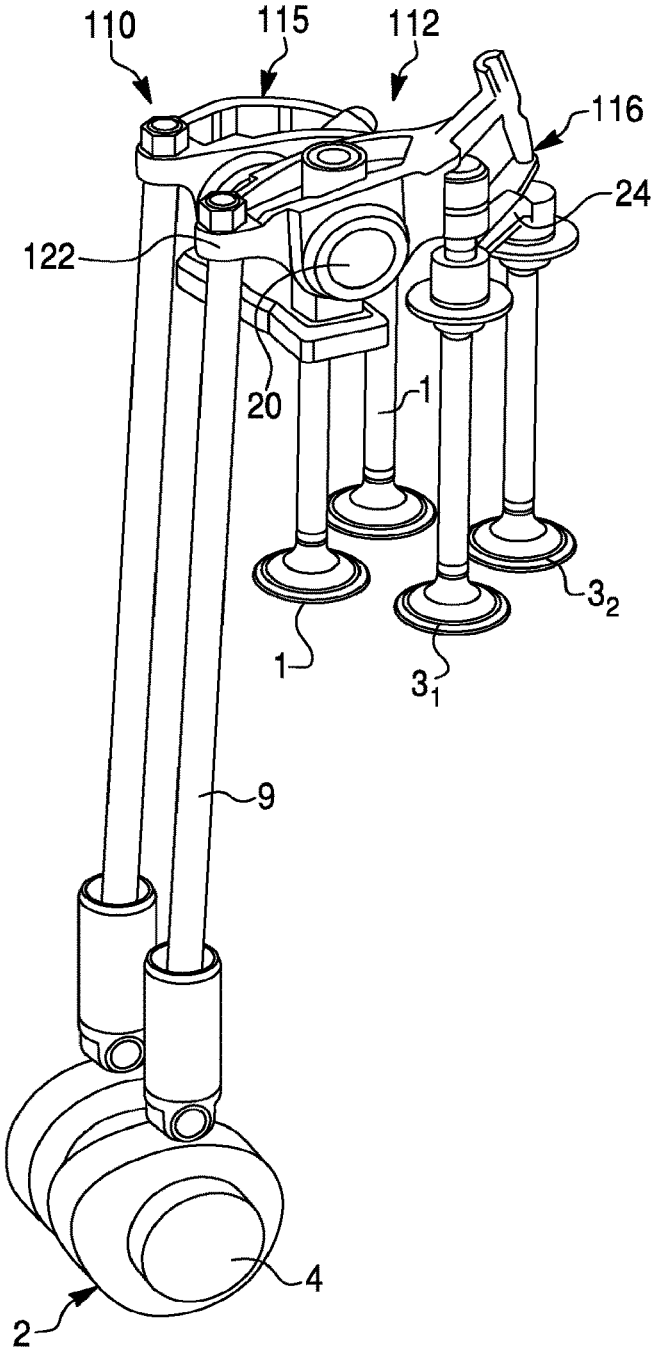
FIG. 13 is a perspective view of a valve train assembly including a rocker arm compression-release engine brake system according to a second exemplary embodiment of the present invention.

As illustrated in FIG. 13, the rocker arm compression-release engine brake system 112 according to the second exemplary embodiment of the present invention includes a conventional intake rocker assembly 115 for operating two intake valves 1, and a lost motion exhaust rocker assembly 116 for operating the exhaust valve(s). The compression-release brake system 112 in accordance with the second exemplary embodiment of the present invention includes a pushrod 9 actuating the exhaust rocker assembly 116 and driven by the exhaust cam 2, as shown in FIG. 13.

The exhaust rocker assembly 116 according to the second exemplary embodiment of the present invention is a lost motion type provided with automatic hydraulic adjusting and resetting functions as disclosed herein. The exhaust rocker assembly 116 includes an exhaust rocker arm 122 pivotally mounted about a rocker shaft 20 and provided to open first and second exhaust valves $3_1$ and $3_2$, respectively, through an exhaust valve bridge 24. The rocker shaft 20 is supported by rocker arm supports (or rocker arm pedestals) 25 and extends through a rocker arm bore 133 formed in the exhaust rocker arm 122 (shown in FIGS. 13-15B).

Figure 14:
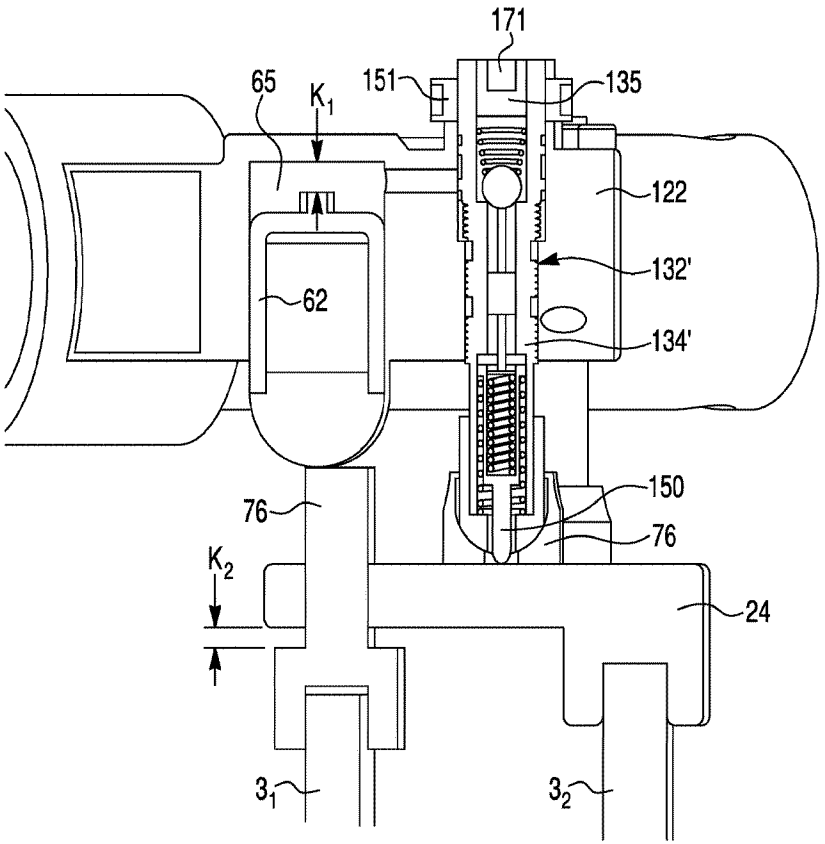
FIG. 14 is a sectional view of the rocker arm compression-release engine brake system according to the second exemplary embodiment of the present invention in a brake-on mode.

The rocker arm compression-release brake system 112 further comprises an exhaust valve reset device 132 disposed in the exhaust rocker arm 122. The exhaust valve reset device 132 according to the second exemplary embodiment of the present invention is substantially structurally and functionally identical to the exhaust valve reset device 32 of the first exemplary embodiment of the present invention (shown in detail FIGS. 8-9B) and is in the form of a substantially cylindrical cartridge and comprises a substantially cylindrical cartridge body 134 provided with an annular supply groove 136 fluidly connected with the continuous supply conduit 26, an annular brake-on groove 38 fluidly connected with the brake-on supply conduit 30, and an annular piston groove 140 fluidly connected with the high-pressure conduit 28. The cylindrical cartridge body 134 is threadedly and adjustably disposed within a substantially cylindrical reset bore in the exhaust rocker arm 122. Moreover, the cartridge body 134 is provided with a contacting foot 72 swivelably mounted to a distal end of the cartridge body 134 adjacent to the exhaust valve bridge 24. As shown in FIGS. 14 and 15B, the reset trigger 150 extends from the cartridge body 134 and the contacting foot 72 through an opening in the contacting foot 72.

As best illustrated in FIG. 14, each of the supply groove 136, the brake-on groove 138 and the piston groove 140 are formed on an outer peripheral cylindrical surface of the cartridge body 134 and axially spaced from each other. The cylindrical cartridge body 134 is disposed within a substantially cylindrical reset bore in the exhaust rocker arm 122 so as to set a predetermined valve lash (or clearance) 6 between the contacting foot 72 and the exhaust valve bridge 24 when the exhaust rocker roller follower is in contact with a lower base circle 5 on the exhaust cam 2, i.e., when the exhaust cam 2 is not acting (pressing) on the exhaust rocker arm 122. The predetermined valve lash δ (such as 0.05") is set to provide normal exhaust valve motion during positive power operation with clearance for valve train components growth at engine operating temperatures. During engine brake operation all lash (except the predetermined valve lash δ) is removed from the valve train and the brake cam profile determines the opening timing, profile and lift of the exhaust valve.

Figure 15A:
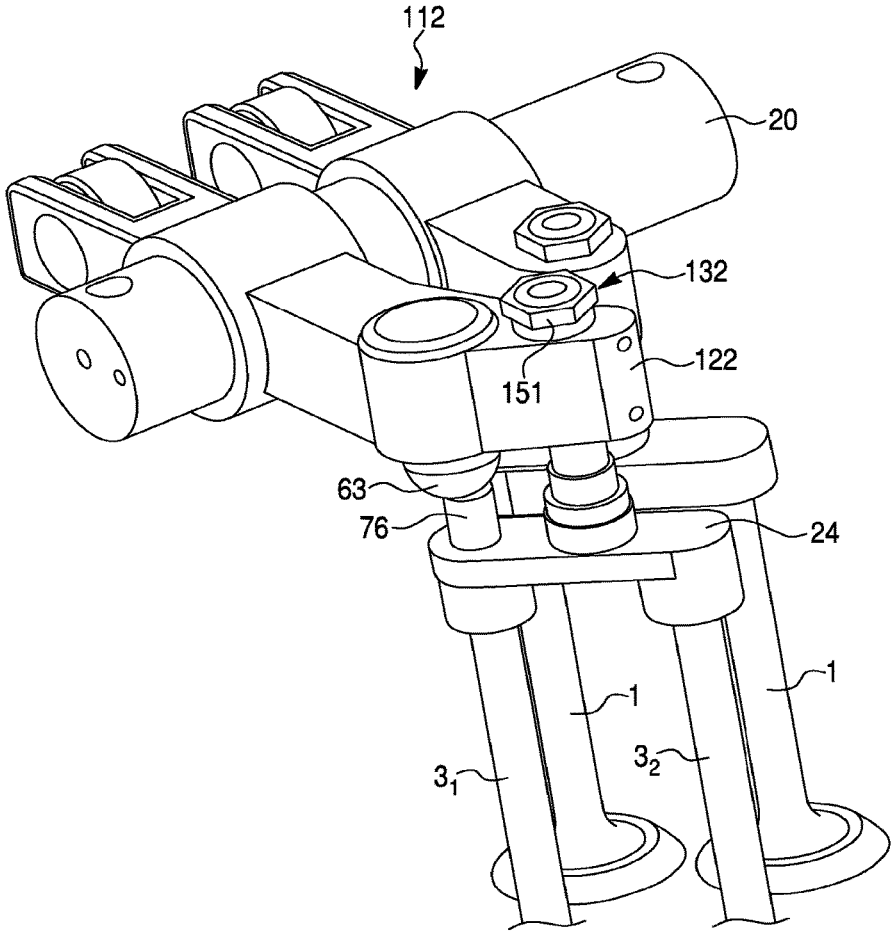
FIG. 15A is an alternative perspective view of the valve train assembly including the rocker arm compression-release engine brake system according to the second exemplary embodiment of the present invention.
Figure 15B:
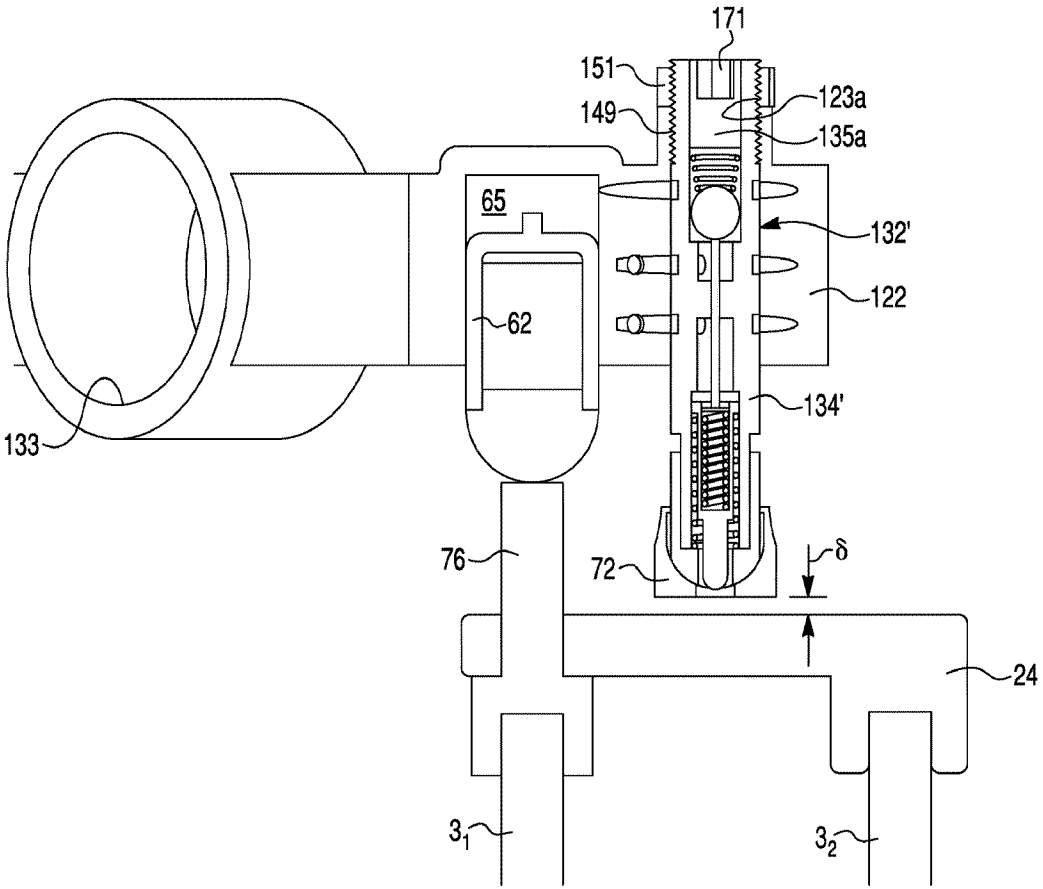
FIG. 15B is a sectional view of the rocker arm compression-release engine brake system of FIG. 15A in a brake-off mode.

Alternatively, an outer peripheral cylindrical surface 149 of cartridge body 134' of an alternative embodiment of an exhaust valve reset device, generally depicted with the reference numeral 132', is wholly or at least partially threaded as best illustrated in FIGS. 15A and 15B. Each of the supply groove 136, the brake-on groove 138 and the piston groove 140 are formed on the threaded outer peripheral cylindrical surface 149 of the cartridge body 134' and axially spaced from each other. The threaded cylindrical cartridge body 134' is adjustably disposed within a substantially cylindrical, threaded reset bore 123*a* in the exhaust rocker arm 122 for setting a predetermined valve lash (or clearance) δ between the contacting foot 72 and the exhaust valve bridge 24 when the exhaust rocker roller follower is in contact with a lower base circle 5 on the exhaust cam 2, i.e., when the exhaust cam 2 is not acting (pressing) on the exhaust rocker arm 122.

An upper cartridge plug 135*a* is non-movably secured (i.e., fixed) to the cartridge body 134' and is provided with a hexagonal socket 171 accessible from above the exhaust rocker arm 122 for setting the predetermined valve lash δ. A lock nut 151 is provided on the adjusting threaded cylindrical cartridge body 134'. The predetermined valve lash δ is set to provide normal exhaust valve motion during positive power operation with clearance for valve train component growth at engine operating temperatures. During engine brake operation all lash (except the predetermined valve lash δ) is removed from the valve train and the brake cam profile determines the opening timing, profile and lift of the exhaust valve. In other words, the reset device 132 combines the functions of a rocker arm adjusting screw assembly and a check valve and reset device. Such an arrangement of the exhaust valve reset device is especially beneficial for an IC engine with an overhead camshaft.

FIGS. 16-18B illustrate a third exemplary embodiment of a valve train assembly of an IC engine, generally depicted by the reference character 310. Components, which are unchanged from the first exemplary embodiment of the present invention, are labeled with the same reference characters. Components, which function in the same way as in the first exemplary embodiment of the present invention depicted in FIGS. 1-12 are designated by the same reference numerals to some of which 300 has been added, sometimes without being described in detail because similarities between the corresponding parts in the two embodiments will be readily perceived by the reader.

The valve train assembly 310 includes a rocker arm compression-release engine brake system 312. Preferably, the IC engine is a four-stroke diesel engine, comprising a cylinder block including a plurality of cylinders. The rocker arm compression-release engine brake system 312 includes a conventional intake rocker assembly (not shown) for operating two intake valves 1, and a lost motion exhaust rocker assembly 316 for operating first and second exhaust valves $\mathbf{3}_1$ and $\mathbf{3}_2$. The exhaust rocker assembly 316 according to the third exemplary embodiment of the present invention is of lost motion type provided with automatic hydraulic adjusting and resetting functions. The exhaust rocker assembly 316 includes an exhaust rocker arm 322 pivotally mounted about a rocker shaft 20 and provided to open the first and second exhaust valves $\mathbf{3}_1$ and $\mathbf{3}_2$, respectively, through exhaust valve bridge 24. The rocker shaft 20 is supported by rocker arm supports (or rocker arm pedestals) and extends through a rocker arm bore 333 formed in the exhaust rocker arm 322 (shown in FIG. 16).

Figure 18A:
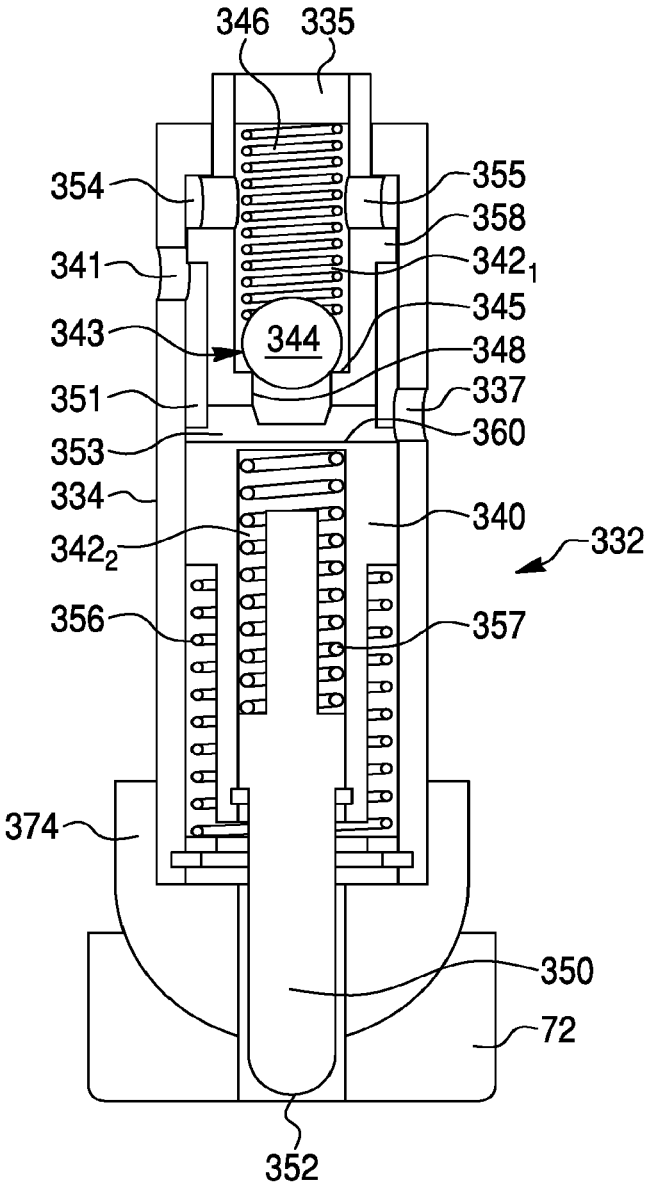
FIG. 18A is a sectional view of an exhaust valve reset device according to the third exemplary embodiment of the present invention in the brake-off mode.
Figure 18B:
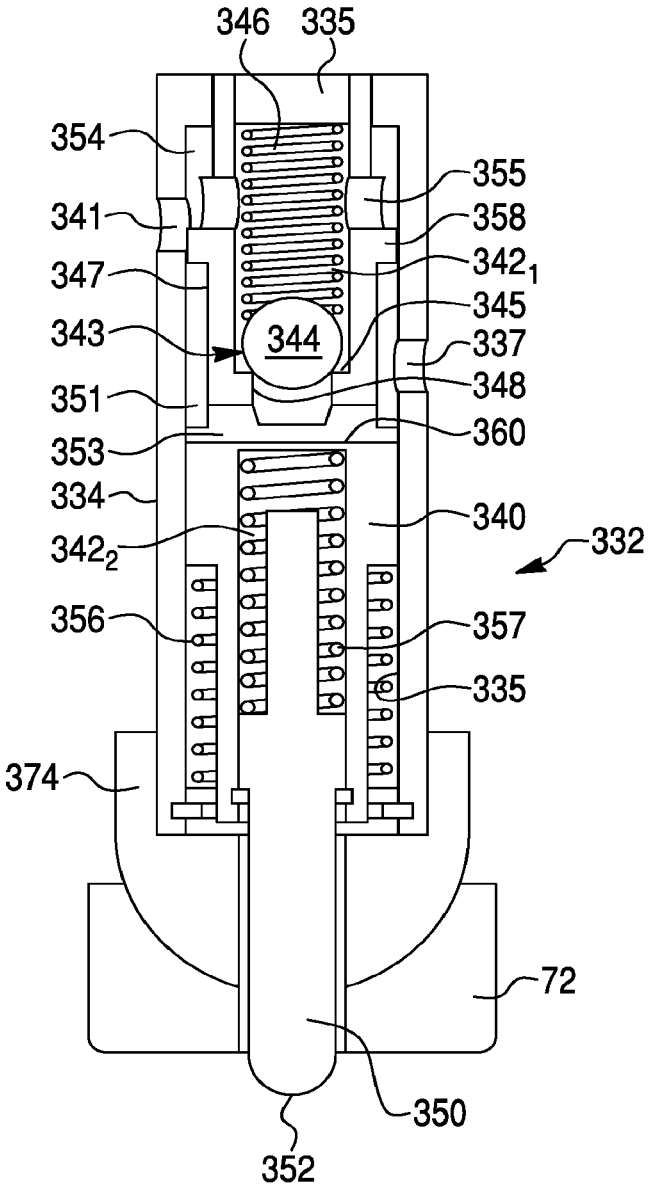
FIG. 18B is a sectional view of the exhaust valve reset device according to the third exemplary embodiment of the present invention in the brake-on mode.

The rocker arm compression-release brake system 312 further comprises an exhaust valve reset device 332 disposed in the exhaust rocker arm 322 in a direction substantially parallel to the exhaust valves $\mathbf{3}_1$ and $\mathbf{3}_2$. The exhaust valve reset device (or spool cartridge) 332 according to the third exemplary embodiment of the present invention, as best illustrated in FIGS. 18A and 18B, is in the form of a compression release spool cartridge assembly and comprises a substantially cylindrical cartridge body 334 provided with a continuous hydraulic fluid pressure supply port 337 fluidly connected with the continuous hydraulic fluid pressure supply conduit 26 and a piston supply port 341 fluidly connected with an actuation piston cavity 65 through the high-pressure conduit 28. The continuous pressure supply port 337 and the piston supply port 341 are axially spaced from each other. The cylindrical cartridge body 334 is non-movably disposed within a substantially cylindrical reset bore in the exhaust rocker arm 322. In the third exemplary embodiment of the present invention, the cylindrical cartridge body 334 is threadedly and adjustably disposed within the substantially cylindrical reset bore in the exhaust rocker arm 322, i.e., the reset device 332 is adjustable for the predetermined exhaust valve lash δ. Moreover, the cartridge body 334 is provided with a contacting (or elephant) foot 372 swivelably mounted to a sliding ball foot 374, in turn mounted to a distal end of the cartridge body 334 adjacent to the exhaust valve bridge 24. In other words, the reset device 332 according to the third exemplary embodiment of the present invention combines functions of a rocker arm adjusting screw assembly and an exhaust valve reset device.

The reset device 332 further comprises a substantially cylindrical reset spool 340 axially slidingly disposed within the cylindrical cartridge body 334. The reset spool 340 is movable within and relative to the cartridge body 334 between a retracted position shown in FIGS. 17A and 18A, and an extended position shown in FIGS. 17B and 18B.

As further illustrated in FIGS. 18A and 18B, the reset spool 340 has an inner cavity therewithin, which is divided by a separating wall 360 into a check-valve cavity $\mathbf{342}_1$ and a reset cavity $\mathbf{342}_2$. The check-valve cavity $\mathbf{342}_1$ within the reset spool 340 is enclosed between an upper cartridge plug 335 and the separating wall 360. The reset spool 340 is further formed with a first annular spool recess 350 between an inner peripheral surface 335 of the cartridge body 334 and an outer peripheral surface 347 of the reset spool 340. The first annular recess 351 defines a lower spool cavity and is in a constant direct fluid communication with the continuous pressure supply port 337 in the cartridge body 334. In turn, the lower spool cavity 351 is in fluid communication with the check-valve cavity 342, through at least one first communication port 353 in the reset spool 340. The lower spool cavity 351 is selectively fluidly connected to the piston supply port 341 depending on an axial position of the reset spool 340. For, example, in the retracted position of the reset spool 340, shown in FIG. 18A, the lower spool cavity 351 is fluidly connected to the piston supply port 341, while in the extended position of the reset spool 340, shown in FIG. 18B, the lower spool cavity 351 is fluidly disconnected from the piston supply port 341.

The reset spool 340 is further formed with a second annular spool recess 354 between the inner peripheral surface 335 of the cartridge body 334 and the outer peripheral surface 347 of the reset spool 340. The second annular recess 354 defines an upper spool cavity and is in fluid communication with the check-valve cavity $342_1$ through at least one second communication port 355 in the reset spool 340. As best illustrated in FIGS. 18A and 18B, the lower spool cavity 351 is fluidly separated from the upper spool cavity 354 by annular flange 358, which is in sliding contact with the inner peripheral surface 335 of the cartridge body 334. In other words, the at least one second communication port 355 is axially spaced from the at least one first communication port 353. The second communication port 355 is provided to selectively fluidly connect the check-valve cavity 342, with the piston supply port 341 depending on the axial position of the reset spool 340.

The reset device 332 further comprises a ball-valve member 344, and a ball-check spring 346 disposed between the ball-valve member 344 and the upper cartridge plug 335. The ball-valve member 344 is held on a ball-check seat 345 by a biasing spring force of the ball-check spring 346 so as to close a communication port 348 in the reset spool 340, which fluidly connects the continuous pressure supply port 337 of the cartridge body 334 and the check-valve cavity $342_1$ of the reset spool 340. The ball-valve member 344, the ball-check seat 345 and the ball-check spring 346 define a reset check valve 343. The check valve 343 provides selective fluid communication between the continuous supply conduit 26 and the high-pressure conduit 28 (i.e., between the continuous supply conduit 26 and the actuation piston cavity 65) through the second communication ports 355. It will be appreciated that any appropriate type of the check valve is within the scope of the present invention.

The continuous pressure supply port 337 and the piston supply port 341 are formed on an outer peripheral cylindrical surface of the cartridge body 334 and axially spaced from each other. The threaded cylindrical cartridge body 334 is adjustably disposed within the substantially cylindrical reset bore in the exhaust rocker arm 322.

The exhaust valve reset device 332 further comprises a reset trigger 350 axially slidable within the reset cavity $342_2$ of the reset spool 340. The reset trigger 350 has a hemispherical distal end 352 at least partially extending from the cartridge body 334. The reset trigger 350 is movable relative to the cartridge body 334 between a retracted position shown in FIGS. 17A and 18A, and an extended position shown in FIGS. 17B and 18B. The reset spool 340 is normally biased into the retracted position by trigger return spring 356 disposed within the cartridge body 334 and outside the reset spool 340. The reset trigger 350 is also normally biased into an extended position within the reset spool 340 by reset pressure spring 357 disposed within the cartridge body 334 and inside the reset cavity $342_2$ of the reset spool 340. The reset trigger 350 is provided to lift the reset spool 340 through the resilient biasing action of the reset pressure spring 357 to reset brake operation.

Figure 17A:
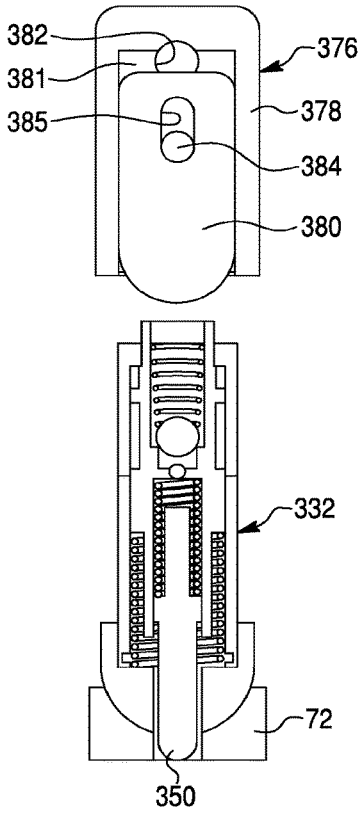
FIG. 17A is a sectional view of the rocker arm compression-release engine brake system according to the third exemplary embodiment of the present invention in the brake-off mode.
Figure 17B:
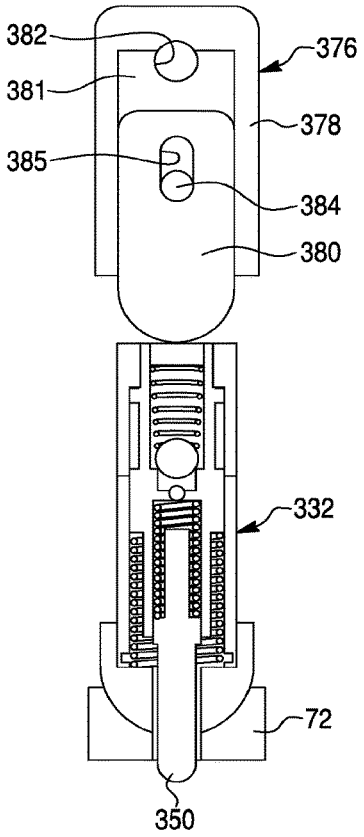
FIG. 17B is a sectional view of the rocker arm compression-release engine brake system according to the third exemplary embodiment of the present invention in the brake-on mode.

The valve train assembly 310 according to the third exemplary embodiment of the present invention further comprises a compression release actuator 376 provided to selectively move the reset spool 340 between the retracted position shown in FIGS. 17A and 18A, and the extended position shown in FIGS. 17B and 18B. The compression release actuator 376, shown in FIGS. 17A and 17B, is in the form of a fluid (such as pneumatic or hydraulic) actuator. Alternatively, the compression release actuator 376 may be in the form of a solenoid actuator. The fluid compression release actuator 376 comprises a casing 378 non-movable relative to the rocker shaft 20, and a brake-on piston 380 reciprocating within the casing 378. The brake-on piston 380 defines an actuation (or brake-on) piston cavity 381 within the casing 378 (best shown in FIGS. 17A and 17B). The casing 378 includes a fluid port 382 open to the actuation piston cavity 381 and connected with a source of pressurized fluid (air or liquid), such as a brake-on supply conduit. The casing 378 is provided with a piston stroke limiting pin 384 that limits upward and downward linear movement of the brake-on piston 380. Specifically, the brake-on piston 380 is provided with an axially extending groove 385 receiving the piston stroke limiting pin 384 therein.

The compression-release brake system 312 operates in a compression brake mode, or brake-on mode (during the engine compression brake operation) and a compression brake deactivation mode, or brake-off mode (during the positive power operation).

Figure 16:
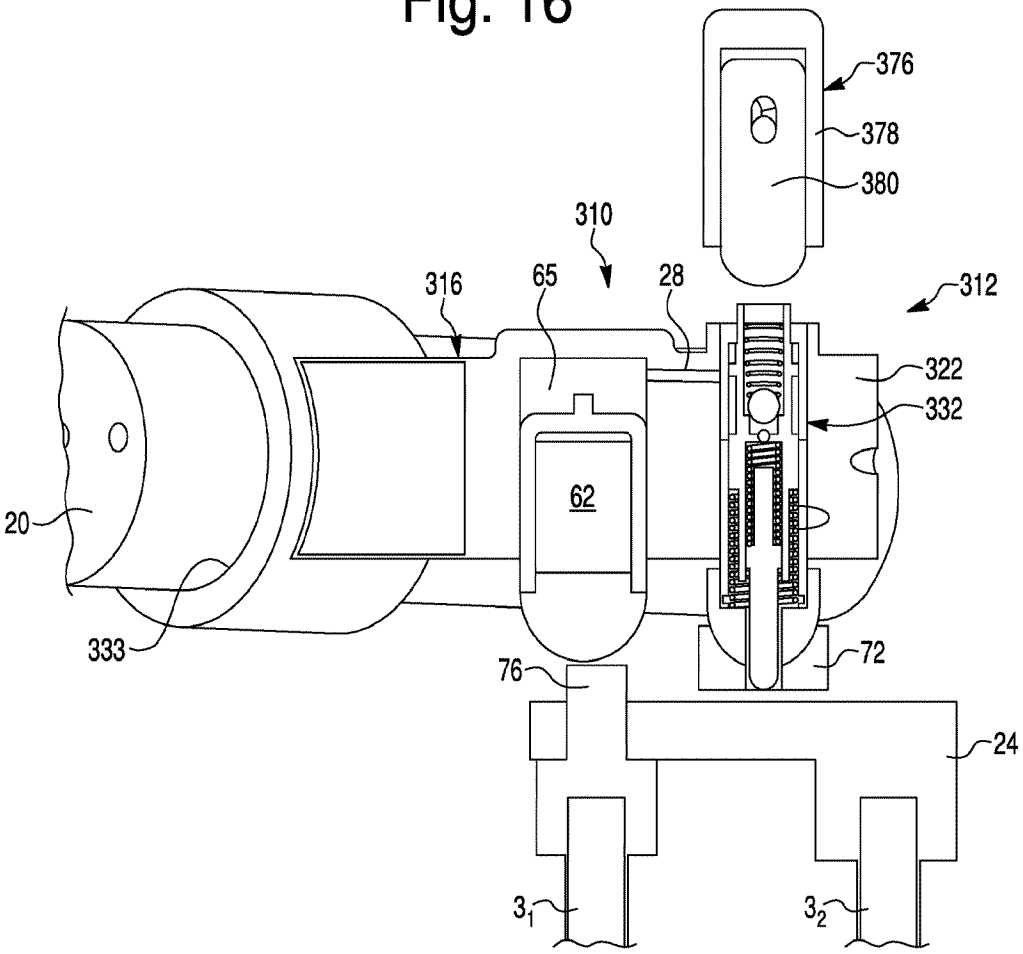
FIG. 16 is a sectional view of a valve train assembly including a rocker arm compression-release engine brake system according to a third exemplary embodiment of the present invention in the brake-off mode.

In operation of the IC engine with the rocker arm compression-release engine brake system 312 with the reset device 332 according to the third exemplary embodiment of the present invention, during the brake-off mode the compression release actuator 376 is deactivated and the brake-on piston 380 is in the retracted position so that the brake-on piston 380 is axially spaced from the reset spool 340 of the reset device 332, as illustrated in FIGS. 16 and 17A. Consequently, the reset spool 340 is biased into the retracted position by the trigger return spring 356, as best shown in FIG. 18A. In this position, the reset trigger 350 does not extend from the elephant foot 372. In the brake-off mode, the pressurized hydraulic fluid, such as engine oil, is continuously supplied to the continuous pressure supply port 337 and provides engine oil to flow back and forth through the lower spool cavity 351 to the piston supply port 341. This continuing oil flow removes the mechanical clearance in the valve train (except the predetermined valve lash δ) during positive power engine operation to eliminate valve train clatter and to maintain continuous contact between the exhaust cam profile and roller follower.

Accordingly, during brake-off mode, the pressurized fluid is continuously supplied from the continuous supply conduit 26 to the actuation piston cavity 65 through the lower spool cavity 351 and the piston supply port 341 of the reset device 332, and the high-pressure passageway 28, as shown in FIGS. 16, 17A and 18A.

The engine braking operation during the brake-on mode is as follows.

To activate the engine brake, the compression release actuator 376 is activated and the brake-on piston 380 moves into the extended position, as best shown in FIG. 17B. Subsequently, the brake-on piston 380 forces the reset spool 340 down, sealing off the piston supply port 341 from the lower spool cavity 351. The actuation piston cavity 65 continues to be filled with the pressurized hydraulic fluid from the continuous pressure supply port 337 through the check valve 343, the check-valve cavity $\mathbf{342}_1$, the at least one second communication port 355 in the reset spool 340, the upper spool cavity 354, and the piston supply port 341. At the same time, the check valve 343 hydraulically locks the actuation piston cavity 65 when the brake-on actuation piston 62 is fully extended downward. The exhaust rocker arm 322, when positioned on lower base circle 5 of the exhaust cam 2, starts to open the single exhaust valve $\mathbf{3}_1$, releasing compressed air from the associated engine cylinder. At approximately 0.050 inch exhaust valve lift, the hemispherical distal end 352 of the reset trigger 350 contacts the exhaust bridge 24, resulting in the reset pressure spring 357 producing an increasing biasing force on the reset spool 340 to move upwardly.

During the engine compression stroke the biasing forces of the brake-on piston 380 of the compression release actuator 376 and hydraulic pressure in the upper spool cavity 354 bias the reset spool 340 into the extended position. On the other hand, the reset pressure spring 357 and the trigger return spring 356 bias the reset spool 340 into the retracted position. As the cylinder pressure continues to increase, the hydraulic pressure in the upper spool cavity 354 also increases, creating a larger biasing force to maintain the reset spool 340 in the downward, extended position and continuing to lock the hydraulic fluid in the actuation piston cavity 65 above the single valve actuation piston 62.

When the engine stroke changes from the compression stroke to the expansion stroke, the cylinder pressure decreases rapidly to approximately atmospheric pressure. When the pressure in the piston supply port 341 and the upper spool cavity 354 decrease to approximately 250 psi pressure, any significant hydraulic biasing force on the reset spool 340 is eliminated, resulting in the upward biasing force of the reset pressure spring 357 exceeding the downward biasing force of the compression release actuator 376. As a result, the reset spool 340 transitions upwardly to open the piston supply port 341 to the lower spool cavity 351, thus unlocking the actuation piston 62, i.e., allowing the hydraulic fluid from the actuation piston cavity 65 to flow back into the continuous oil supply conduit 126 through the continuous pressure supply port 337. This oil flow through the continuous pressure supply port 337 allows the single exhaust valve $\mathbf{3}_1$ to be reseated and completes a single valve reset function. The reset pressure spring 357 has a spring rate sufficient to generate an adequate force to overcome the force of approximately 100 pounds from the valve spring $\mathbf{9}_1$ of the braking exhaust valve $\mathbf{3}_1$ that creates the pressure differential across the reset ball-valve member 444 of the reset check valve 443 at the end of the expansion stroke to reset the single exhaust valve $\mathbf{3}_1$.

Figure 19:
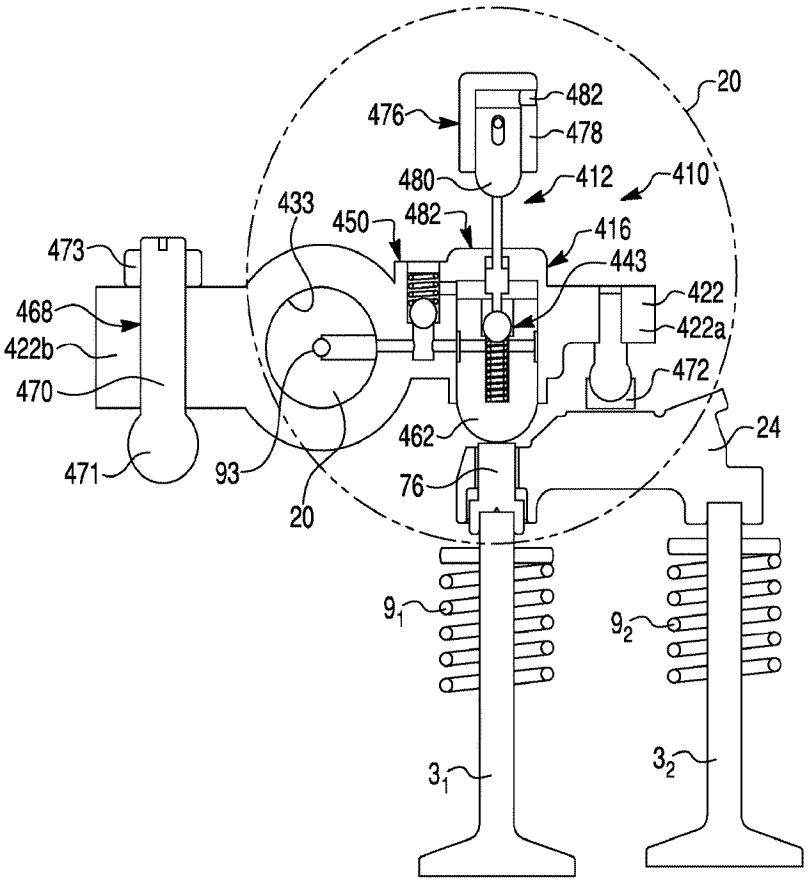
FIG. 19 is a sectional view of a valve train assembly including a rocker arm compression-release engine brake system according to a fourth exemplary embodiment of the present invention in the brake-on mode.
Figure 20:
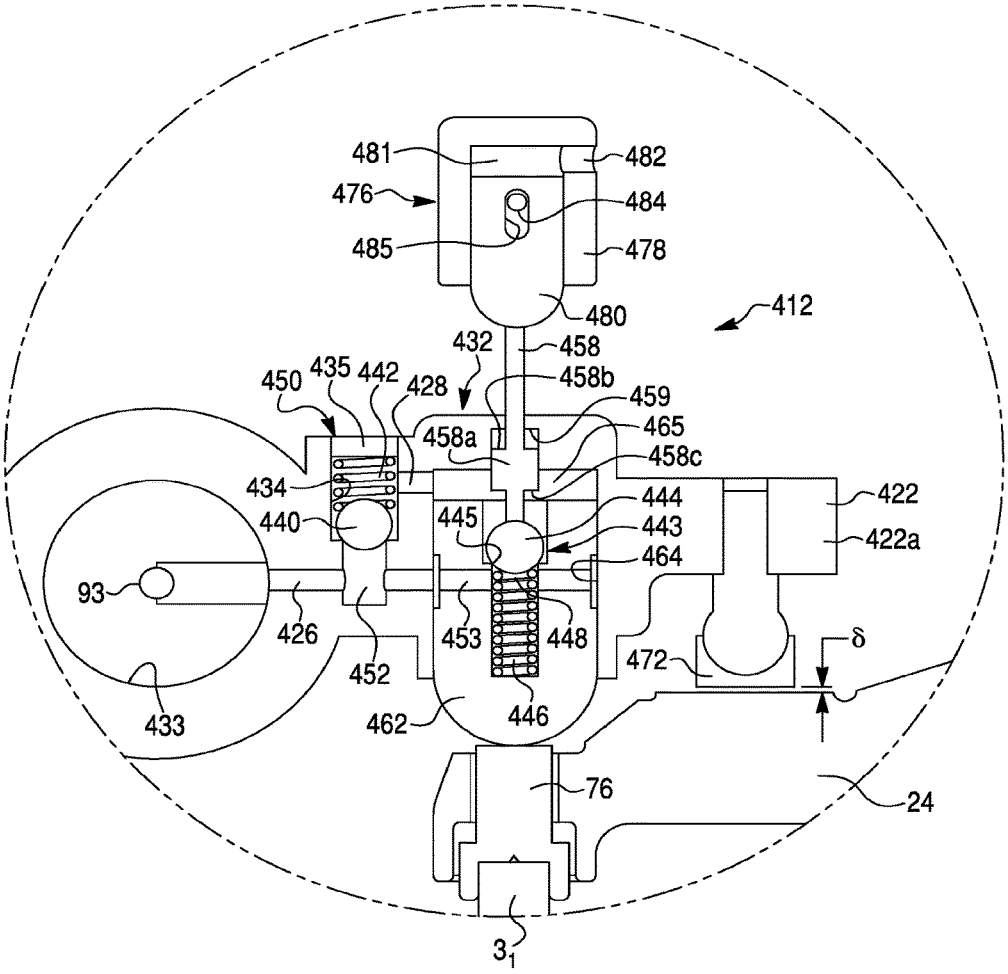
FIG. 20 is an enlarged front view of a fragment of the compression-release engine brake system shown in the circle 20 of FIG. 19.

FIGS. 19 and 20 illustrate a fourth exemplary embodiment of a valve train assembly of an IC engine, generally depicted by the reference character 410. Components, which are unchanged from the first exemplary embodiment of the present invention, are labeled with the same reference characters. Components, which function in the same way as in the first exemplary embodiment of the present invention depicted in FIGS. 16-18B are designated by the same reference numerals to some of which 100 has been added, sometimes without being described in detail since similarities between the corresponding parts in the two embodiments will be readily perceived by the reader.

The valve train assembly 410 includes a rocker arm compression-release engine brake system 412. Preferably, the IC engine is a four-stroke diesel engine, comprising a cylinder block including a plurality of cylinders. The rocker arm compression-release engine brake system 412 comprises a conventional intake rocker assembly (not shown) for operating two intake valves 1, and a lost motion exhaust rocker assembly 416 for operating first (or braking) and second exhaust valves $\mathbf{3}_1$ and $\mathbf{3}_2$, respectively. The exhaust rocker assembly 416 according to the fourth exemplary embodiment of the present invention is a lost motion type provided with automatic hydraulic adjusting and resetting functions as disclosed herein. The exhaust rocker assembly 416 includes an exhaust rocker arm 422 pivotally mounted about a rocker shaft 20 and provided to open the first and second exhaust valves $\mathbf{3}_1$ and $\mathbf{3}_2$, respectively, through an exhaust valve bridge 24. The rocker shaft 20 is supported by rocker arm supports (or rocker arm pedestals) and extends through a rocker arm bore 433 formed in the exhaust rocker arm 422 (shown in FIG. 19).

The IC engine incorporating the compression-release brake system 412 in accordance with the fourth exemplary embodiment of the present invention includes a pushrod (shown in FIG. 13) actuating the exhaust rocker assembly 416 and driven by the exhaust cam 2 (shown in FIG. 13). The exhaust rocker arm 422 has a driving (first distal) end 422*a* provided to operatively engage the engine exhaust valves $\mathbf{3}_1$ and $\mathbf{3}_2$ for controlling the engine exhaust valves $\mathbf{3}_1$ and $\mathbf{3}_2$, and a driven (second distal) end 22*b* located adjacent to the pushrod.

The rocker arm brake system 412 also comprises a substantially cylindrical actuation piston bore 464 formed in the exhaust rocker arm 422 for slidably receiving an actuation piston 462 (best shown in FIG. 20) therein. The actuation piston 462 is moveable between retracted and extended positions relative to the reset piston bore 464 in a direction substantially parallel to the exhaust valves $\mathbf{3}_1$ and $\mathbf{3}_2$, and is configured to contact a top end surface 76*a* of a single-valve actuation pin 76 (best shown in FIG. 20). The single-valve actuation pin 76 is slidably movable relative to the exhaust valve bridge 24. The actuation piston 462 defines a reset piston cavity 465 within the reset piston bore 464 in the exhaust rocker arm 422 (best shown in FIG. 20). The exhaust single-valve actuation pin 76 allows the actuation piston 462 to press against the first exhaust valve $\mathbf{3}_1$ to open the first exhaust valve $\mathbf{3}_1$ (only one of the two exhaust valves) during the compression-release engine braking operation (i.e., in the brake-on mode). In other words, the single-valve actuation pin 76 is reciprocatingly movable relative to the exhaust valve bridge 24 to make the first exhaust valve $\mathbf{3}_1$ movable relative to the second exhaust valve $\mathbf{3}_2$ and the exhaust valve bridge 24.

The rocker arm brake system 412 further comprises an exhaust valve reset device 432 disposed in the exhaust rocker arm 422. The exhaust valve reset device 432 includes a reset check valve disposed in the actuation piston 462, as shown in FIGS. 19 and 20. In the exemplary embodiments of the present invention, the reset check valve is in the form of a ball-check valve 443, which is normally biased open. It will be appreciated that any appropriate type of the check valve, other than the ball-check valve, is also within the scope of the present invention. The reset check valve 443 includes a ball-valve member 444, a ball-check seat 445 and a biasing (or reset) spring 446 that biases the reset ball-valve member 444 upward to an open position of the reset check valve 443.

The ball-valve member 444 is biased open, i.e., held off the ball-check seat 445 by the biasing spring force of the reset spring 446, so as to open a communication port 448 in the actuation piston 462, which fluidly connects the reset piston cavity 465 with a communication conduit 453 formed through the actuation piston 462. In turn, the communication conduit 453 in the actuation piston 462 is fluidly connected directly to the continuous supply conduit 426. In other words, when the reset check valve 443 is open, the continuous supply conduit 426 is fluidly connected to the reset piston cavity 465.

The exhaust valve reset device 432 of the rocker arm brake system 412 further includes a rocker check valve 450 also disposed in the exhaust rocker arm 422. In the exemplary embodiment of the present invention, the rocker check valve 450 is in the form of a ball-check valve, which is normally biased closed. It will be appreciated that any appropriate type of the check valve, other than the ball-check valve, is also within the scope of the present invention. The rocker check valve 450 is disposed in check-valve bore 434 formed in the exhaust rocker arm 422 substantially perpendicular to the rocker arm bore 433 receiving the rocker shaft 20. The bore 434 is closed by a plug 435. The rocker check valve 450 comprises a ball-valve member 440 disposed in the check-valve bore 434, and a ball-check spring 442 biasing the all-valve member 440 to its closing position. In other words, the ball-valve member 440 is held on a ball-check seat by the biasing spring force of the ball check spring 442 so as to close a communication opening 452 through the rocker check valve 450, which fluidly connects the continuous supply conduit 426 and the reset piston cavity 465 through a reset conduit 428.

The rocker arm brake system 412 according to the fourth exemplary embodiment of the present invention further comprises a compression release actuator 476 provided to selectively control the exhaust valve reset device 432. The compression release actuator 476, shown in FIGS. 19 and 20, is in the form of a fluid (such as pneumatic or hydraulic) actuator. Alternatively, the compression release actuator 476 may be in the form of a solenoid actuator. The fluid compression release actuator 476 comprises a casing 478 non-movable relative to the rocker shaft 20, and a brake-on piston 480 reciprocating within the casing 478. The brake-on piston 480 defines a brake-on piston cavity 481 within the casing 478 (best shown in FIG. 20). The casing 478 includes a brake-on fluid supply port 482 open to the brake-on piston cavity 481 and connected with a source of pressurized fluid (air or liquid). The casing 478 is provided with a piston stroke limiting pin 484. The piston stroke limiting pin 484 is an adjustable positive stop that limits upward and downward linear movement of the brake-on piston 480. Specifically, the brake-on piston 480 is provided with an axially extending groove 485 receiving the piston stroke limiting pin 484 therein.

The rocker arm brake system 412 according to the fourth exemplary embodiment of the present invention further comprises a reset pin 458 extending between the brake-on piston 480 and the reset ball-valve member 444 of the reset check valve 443.

Moreover, the exhaust rocker arm 422 includes a rocker arm adjusting screw assembly 468 (as best shown in FIG. 1) adjustably mounted in the driven end 422*b* of the exhaust rocker arm 422 so that the adjusting screw assembly 468 is disposed in the exhaust valve drive train on a camshaft side of the engine, and is operatively coupled to the pushrod. The adjusting screw assembly 468 defines an adjustable linkage placed in the exhaust valve drive train between the exhaust rocker arm 422 and the pushrod.

As best illustrated in FIG. 19, the rocker arm adjusting screw assembly 468 is provided to engage the pushrod in order to open the exhaust valves $\mathbf{3}_1$ and $\mathbf{3}_2$. The adjusting screw assembly 468 includes an adjustment screw 470 adjustably, such as threadedly, mounted in the driven end 422*b* of the exhaust rocker arm 422.

The screw assembly 468 comprises an adjustment screw 470 having a ball-like end 471 for being received in a socket (not shown) coupled to a top end of the pushrod. The adjustment screw 470 is adjustably, such as threadedly, mounted in the driven end 422*b* of the exhaust rocker arm 422 and fastened in place by a locknut 473.

The compression-release brake system 412 operates in a compression brake mode, or brake-on mode (during the engine compression brake operation) and a compression brake deactivation mode, or brake-off mode (during the positive power operation).

The engine braking operation during the brake-on mode is as follows.

To activate the engine brake, the compression release actuator 476 is activated and pressurized fluid enters the brake-on piston cavity 481 through the brake-on fluid supply port 482. Pneumatic or hydraulic fluid, such as engine oil, supplied to the brake-on piston cavity 481, forces the brake-on piston 480 downwardly. Subsequently, the brake-on piston 480 moves into the extended position to engage and move downwardly the piston stroke limiting pin 484, as shown in FIG. 19. The brake-on fluid supply port 482 is regulated to maintain a constant supply pressure to maintain a continuous force of approximately 16 pounds biasing the brake-on piston 480 downwardly to close the ball-valve member 444. Alternatively, the brake-on piston 480 of the compression release actuator 476 may be activated by an electronic solenoid or an electric magnet. The downward linear movement of the brake-on piston 480 biases the reset pin 458 downwardly and closes the reset check valve 443. As the reset check valve 443 is closed by the brake-on piston 480 via the reset pin 458, the actuation piston 462 does not retract into the reset piston bore 464 because the hydraulic fluid is locked within the reset piston bore 464 by the closed reset check valve 443 and the rocker check valve 450.

The operation of the compression-release engine brake system 412 according to the fourth exemplary embodiment requires opening only one of the two exhaust valves $\mathbf{3}_1$ and $\mathbf{3}_2$ so as to not exceed the valve train maximum valve train loading specifications. The opening of the braking exhaust valve $\mathbf{3}_1$ incorporates a single valve brake lift of approximately 0.100 inches. The compression-release engine brake system 412 requires the brake-on piston 480 to provide substantial downward biasing force to the ball-valve member 444 of the reset check valve 443 via the reset pin 458 to seal (i.e., close) the reset check valve 443 for approximately 50% of the typical 0.100 inch lift of the braking exhaust valve $\mathbf{3}_1$ for the initial valve opening. In other words, the ball-valve member 444 is biased closed mechanically during the first 0.050 inches of the single valve brake lift.

When the lift of the braking exhaust valve $\mathbf{3}_1$ is at approximately 50% (or 0.050 inches) of its entire engine brake braking lift, the brake-on piston 480 engages the adjustable piston stroke limiting pin (or positive stop) 484. From that moment on, downward linear movement of the brake-on piston 480 is prevented. Subsequently, as the exhaust rocker arm 422 continues to move the exhaust bridge 24 downwardly, the brake-on piston 480 stops pushing the reset pin 458 downward.

Cylinder pressure and, therefore, the valve force against the actuation piston 462 continue to rise during the second half of the motion of the braking exhaust valve $\mathbf{3}_1$. The increasing hydraulic pressure now holds the reset ball-valve member 444 firmly on its seat 445, such that contact with the reset pin 458 is no longer needed for the last (or second) 50% of motion. In other words, the downward biasing force of the reset pin 458 on the ball-valve member 444 is eliminated at approximately 50% of the opening of the braking exhaust valve $\mathbf{3}_1$ resulting from the contact of the brake-on piston 480 with the adjustable positive stop 484, as the exhaust rocker arm 422 continues to open the braking exhaust valve $\mathbf{3}_1$. Cylinder pressure continues increasing during the compression stroke, thus biasing the braking exhaust valve $\mathbf{3}_1$ upward and increasing the pressure of the oil in the reset piston cavity 465. As a result, a downward biasing force acting to the reset ball-valve member 444 is provided. The high pressure in the reset piston cavity 465 produces a high pressure differential across the reset ball-valve member 444 to continue to bias the reset ball-valve member 444 seated, i.e., into the closed position of the reset check valve 443. In other words, the pressure in the actuation piston cavity 465 hydraulically biases the reset check valve 443 closed for the second and final half (i.e., 0.050 inch lift) of the single valve brake lift.

As described above, internal to the actuation piston 462 is the reset spring 446 that biases the reset ball-valve member 444 upward to an open position of the reset check valve 443 with an approximate initial force of the reset spring 446 of 13 pounds of force. During the expansion stroke 89 the cylinder pressure $\mathbf{89}_P$ will decrease rapidly due to air being released from the cylinder during the engine brake's compression relief event near TDC compression stroke.

The cylinder air mass, which is released through the opening of the braking exhaust valve $\mathbf{3}_1$ into the engine's exhaust manifold, results in a very low cylinder pressure near the end of the expansion stroke. Because the braking exhaust valve $\mathbf{3}_1$ remains open at approximately 0.100 inches lift, the valve spring $\mathbf{9}_1$ of the braking exhaust valve $\mathbf{3}_1$ creates an upward biasing force of approximately 100 pound-force (lbf) on the actuation piston 462.

Towards the end of the expansion stroke 89, when the cylinder pressure is close to atmospheric and an added small biasing force from the valve spring $\mathbf{9}_1$ of the braking exhaust valve $\mathbf{3}_1$, the higher biasing force from the reset spring 446 lifts the reset ball-valve member 444 off the seat 445, resulting in hydraulic fluid returning from the reset piston cavity 465 to the continuous supply conduit 426 and the hydraulic fluid supply passage 93, such as an engine oil supply. The returning hydraulic fluid flow allows the valve spring $\mathbf{9}_1$ of the braking exhaust valve $\mathbf{3}_1$ to force the actuation piston 462 upwardly to initiate contact between the reset pin 458 and the brake-on piston 480.

The resilient biasing force of the valve spring $\mathbf{9}_1$ of the braking exhaust valve $\mathbf{3}_1$ is approximately 100 pound-force (lbf), creating approximately 220 psi pressure in the reset piston cavity 465 to force the hydraulic fluid back into the hydraulic fluid supply passage 93 and allowing the actuation piston 462 to travel upwardly. When the braking exhaust valve $\mathbf{3}_1$ approaches 0.050 inches from the seated position, the reset pin 458 contacts the brake-on piston 480 and reset ball-valve member 444 will be seated, i.e., the reset check valve 443 is closed.

The biasing force of the valve spring $\mathbf{9}_1$ of the braking exhaust valve $\mathbf{3}_1$, which is approximately 100 lbf, exceeds the approximately 12 pound downward biasing force of the brake-on piston 480, forcing the brake-on piston 480 upwardly and positioned to approximately 0.050 inches above the adjustable positive stop 484. This causes the actuation piston 462 and the single-valve actuation pin 76 to move upwardly, thus permitting the single exhaust valve $\mathbf{3}_1$ to be reset and return the first exhaust valve $\mathbf{3}_1$ back to its valve seat. In other words, resetting the single exhaust braking valve $\mathbf{3}_1$ is achieved by sensing the decreasing cylinder pressure and corresponding hydraulic pressure in the actuation piston cavity 465 during the expansion stroke to unseat the ball-check 444 and release hydraulic fluid from the actuation piston cavity 465 to close or reset the single exhaust valve $\mathbf{3}_1$ to eliminate unbalanced exhaust bridge prior to the normal exhaust valve lift.

The hydraulic fluid supply passage 93 adds the final required make-up oil to the reset piston cavity 465 through the rocker check valve 450.

The rocker check valve 450 is fluidly connected to the continuous supply conduit 426 for supplying hydraulic fluid to the reset piston cavity 465. The rocker check valve 450 allows the reset piston cavity 465 to be completely filled prior the start of the compression braking stroke. The operation of the brake-on piston 480 biases the reset check valve 443, seated for approximately 0.050 inches of the lift of the braking exhaust valve $\mathbf{3}_1$, both during opening $\mathbf{91}_1$ and closing $\mathbf{91}_2$ exhaust lift profiles.

During refilling of the actuation piston cavity 465, the passageway 453 adds supply oil only until the brake-on piston 480 and the reset pin 458 bias the reset ball-valve member 444 of the reset check valve 443 prior to the last 0.050" of the single valve brake lift (or lost motion) to be taken up. Because the reset ball-valve member 444 seals the reset check valve 443 for the first 0.050" of the single braking lift, it cannot add make-up reset supply oil during the last the last 0.050" of the single braking lift. For this reason, the rocker check valve 450 is provided.

The reset check valve 443 is biased closed by the brake-on piston 480 (through the reset pin 458) for the initial 0.050 inch of an opening portion 88, of an exhaust cam profile lift 88 during the compression-release engine braking event, thereby preventing the continuous supply conduit 426 to add any make-up oil at normal oil supply pressure. The conical biasing spring 442 of the rocker check valve 450 has a low biasing force providing the make-up oil from the continuous supply conduit 426 to completely fill the reset piston cavity 465 and remove all exhaust valve train clearance prior to the next compression-release engine braking event 88 (shown in FIG. 12).

During the expansion stroke 89, the hydraulic fluid from the reset piston cavity 465 flows back into the continuous supply conduit 426, permitting the seating (displacement) of the braking exhaust valve $\mathbf{3}_1$ into its closed position. With the braking exhaust valve $\mathbf{3}_1$ seated (or closed), the normal exhaust cycle commences operation with both exhaust valves $\mathbf{3}_1$ and $\mathbf{3}_2$ closed, which eliminates unbalanced exhaust valve bridge 24 opening consisting of the closed outer exhaust valve $\mathbf{3}_2$ and the partially opened braking exhaust valve $\mathbf{3}_1$.

During the engine compression operation, a peak cylinder pressure in the engine cylinder can be as high as 1000 psi, resulting in a pressure of approximately 4000 psi in the reset piston cavity 465. The reset pin 458 comprises an enlarged, such as cylindrical, portion (or stop portion) 458*a* formed integrally (i.e. non-moveably or fixedly) between distal ends of the reset pin 458 and disposed in the reset piston cavity 465. The stop portion 458*a* of the reset pin 458 is configured to control an upper stop of the reset pin 458 in the reset piston cavity 465 and to control the upper biasing force resulting from hydraulic pressure in the reset piston cavity 465. A cross-sectional area (or diameter) of the stop portion 458*a* is larger than a cross-sectional area (or diameter) of the reset pin 458 outside of the cylindrical portion 458*a*. The differential area of the reset pin 458 minimizes the internal surface area of the reset pin 458 inside the reset piston cavity 465 to reduce or eliminate undesired biasing of the reset ball-valve member 444 during seating and unseating functions. Moreover, an upper pin stop surface 458*b* of the stop portion 458*a* faces and is configured to selectively engage a reset stop surface 459 of the exhaust rocker arm 422 to limit an upward movement of the reset pin 458.

The engine operation during the brake-off mode is as follows.

In operation of the engine with the rocker arm compression-release engine brake system 412 and the exhaust valve reset device 432 according to the fourth exemplary embodiment of the present invention, during the brake-off mode, the compression release actuator 476 is deactivated and the brake-on piston 480 is in the retracted position. Consequently, the reset check valve 443 is biased open by the reset spring 446.

In this position, the reset pin 458 does not bias the reset check valve 443 closed. In the brake-off mode, the pressurized hydraulic fluid, such as engine oil, is continuously supplied to the reset piston cavity 465 from the continuous supply conduit 426 through the communication conduit 453, the communication port 448 and the open reset check valve 443. Moreover, the open reset check valve 443 allows the pressurized hydraulic fluid to flow into and out of the reset piston cavity 465 through the communication conduit 453 and the communication port 448 to the continuous supply conduit 426. This continuing oil flow removes the mechanical clearance in a valve train (except the predetermined valve lash δ, best shown in FIG. 20) during positive power engine operation to eliminate valve train clatter and to maintain continuous contact between the exhaust cam profile and roller follower.

When the brake-on fluid supply to the brake-on piston cavity 481 through the brake-on fluid supply port 482 is off, the reset pin 458 is biased upwardly to the reset stop surface 459 of the exhaust rocker arm 422 by the reset spring 446 and the hydraulic fluid pressure acting on lower pin stop surface 458*c* of the stop portion 458*a*, thereby biasing the reset ball-valve member 444 upward to the open position for allowing unrestricted fluid flow in the reset piston cavity 465 to flow engine oil from the continuous supply conduit 426 freely into and out of the reset piston cavity 465 and to remove all exhaust valve train lash to reduce valve train impact and mechanical noise during positive power engine operation.

During the compression stroke 86, all valve train lash is removed by the addition of the pressurized hydraulic fluid to the reset piston cavity 465 through the continuous supply conduit 426, so that the reset piston 462 engages the braking exhaust valve $\mathbf{3}_1$. Near the end of the compression stroke 86, the engine brake lift profile 7 of the exhaust cam 2 causes rotation of the exhaust rocker arm 422. As the exhaust rocker arm 422 moves pivotally toward the braking exhaust valve $\mathbf{3}_1$, the reset piston 462 is unable to overcome the resilient biasing force of the valve spring $\mathbf{9}_1$ of the braking exhaust valve $\mathbf{3}_1$ and is displaced into the reset piston bore 464, so that the pressurized hydraulic fluid flows from the reset piston cavity 465 through the open reset check valve 443, which is biased off its seat 445 by the reset spring 446, into the continuous supply conduit 426.

After completion of the exhaust lift profile 88 (as shown in FIG. 12), the pressurized hydraulic fluid flows from the continuous supply conduit 426 through the open reset check valve 443, which is biased off its seat 445 by the reset spring 446, back into the reset piston cavity 465 to bias the reset piston 462 downward toward the braking exhaust valve $\mathbf{3}_1$ and remove the valve train lash.

Subsequently, the exhaust rocker arm 422 is on the exhaust cam profile (or upper base circle) 6 of the exhaust cam 2 ready to continue the normal exhaust cam lift profile 85. With the reset spring 446 continuously holding the reset ball-valve member 444 off its seat 445, thereby allowing unrestrictive flow of the engine oil in the reset piston cavity 465, the valve train lash is eliminated during the positive power operation of the engine.

Therefore, incorporating a hydraulic lash adjuster and an exhaust valve reset device on a lost motion rocker arm brake as disclosed herein has the advantages of not having to adjust brake valve lash at initial installation and at service intervals and having an automatic valve train adjustment to accommodate valve train wear and to reduce valve train mechanical sound levels. Moreover, the rocker arm compression-release engine brake system according to exemplary embodiments of the present invention is lighter than conventional compression-release engine brake systems, and provides lower valve cover height and reduced cost.

FIGS. 21-31B illustrate a fifth exemplary embodiment of a compression-release brake system generally designated by reference numeral 512. Components that are unchanged from the above-described embodiments are labeled with the same reference numerals. Components of the system 512 corresponding to components of the first embodiment are designated by the same reference numerals as used in FIGS. 1-12 but in the 500 series.

The compression-release brake system 512 is particularly useful for an IC engine, such as a four-stroke diesel engine, as generally shown in FIG. 36. The diesel engine comprises a cylinder block 11 and a plurality of cylinders 11'. Each engine cylinder 11 is associated with at least one intake valve 1, at least one exhaust valve $\mathbf{3}_1/\mathbf{3}_2$, at least one exhaust valve return spring $\mathbf{9}_1/\mathbf{9}_2$ exerting a closing force on the exhaust valve $\mathbf{3}_1/\mathbf{3}_2$ sufficient to urge the exhaust valve into a seated state, and an engine piston 13 configured to undergo reciprocating motion in the engine cylinder as part of an engine piston cycle that includes an intake stroke, a compression stroke, an expansion stroke, and an exhaust stroke in well-known manner.

Like the systems discussed above, the compression-release brake system 512 of the fifth exemplary embodiment is selectively operable in the positive power operation (brake-off mode) and the engine brake operation (brake-on mode). For example, a switch may be provided in the operator's cab to activate and deactivate the compression-release brake system 512.

Figure 21:
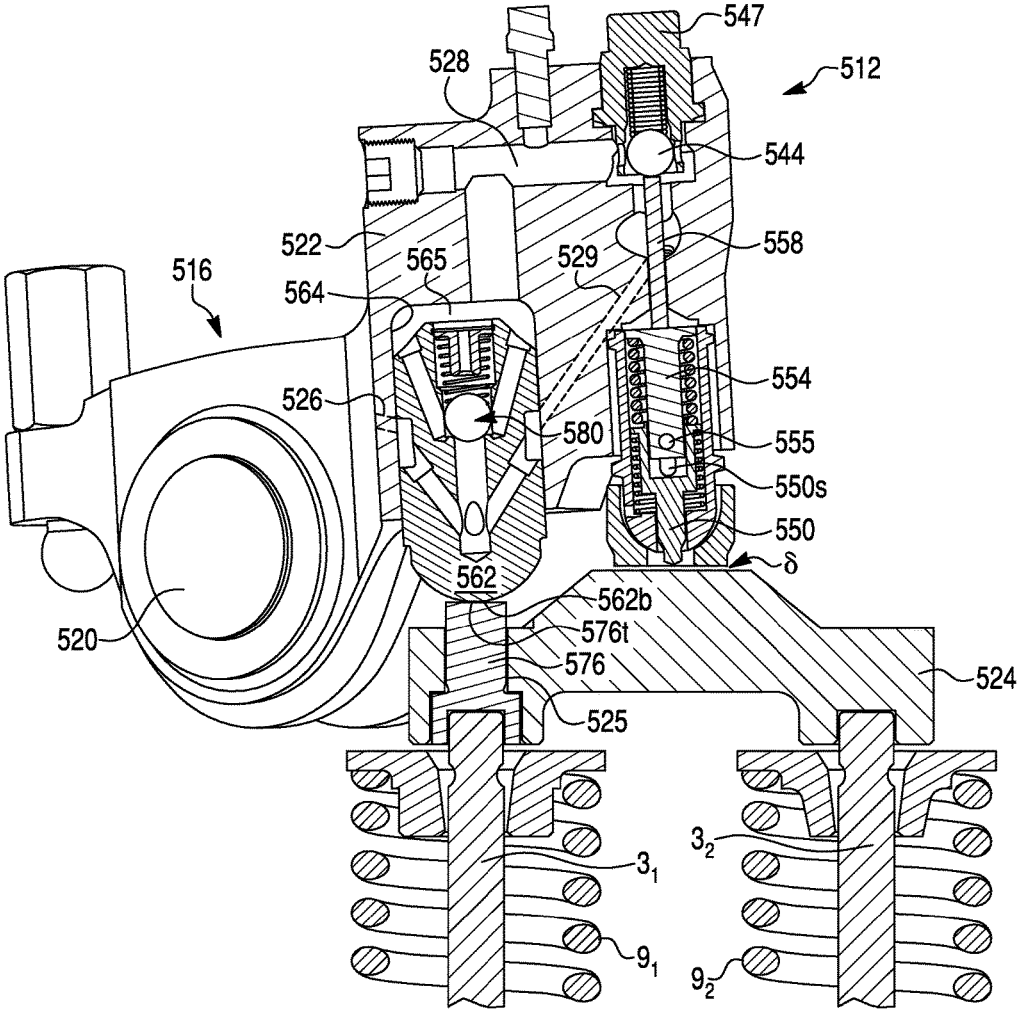
FIG. 21 is a fragmentary sectional view of the rocker arm compression-release engine brake system according to the fifth exemplary embodiment of the present invention in a brake-on mode.

Referring principally to FIG. 21, the compression-release brake system 512 includes a lost motion exhaust rocker assembly generally designated by reference numeral 516 for operating the exhaust valves $\mathbf{3}_1$ and $\mathbf{3}_2$. The intake rocker assembly with intake valves is not shown in FIG. 21, but may be of a conventional type as shown in FIG. 1. The exhaust rocker assembly 516 includes an exhaust rocker arm 522 pivotally mounted on a rocker shaft 520. The exhaust cam lobe follower 21, the exhaust camshaft 4, and the exhaust cam 2 may be provided as described above in connection with FIG. 2.

The exhaust rocker assembly 516 further includes a stop member in the form of an exhaust valve bridge 524 having an opening 525. The rocker shaft 520 may be supported by rocker arm supports (such as designated by reference numeral 25 in FIG. 1) and may be equipped with an accumulator as discussed above and illustrated in FIGS. 11A-11C and a solenoid valve as discussed above and illustrated in FIG. 11D. A driving end of the exhaust rocker arm 522 is operatively associated with the first and second exhaust valves $\mathbf{3}_1$ and $\mathbf{3}_2$, and a driven end of the exhaust rocker arm 522 has the exhaust lobe follower 21 (FIG. 2) adapted to contact an exhaust cam, such as the exhaust cam 2 having the exhaust cam profile 6, the engine lift profile 7 and the pre-charge lift profile 8 described above and illustrated in FIG. 2.

The exhaust rocker arm 522 features a dual-supply hydraulic circuit that includes a continuous supply conduit (or passageway) 526 and connecting conduits (or passageways) 528 and 529. Pressurized hydraulic fluid, such as engine oil, is supplied through the hydraulic circuit to remove valve train lash (except the predetermined valve lash δ). The exhaust rocker arm 522 further includes a separate brake-on supply conduit (or passageway) 530, shown for example in FIGS. 24-30. The flow of activation fluid (e.g., hydraulic fluid such as engine oil) through the brake-on supply conduit 530 may be controlled by a solenoid valve, such as described above in connection with FIG. 11D.

The exhaust rocker arm 522 includes a substantially cylindrical actuation piston pocket or bore 564 at the driving end of the exhaust rocker arm 522 for slidably receiving an actuation piston 562. The actuation piston 562 is reciprocatingly movable in the piston pocket 564 between a piston retracted position and a piston extended position. The actuation piston 562 is shown in the piston extended position in FIG. 21. In the piston retracted position, the actuation piston 562 in situated similar to the piston 62 depicted in FIG. 5B. A variable-volume piston cavity 565 is defined within the piston pocket 564, in particular between an upper end of the pocket 564 and the upper end surface of the actuation piston 562. The volume of the piston cavity 565 varies as the actuation piston 562 reciprocatingly moves between the piston extended position and the piston retracted position.

A single-valve actuation pin 576 is positioned between the actuation piston 562 and the first exhaust valve $\mathbf{3}_1$. The single-valve actuation pin 576 is slidable relative to the exhaust valve bridge 524 through the opening 525. A hemispherical bottom 562*b* of the actuation piston 562 engages the top 576*t* of the single-valve actuation pin 576. The bottom of the single-valve actuation pin 576 operatively engages the first exhaust valve $\mathbf{3}_1$. The actuation piston 562 is operatively associated with the exhaust valve $\mathbf{3}_1$ through the actuation pin 576 to permit unseating (opening) of the first exhaust valve $\mathbf{3}_1$ from the seated state during compression-release engine braking operation near or at TDC) without unseating the second exhaust valve $\mathbf{3}_2$.

Although the exemplary embodiments described herein, including the fifth exemplary embodiment, make use of an actuation pin such as the pin 576 for actuation of the first exhaust valve $\mathbf{3}_1$ while maintaining the second exhaust valve $\mathbf{3}_2$ unactuated, it should be understood that actuation of only the first exhaust valve $\mathbf{3}_1$ may be accomplished by other operations. For example, the bridge 524 may be pivotally movable by the actuation piston 562 to actuate the first exhaust valve $\mathbf{3}_1$ but not the second exhaust valve $\mathbf{3}_2$.

Figure 31A:
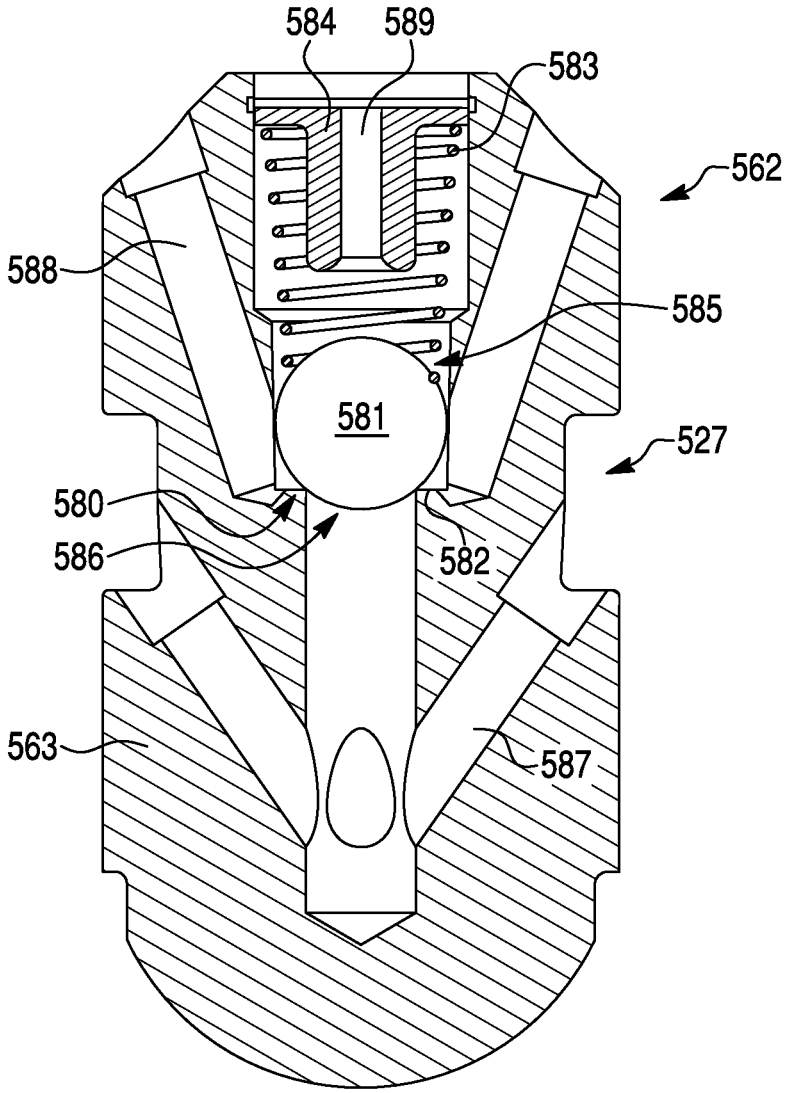
FIGS. 31A and 31B are enlarged sectional views of an actuation piston of the brake system of the fifth embodiment in closed and open states, respectively.
Figure 31B:
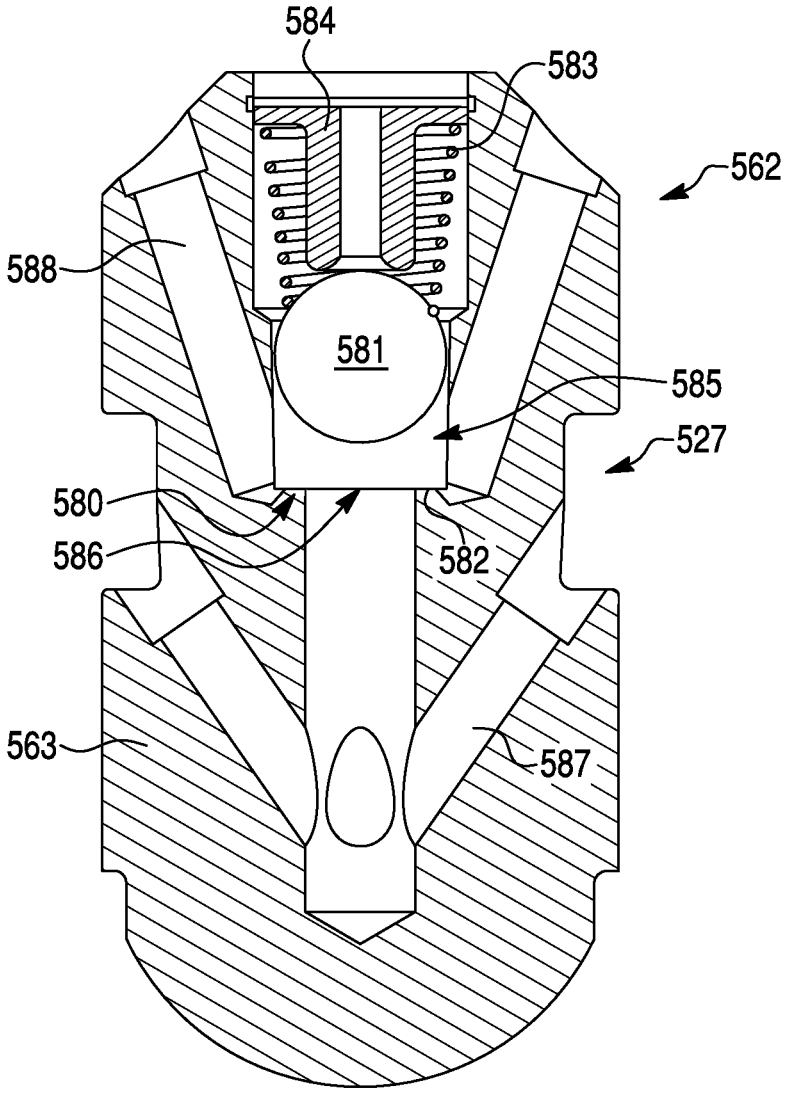

As best shown in FIGS. 31A and 31B, the actuation piston 562 has an actuation piston body 563. Internal to the actuation piston body 563 is an internal actuation piston check valve 580 that includes a spring-loaded actuation piston ball-valve member 581, an actuation piston check-valve seat 582, an actuation piston ball-valve check spring 583, and a stopper 584 fixed to the actuation piston body 563. The stopper 584 retains the ball-valve check spring 583 in place from above and includes a stopper passage 589 along its longitudinal axis.

The actuation piston body 563 also defines an actuation piston check-valve cavity 585 containing the ball-valve member 581 and the ball-valve check spring 583, an actuation piston communication port 586 surrounded by the actuation piston check-valve seat 582, actuation piston feed conduits 587 feeding into a vertical passage below the communication port 586, and actuation piston outlet conduits 588 above the communication port 586. The illustrated embodiment includes four feed conduits 587 spaced ninety degrees apart from one another, and four outlet conduits 588 circumferentially spaced ninety degrees apart from one another. It should be understood that the actuation piston 562 may contain a different number of conduits 587 and 588, and thus different angular spacing.

The actuation piston check valve 580 is movable between open and closed positions. In the open position shown in FIG. 31B, the actuation piston ball-valve member 581 is spaced from the actuation piston check-valve seat 582 to open the actuation piston communication port 586 and allow the flow of hydraulic fluid (e.g., engine oil) from the feed conduits 587 (which receive the hydraulic fluid from the supply conduit 526) and the communication port 586, up through the outlet conduits 588 and the stopper passage 589, into the piston cavity 565. In the closed position shown in FIG. 31A, the actuation piston ball-valve member 581 is seated on the actuation piston check-valve seat 582 to close the communication port 586. The actuation piston ball-valve check spring 583 biases the actuation piston ball-valve member 581 towards check-valve seat 582 and the closed position so that the actuation piston check valve 580 operates as a one-way valve, preventing the backflow of hydraulic fluid from the piston cavity 565 through the communication port 586 via the outlet conduits 588 and the stopper passage 589. As discussed below, at the appropriate times, the upward flow of hydraulic fluid through the actuation piston 562 overcomes the downward biasing force of the ball-valve check spring 583 to lift the ball-valve member 581 off the check-valve seat 582 and open the actuation piston check valve 580 to supplement hydraulic fluid flow to the piston cavity 565.

It should be understood that the actuation piston check valve 580 illustrated in the exemplary embodiment may be replaced by other suitable check valves, and that such modifications are within the scope of the invention.

Figure 22:
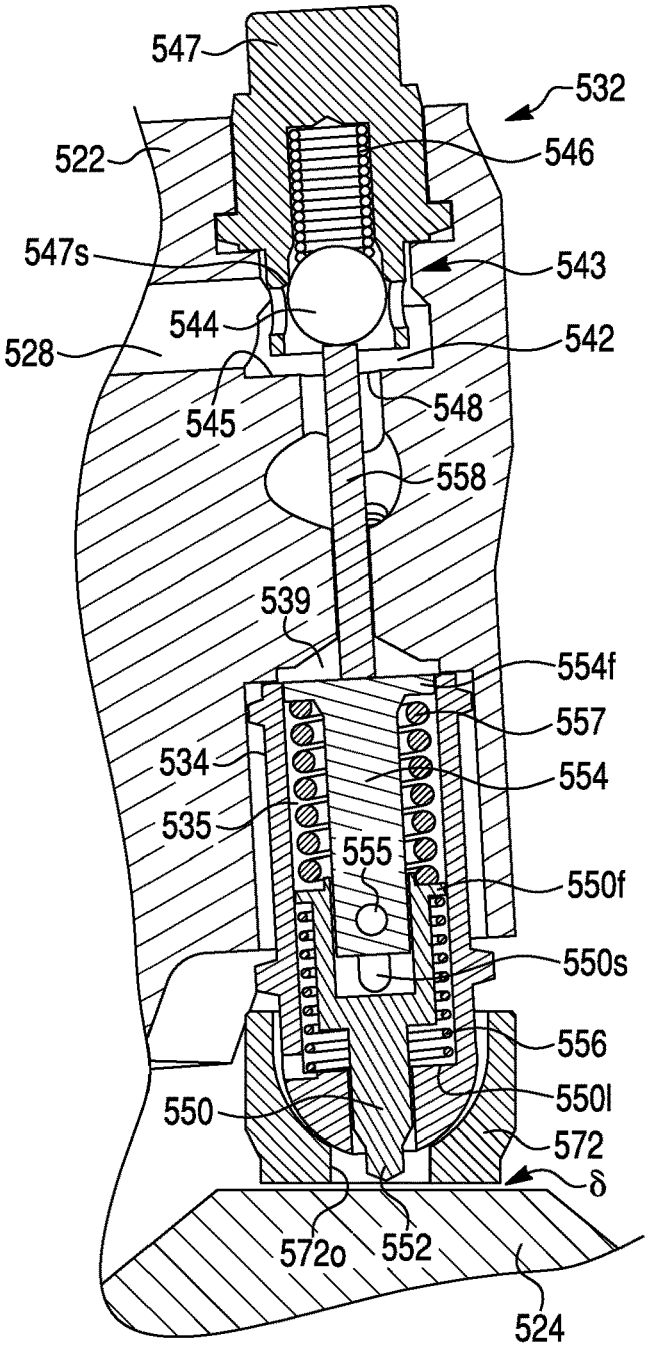
FIG. 22 is a fragmentary sectional view of a reset device of the rocker arm compression-release engine brake system of FIG. 21.
Figure 23:
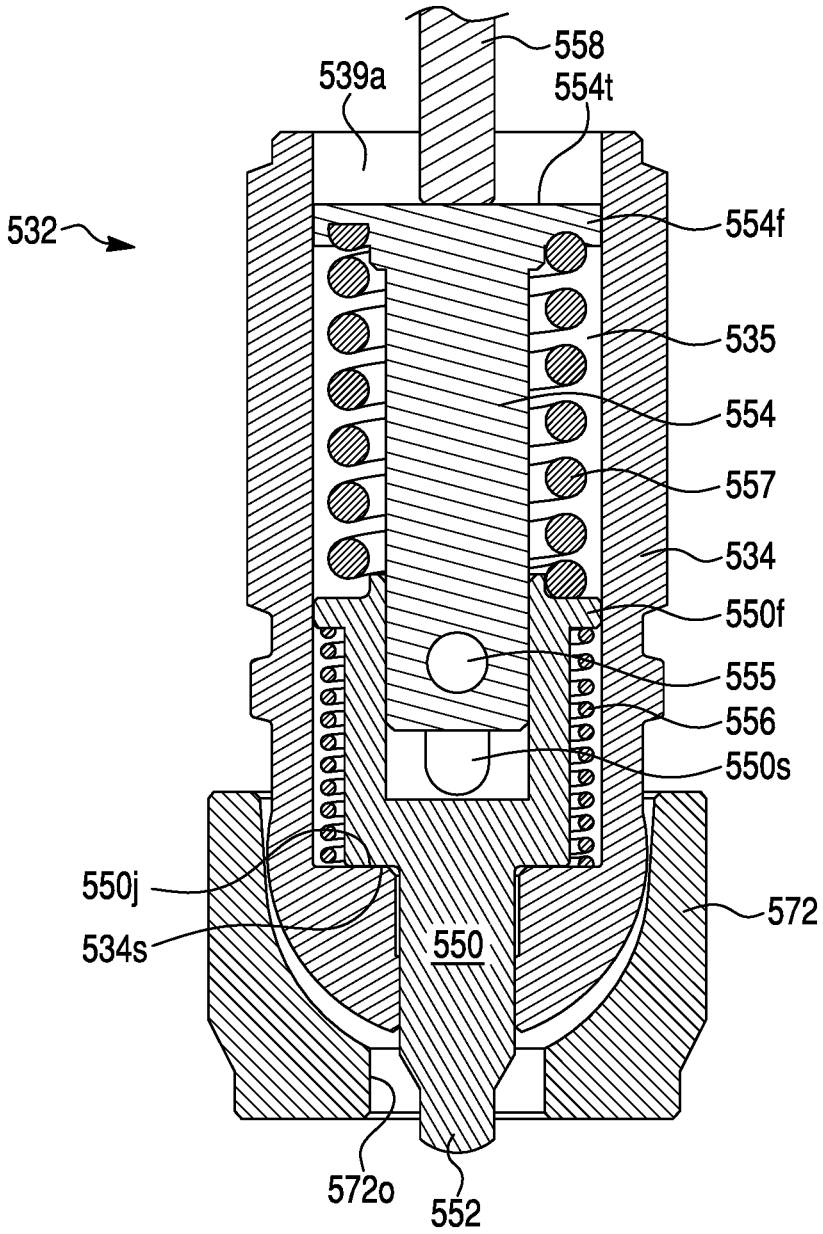
FIG. 23 is an enlarged fragmentary sectional view of the reset device of FIG. 22.

As best shown in FIGS. 22 and 23, the compression-release brake system 512 further includes an exhaust valve reset device (or reset device) 532 disposed in the exhaust rocker arm 522. The reset device 532 is similar in structure and operation to the reset device 32 illustrated in FIGS. 9A and 9B, with several differences pointed out below.

As best shown in FIGS. 22 and 23, the reset device 532 has a lower subassembly and an upper subassembly operatively connected to one another by upset pin 558. The lower subassembly of the reset device 532 includes a substantially cylindrical, hollow cartridge body 534. A swivelable foot (or "elephant foot") 572 is swivelably mounted at the lower end of the cartridge body 534 using a suitable swivel fastener. Swivel fasteners are known in the art. The foot 572 has a bottom opening 572*o*. The foot 572 operates similarly to the foot 72 and the foot 372 discussed above. The incorporation of the foot 572 into the reset device 532 permits the functions of a rocker arm adjusting screw assembly and an exhaust valve reset device to be combined into the same unit 532.

The cartridge body 534 has a reset device cavity 535 containing a reset trigger 550, a reset piston 554, a reset trigger return spring 556, and a reset pressure control spring 557. The reset trigger 550 is axially slidable within and relative to the cartridge body 534 between a trigger retracted position and a trigger extended position. A distal end 552 of the reset trigger 550 extends through bottom opening (unnumbered) of the cartridge body 534. When the reset trigger 550 is in the trigger extended position, the distal end 552 protrudes through the bottom opening 572*o* of the foot 572 and, depending on the pivotal position of the rocker arm 522, contacts the exhaust valve bridge 524, as discussed further below.

The reset trigger 550 is biased upwardly towards the trigger retracted position by the reset trigger return spring 556 disposed in the reset device cavity 535 between a shoulder portion 534*s* of the cartridge body 534 and a flange portion 550*f* of the reset trigger 550. As best shown in FIG. 23, a piston stroke limiting pin 555 connects the reset trigger 550 to the reset piston 554 while permitting relative longitudinal movement therebetween. The piston stroke limiting pin 555 is fixedly secured in a horizontal bore of the reset piston 554 and is configured to travel along the height of a slot 550*s* of the reset trigger 550. It should be understood that the reset trigger 550 may be provided with the stroke limiting pin, and the reset piston 554 may be provided with the slot in which the stroke limiting pin is received. The reset piston 554 has an upper flange portion (or landing) 554*f* that interfaces with the inside wall of the cartridge body 534 to seal the reset device cavity 535. The upset pin 558 is fixedly connected to the top surface 554*t* of, and optionally may be integrally formed with, the reset piston 554.

The reset device cavity 535 also includes the reset pressure control spring 557, which is positioned between the reset trigger flange portion 550*f* (opposite to the reset trigger return spring 556) and the flanged portion 554*f* of the reset piston 554. The reset pressure control spring 557 biases the reset piston 554 (and the upset pin 558 seated on the reset piston 554) upward.

An activation cavity 539 is positioned above a top surface 554*t* of the reset piston 554 to surround the lower end of the upset pin 558. The activation cavity 539 communicates with the brake-on supply conduit 530, as shown for example in FIGS. 24-30. As pressurized activation (e.g., hydraulic) fluid enters the activation cavity 539, the reset piston 554 is driven downward to create an adjustable cavity 539*a* (FIG. 23) above the top surface 554*t* within the cartridge body 534 to receive the activation fluid.

As mentioned above, the reset device 532 includes a lower subassembly (described above) and an upper subassembly (described below). The upset pin 558 extends through a hole or bore in the exhaust rocker arm 522 to connect the two subassemblies. An appropriate sleeve or other component may be provided around the upset pin 558 to provide a seal and thereby prevent the hydraulic or other fluid from escaping from the activation cavity 539 or a reset check-valve cavity 542 discussed below.

Referring to FIG. 22, the upper subassembly of the reset device 532 includes a reset check valve 543 including a reset ball-valve member 544 contained in the reset check-valve cavity 542 and movable relative to a reset check-valve seat 545 defined by hydraulic circuit of the exhaust rocker arm 522. A retaining plug 547 fitted in an opening of the exhaust rocker arm 522 above the reset check-valve cavity 542 is provided with a reset ball-valve check spring 546 that remains in constant contact with the upper part of the reset ball-valve member 544. The reset ball-valve check spring 546 exerts a downward biasing force on the reset ball-valve member 544 to urge the reset ball-valve member 544 towards a closed position in which the reset ball-valve member 544 sits on the reset check-valve seat 545 to close reset communication port 548. The reset ball-valve member 544 is shown in the closed position in FIGS. 27 and 28. FIGS. 21, 22, 24-26, 29, and 30 depict the reset ball-valve member 544 in the open position, in which the upset pin 558 mechanically lifts the reset ball-valve member 544 off the reset check-valve seat 545 to open the reset communication port 548. The retaining plug 547 has a travel stop surface 547*s* to limit upward movement of the reset ball-valve member 544 when the reset ball-valve member 544 is in the open position. It should be understood that the reset check valve 543 illustrated in this exemplary embodiment may be replaced with other suitable check valves, and that such modifications are within the scope of the invention.

The hydraulic circuit will now be discussed in greater detail. The various conduits of the hydraulic circuit may be positioned in locations other than those shown in the drawings.

The hydraulic fluid is fed from an accumulator such as described above in connection with FIGS. 11A-11C through the supply conduit 526 to the actuation piston 562. The actuation piston body 563 includes an annular groove 527 around its outer surface. The annular groove 527 has a height that is greater than the height of the supply conduit 526. In the piston extended position shown in FIG. 21, the upper portion of the annular groove 527 interfaces with and receives the hydraulic fluid from the supply conduit 526. In the piston retracted position (with the actuation piston body 563 moved upward relative to FIG. 21), the lower portion of the annular groove 527 interfaces with and receives the hydraulic fluid from the supply conduit 526.

The hydraulic fluid received by the annular groove 527 is fed into the actuation piston feed conduits 587, which are best shown in FIGS. 31A and 31B. From there, the hydraulic fluid flows upward towards the actuation piston check-valve cavity 585. As discussed in greater detail below, at certain times in operation when hydraulic fluid is needed to fill the piston cavity 565, a pressure differential across the actuation piston ball-valve member 581 will cause the hydraulic fluid to lift the actuation piston ball-valve member 581 off the check-valve seat 582, allowing the hydraulic fluid to flow through the actuation piston outlet conduits 588 and the stopper passage 589 into the piston cavity 565.

Figure 27:
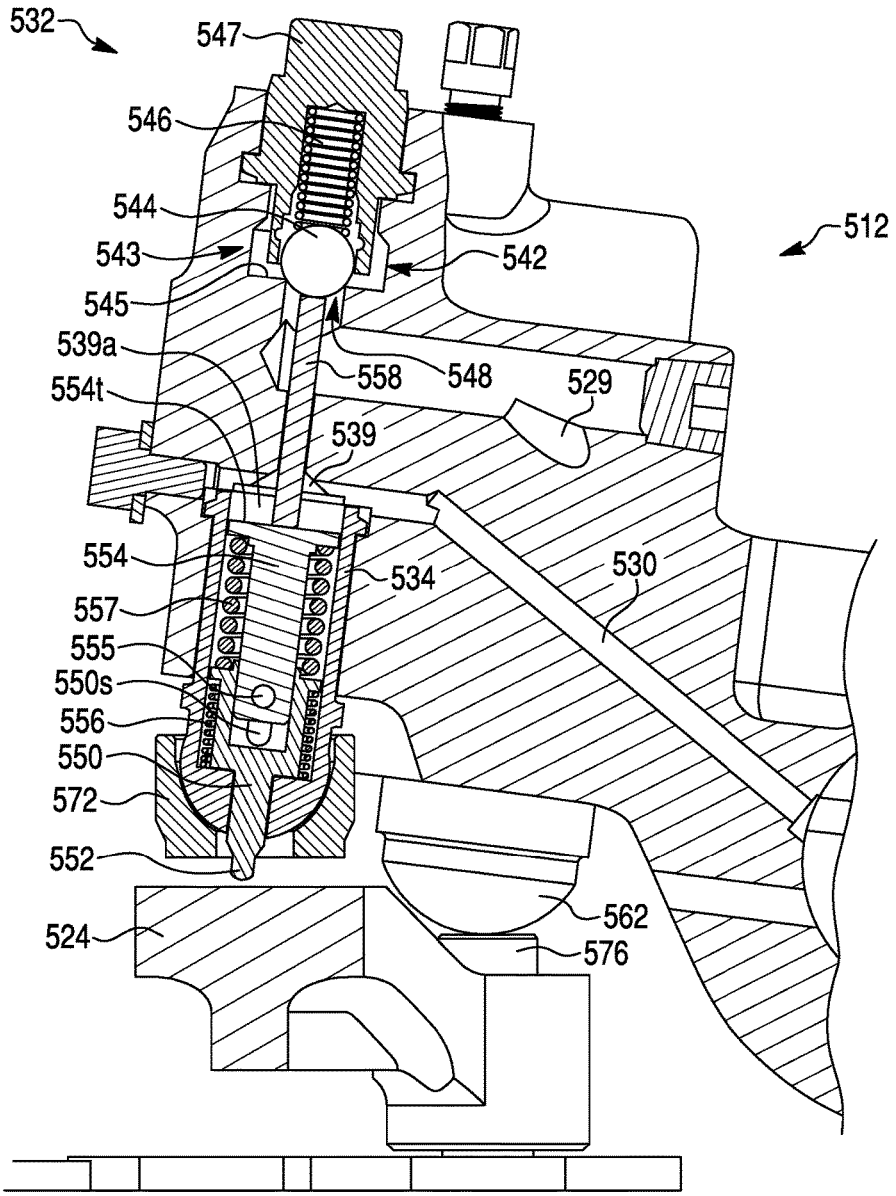
FIG. 27 is a partially fragmentary sectional view of the fifth embodiment depicting the rocker arm compression-release engine brake system in brake-on mode with the exhaust rocker arm on lower base circle.
Figure 28:
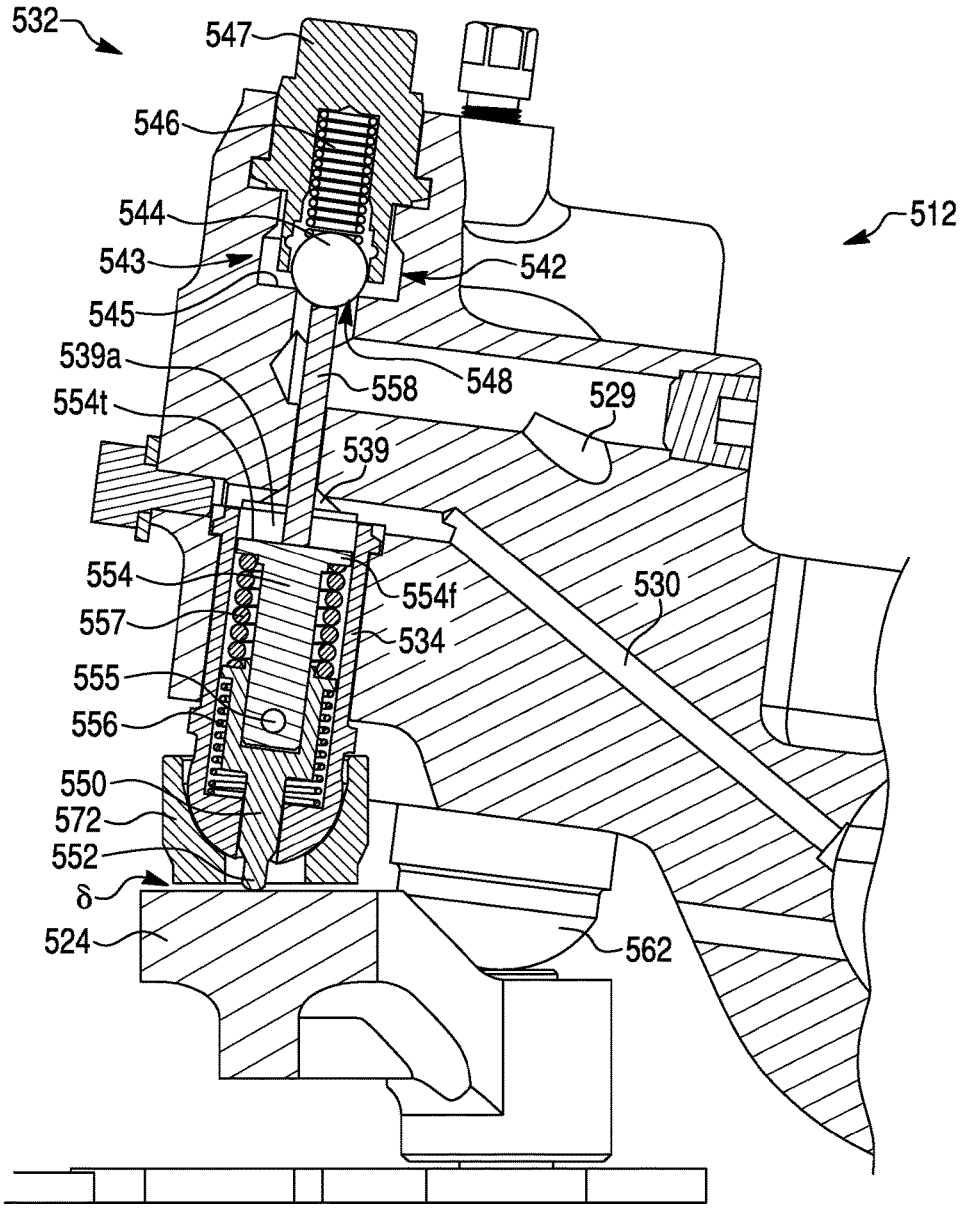
FIG. 28 is a partially fragmentary sectional view of the fifth embodiment depicting the rocker arm compression-release engine brake system in brake-on mode with the exhaust rocker arm on upper base circle.

The annular groove 527 is also connected to the connecting conduit 529, which is sometimes referred to herein as the first connecting conduit. As best shown in FIG. 21, the first connecting conduit 529 feeds the hydraulic fluid received from the supply conduit 526 to the reset check-valve cavity 542 (FIG. 22). In the same manner as described above with respect to the supply conduit 526 and the annular groove 527, the first connecting conduit 529 remains in constant fluid communication with the annular groove 527 irrespective of whether the actuation piston 562 is in the piston extended position or piston retracted position, The connecting conduit 528, which is sometimes referred to herein as the second connecting conduit, connects the reset check-valve cavity 542 to the piston cavity 565. When the reset check valve 543 is in the closed position as shown in FIGS. 27 and 28, the reset ball-valve member 544 sits on the reset check-valve seat 545. On the other hand, when the reset check valve 543 is in the open position, the reset ball-valve member 544 is spaced from the reset check-valve seat 545 to allow the hydraulic fluid to flow from the first connecting conduit 529 through the reset communication port 548 to the second connecting conduit 528 so as to feed into the piston cavity 565. Thus, the open reset check valve 543 allows the supply conduit 526 to connect to the piston cavity 565 through the connecting conduits 528 and 529 and the reset communication port 548.

The positive power operation (brake-off mode) of the IC engine is now described with reference to FIGS. 24-26. During positive power operation, the reset trigger 550 is maintained in the trigger retracted position shown in FIGS. 24-26 by reducing or eliminating hydraulic fluid pressure in the activation cavity 539, so that the biasing forces of the reset trigger return spring 556 and the reset pressure control spring 557 each exceed the force, if any, exerted by hydraulic fluid in the activation cavity 539 on the top surface 554*t* of the reset piston 554. For example, a solenoid valve controlling the flow of activation fluid through the brake-on supply conduit 530 to the activation cavity 539 may be deactivated. In the trigger retracted position shown in FIGS. 24-26, the reset piston 554 is in a fully raised position. The upset pin 558 attached to the top surface 554*t* of the reset piston 554 is likewise in its fully raised position so that the top end of the upset pin 558 lifts and maintains the reset ball-valve member 544 above the reset check-valve seat 545, and in an open position, for the entirety of the brake-off mode. Because the reset check valve 543 is open, the reset communication port 548 allows the supply conduit 526 to be maintained in fluid communication with the piston cavity 565 through the first and second connecting conduits 529 and 528. Hydraulic fluid, such as engine oil, is able to flow back and forth between the piston cavity 565 and the supply conduit 526 relatively unobstructed by the open reset check valve 543. The hydraulic fluid fills the actuation piston cavity 565, moving the actuation piston 562 into its piston extended position and eliminating the valve train lash except for the predetermined valve lash δ set between the foot 572 and the exhaust valve bridge 524. The hydraulic fluid may also open the actuation piston check valve 580 and feed into the piston cavity 565 through the actuation piston communication port 586.

Figure 24:
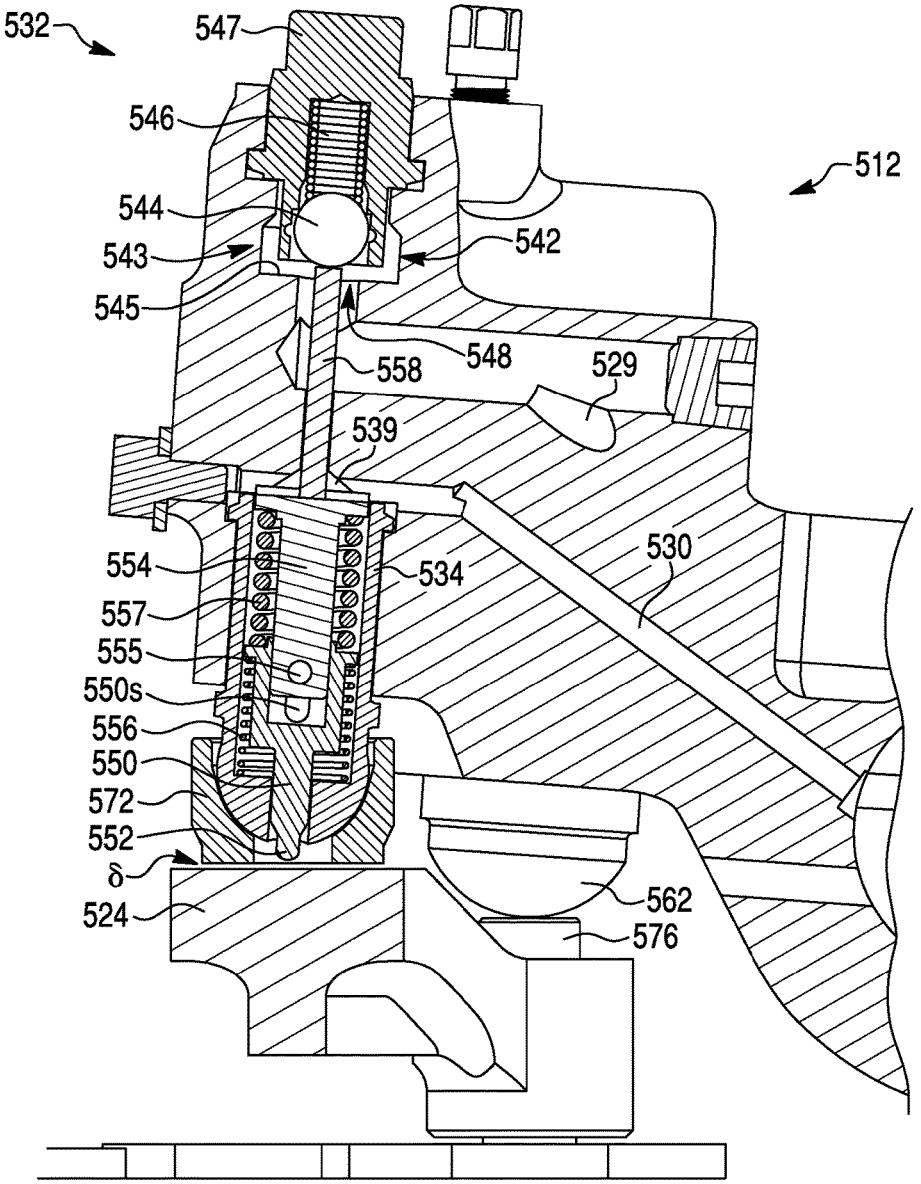
FIG. 24 is a partially fragmentary sectional view of the fifth embodiment depicting the rocker arm compression-release engine brake system in brake-off mode with the exhaust rocker arm on upper base circle.

FIG. 24 is a view of the compression-release engine brake system 512 in the brake-off mode with the exhaust cam lobe follower 21 of the driven end 22*b* (FIG. 2) of the exhaust rocker arm 522 on the upper base circle (corresponding to the engine brake lift profile 7 of FIG. 2) of the exhaust cam 2. The engine brake lift profile 7 engages the driven end 22*b* of the exhaust rocker arm 522 to pivotally rotate the exhaust rocker arm 522, causing the distal end of the actuation piston 562 to press on the single-valve actuation pin 576. The pressing force maintains the actuation piston 562 in contact with the single-valve actuation pin 576 but is insufficient to unseat the first exhaust valve $\mathbf{3}_1$. The pressing force may move the actuation piston 562 upwardly to displace hydraulic fluid from the piston cavity 565, through the connecting conduits 528 and 529 and the supply conduit 526 into the accumulator cavity 94 of the rocker shaft 20. Due to the predetermined valve lash δ, the foot 572 of the reset device 532 is spaced apart from the exhaust valve bridge 524. Consequently, both exhaust valves $\mathbf{3}_1$ and $\mathbf{3}_2$ remain seated in a closed state.

Figure 25:
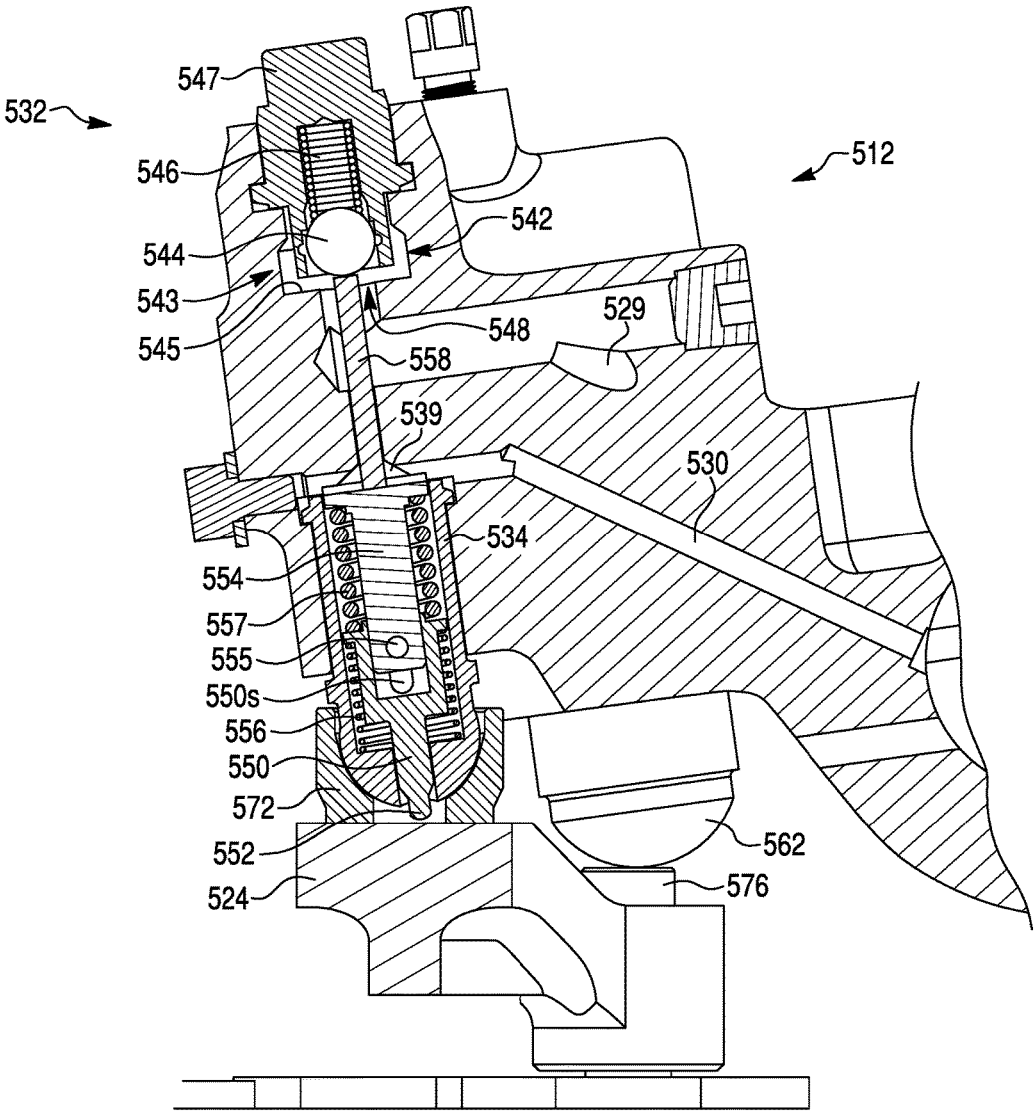
FIG. 25 is a partially fragmentary sectional view of the fifth embodiment depicting the rocker arm compression-release engine brake system in brake-off mode during exhaust mode.

FIG. 25 is a view of the compression-release engine brake system 512 in the brake-off mode with the exhaust cam lobe follower 21 of the driven end 22*b* (FIG. 2) of the exhaust rocker arm 522 of the exhaust rocker arm 522 operatively associated with the exhaust cam profile 6 (FIG. 2) for carrying out an exhaust stroke. The exhaust cam profile 6 pivots the exhaust rocker arm 522, eliminating the valve lash δ and maintaining the actuation piston 562 in contact with the single-valve actuation pin 576. The actuation piston 562 retracts to remain in contact with the actuation pin 576, but does not interfere with the intended operation on the exhaust valve bridge 524. Upward movement of the actuation piston 562 displaces the hydraulic fluid from the actuation piston cavity 565 through the connecting conduits 528 and 529 and the supply conduit 526 to the accumulator cavity 94. The pivotal movement of the exhaust rocker arm 522 presses the foot 572 on the exhaust valve bridge 524. The pressing force of the foot 572 on the exhaust valve bridge 524 moves the exhaust valve bridge 524 downward to simultaneously open the exhaust valves $\mathbf{3}_1$ and $\mathbf{3}_2$ in a balanced manner during the exhaust stroke.

Figure 26:
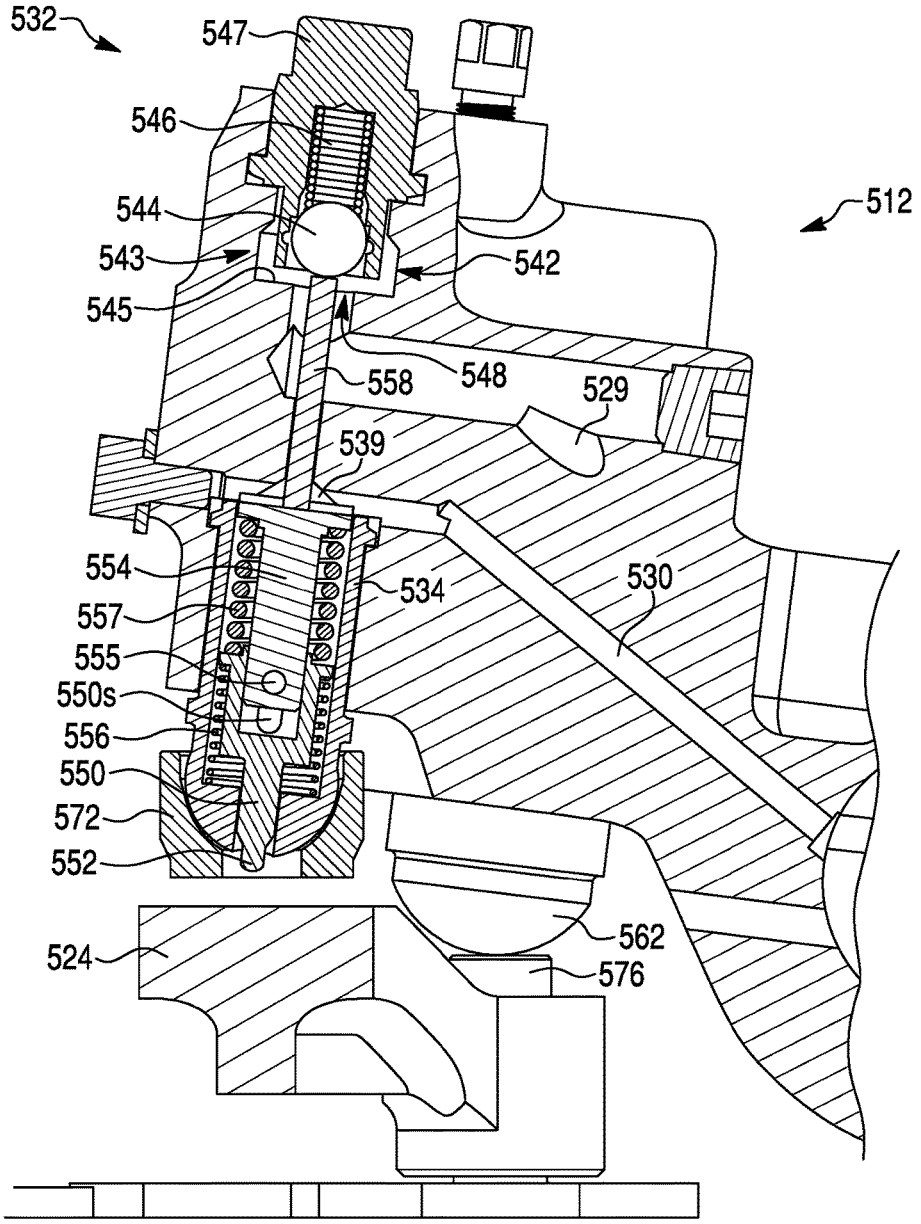
FIG. 26 is a partially fragmentary sectional view of the fifth embodiment depicting the rocker arm compression-release engine brake system in brake-off mode with the exhaust rocker arm on upper base circle.

FIG. 26 is a view of the compression-release engine brake system 512 in the brake-off mode with the exhaust cam lobe follower 21 of the driven end 22*b* (FIG. 2) of the exhaust rocker arm 522 positioned on the lower base circle 5 (FIG. 2). The actuation piston 562 extends in the actuation piston cavity 565 while remaining in contact with the single-valve actuation pin 576. Hydraulic fluid is fed from the accumulator cavity 94, through the supply conduit 526, the connecting conduits 528 and 529 and the open reset check valve 543 into the piston cavity 565 as the actuation piston 562 moves into the piston extended position. The hydraulic fluid may also enter into the piston cavity 565 by opening the actuation piston check valve 580 to flow through the actuation piston communication port 586 and the outlet conduits 588, thereby supplementing the flow of hydraulic fluid to the piston cavity 565 and keeping the hydraulic circuit, including the piston cavity 565, filled.

The compression-release brake system 512 in brake-on mode will now be described with reference to FIGS. 27-30.

FIG. 27 is a view of the compression-release engine brake system 512 in the brake-on mode with the exhaust cam lobe follower 21 of the driven end 22*b* (FIG. 2) of the exhaust rocker arm 522 positioned on the lower base circle 5 of the exhaust cam 2. An activator, such as the solenoid valve 98 discussed above with reference to the first embodiment and FIG. 11D, is energized to feed pressurized activation fluid (e.g., engine oil) through the brake-on supply conduit 530 into the activation cavity 539. The brake-on supply conduit 530 may be isolated from the supply conduit 526 to provide a multi-source (e.g., dual-source) system. However, the system can be operated as a single-source system, as described below in the seventh exemplary embodiment.

The pressurized hydraulic fluid accumulates in the activation cavity 539 and exerts a downward force on the top surface 554*t* of the reset piston 554. This downward force overcomes the biasing force exerted by the reset trigger return spring 556 to compress the trigger return spring 556 and drive the reset trigger 550 downward from the trigger retracted position, which is discussed above in connection with the brake-off mode to the trigger extended position shown in FIG. 27. The pressurized hydraulic fluid fills the adjustable cavity 539*a* as the reset piston 554 is driven downward.

The reset trigger return spring 556 may be provided with a lower spring constant than the reset pressure control spring 557, so that the downward movement of the reset piston 554 at this activation stage primarily compresses the reset trigger return spring 556 and not the reset pressure control spring 557. Because of the higher spring constant of the reset pressure control spring 557, the height of the reset pressure control spring 557 remains fixed at the piston stroke limiting pin 555, i.e., the piston stroke limiting pin 555 does not slide downward along the slot 550*s* of the reset trigger 550 at this time. In the trigger extended position shown in FIG. 27, a jut 550*j* of the reset trigger 550 abuts against the shoulder portion 534*s* of the cartridge body 534 to limit the downward movement of the reset trigger 550. The distal end 552 of the reset trigger 550 protrudes through the opening 5720 of the foot 572.

In addition to moving the reset trigger 550 into the trigger extended position, the downward movement of the reset piston 554 translates downward the upset pin 558 connected to the top surface 554*t* of the reset piston 554. The upper end of the upset pin 558 is thereby lowered below the reset communication port 548. The biasing force exerted by the reset ball-valve check spring 546 on the reset ball-valve member 544 urges the reset ball-valve member 544 onto the reset check-valve seat 545, closing the reset check valve 543.

The reset check valve 543 closes after the hydraulic fluid has flowed into the piston cavity 565 to extend the actuation piston 562 into the piston extended position to retain contact with the actuation pin 576 and drive the exhaust rocker arm 522 away from the exhaust valve bridge 524, as shown in FIG. 27. All valve train lash between the single-valve actuation pin 576 and the actuation piston 562, and the cam follower 21 and the lobe of the exhaust cam 2, is eliminated. In this closed position, the reset check valve 543 prevents the reverse flow of the hydraulic fluid from the piston cavity 565 and the second connecting conduit 528 through the reset communication port 548 back into the first connecting conduit 529 and the supply conduit 526.

Next, the cam follower 21 of the driven end 22*b* (FIG. 2) of the exhaust rocker arm 522 proceeds from the lower base circle 5 on the exhaust cam 2 discussed above with respect to FIG. 27 to the upper base circle (i.e., the brake lift profile 7 of FIG. 2). FIG. 28 depicts the compression-release brake system 512 in the brake-on mode with the exhaust rocker arm 522 positioned on the upper base circle 7 of the exhaust cam 2 (FIG. 2).

As the exhaust rocker arm 522 moves from lower base circle 5 towards upper base circle 7, the downward motion of the driving end of the exhaust rocker arm 522 drives the actuation piston 562 against the single-valve actuation pin 576. Initially, the downward moving actuation pin 576 lacks sufficient force to open the exhaust valve $\mathbf{3}_1$. With the actuation piston 562 in the piston extended position and the piston cavity 565 and the second connecting conduit 528 filled with the hydraulic fluid, the hydraulic fluid in the piston cavity 565 and the connecting conduit 528 acts on the reset ball-valve member 544 to hydraulically lock the reset check valve 543 in the closed position with the reset ball-valve member 544 retained on the reset check-valve seat 545 to prevent backflow.

FIG. 28 also shows the distal end 552 of the reset trigger 550 in the trigger extended position in contact with the exhaust valve bridge 524. The downward motion of the driving end of the exhaust rocker arm 522 (as the brake lift profile 7 pivots the exhaust rocker arm 522 about the rocker shaft 520) drives the distal end 552 into the exhaust valve bridge 524, moving the reset trigger 550 upward relative to the cartridge body 534. Upward movement of the reset trigger 550 lifts the jut 550*j* of the reset trigger 550 off the shoulder 534*s* of the reset piston 534. As the exhaust rocker arm 522 continues towards the upper base circle 7 to move the exhaust rocker arm 522 farther downward towards the exhaust valve bridge 524, the reset trigger 550 continues its upward movement relative to the cartridge body 534 into the trigger retracted position. Upward movement of the reset piston 554 is prevented by the upset pin 558 contacting the bottom of the reset ball-valve member 544, which is hydraulically locked in the closed position by the high hydraulic pressure in the second connecting conduit 528 and the piston cavity 565. As the reset trigger 550 moves upwardly relative to the reset piston 554, the slot 550*s* of the reset trigger 550 is guided by the piston stroke limiting pin 555 of the reset piston 554. The reset pressure control spring 557 compresses between the reset trigger flange portion 550*f* and the flange portion 554*f* of the reset piston 554, building potential energy in the reset pressure control spring 557.

The continued downward rotational movement of the distal end of the exhaust rocker arm 522 as the exhaust rocker arm 522 moves toward the upper base circle 7 causes the actuation piston 562 in its piston extended position to drive the single-valve actuation pin 576 downward and open the first exhaust valve $\mathbf{3}_1$ just prior to or at TDC of the compression stroke during the compression-release engine braking event. Due to the predetermined valve lash δ (FIG. 28), the foot 572 does not press the exhaust valve bridge 524 downward, and consequently the bridge 524 remains stationary and the second exhaust valve $\mathbf{3}_2$ remains closed. The opening of the first exhaust valve $\mathbf{3}_1$ at or near TDC compression causes the engine cylinder pressure to drop after TDC, thereby relieving the upward force acting on the actuation piston 562 (through the actuation pin 574) and decreasing the hydraulic pressure in the piston cavity 565 and the second connecting conduit 528.

Figure 29:
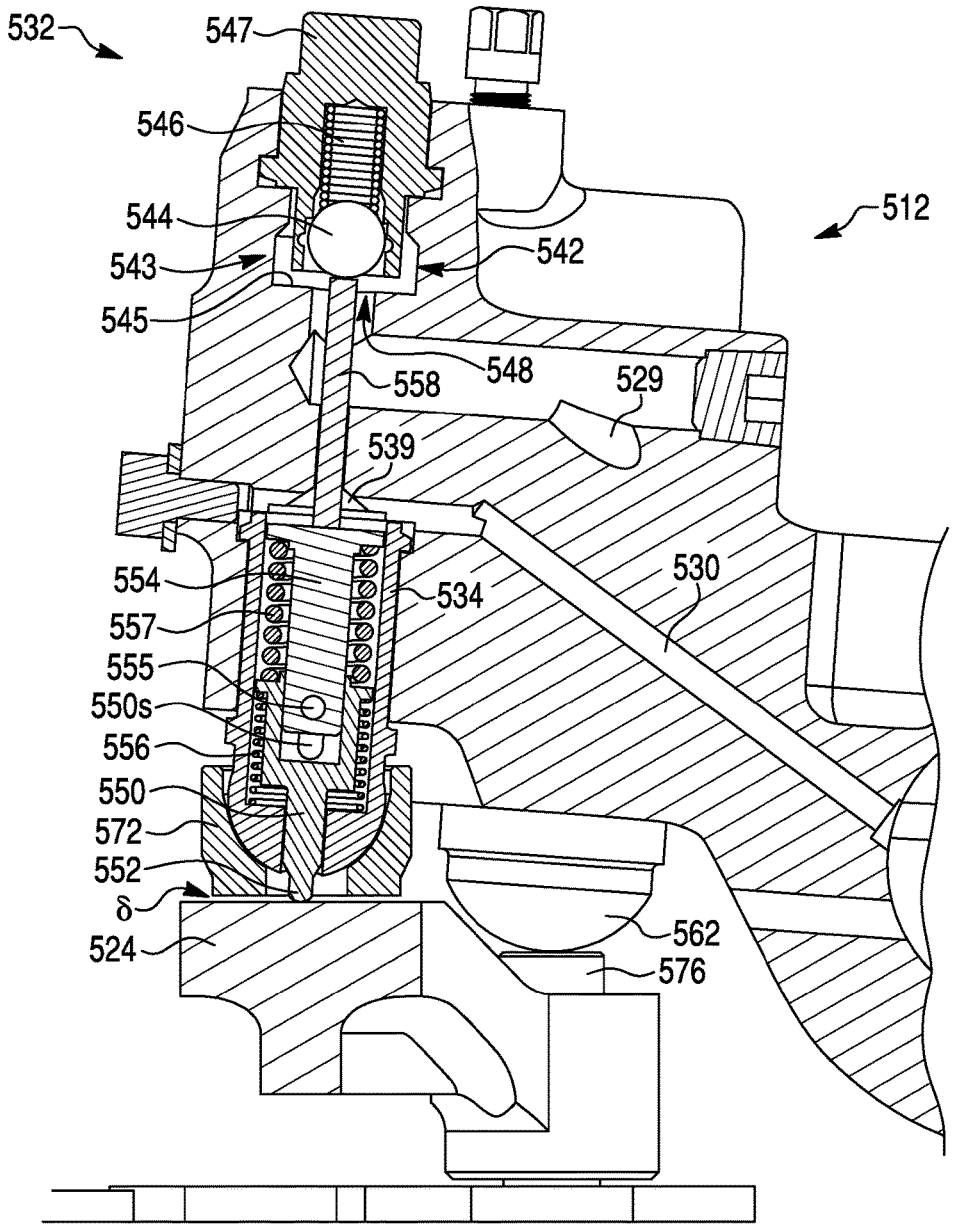
FIG. 29 is a partially fragmentary sectional view of the fifth embodiment depicting the rocker arm compression-release engine brake system in brake-on mode during reset.

When the biasing force applied by the compressed reset pressure control spring 557 exceeds the force exerted by the decreasing hydraulic pressure above the reset ball-valve member 544 (the force exerted by the reset ball-valve check spring 546 is negligible), the upward force exerted by the potential energy in the compressed reset pressure control spring 557 drives the reset piston 554 and the upset pin 558 upward and thereby unseats the reset ball-valve member 544 from the reset check-valve seat 545, opening the reset check valve 543 at the beginning of the expansion stroke. FIG. 29 illustrates the reset check valve 543 having been opened during the expansion stroke. A portion of the hydraulic fluid in the piston cavity 565 and the second connecting conduit 528 is released through the open reset communication port 548 and the conduits 529 and 526 to the accumulator cavity 94, where the hydraulic fluid is stored for the next braking event. The release of the hydraulic fluid from the piston cavity 565 allows the actuation piston 562 to move into the piston retracted position as the closing force of the exhaust valve return spring $\mathbf{9}_1$ resets the exhaust valve $\mathbf{3}_1$ into the seated state by the end of the expansion stroke, that is, prior to the exhaust stroke. Because both exhaust valves $\mathbf{3}_1$ and $\mathbf{3}_2$ are seated before the exhaust stroke begins, the exhaust rocker arm 522 can act on the exhaust valve bridge 524 with both exhaust valve $\mathbf{3}_1$ and $\mathbf{3}_2$ initially seated to simultaneously open the exhaust valves $\mathbf{3}_1$ and $\mathbf{3}_2$ in a balanced condition during the exhaust stroke.

Figure 30:
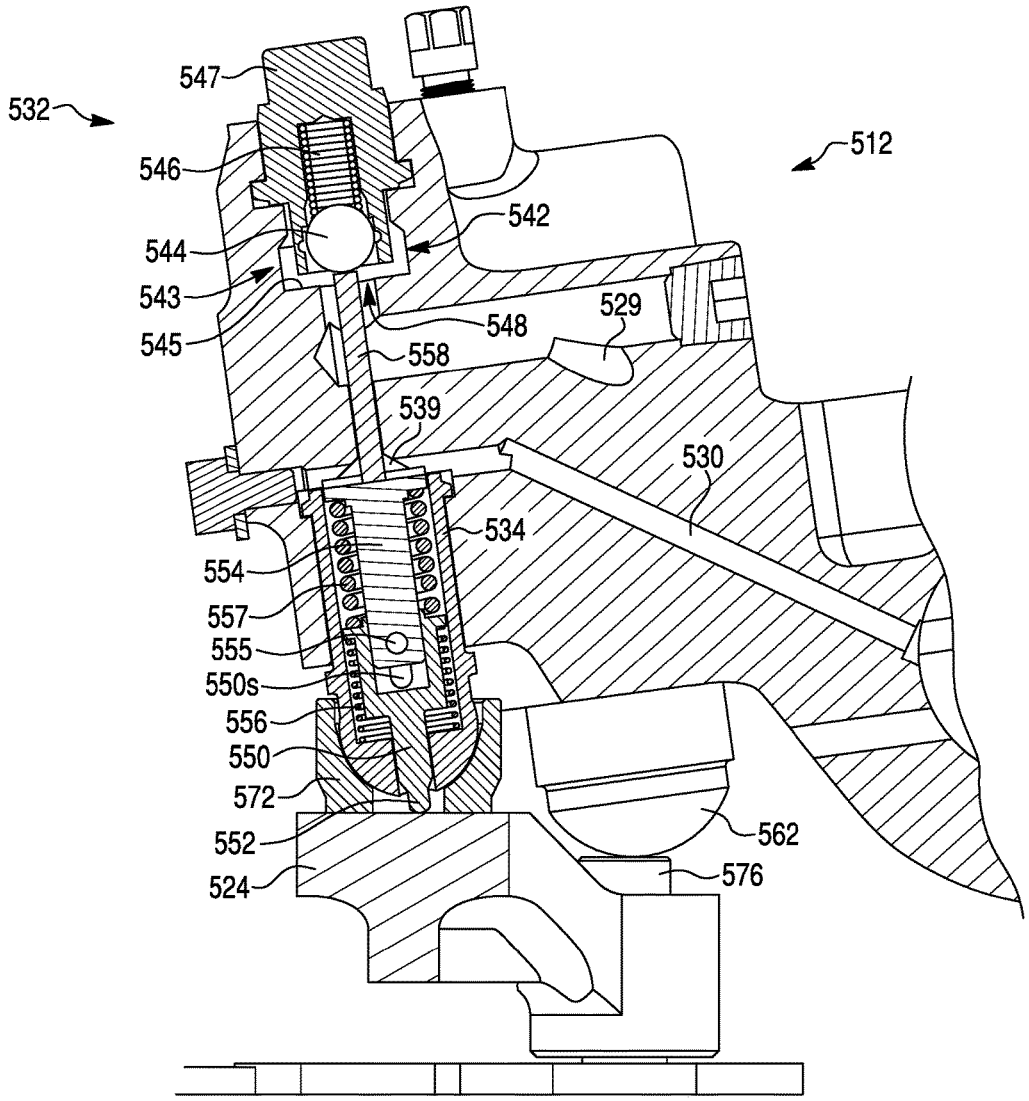
FIG. 30 is a partially fragmentary sectional view of the fifth embodiment depicting the rocker arm compression-release engine brake system in brake-on mode during the exhaust stroke.

FIG. 30 depicts the compression-release brake system 512 in the brake-on mode with the exhaust cam lobe follower 21 of the driven end 22*b* (FIG. 2) of the exhaust rocker arm 522 positioned on the exhaust cam profile 6 of the exhaust cam 2 for carrying out an exhaust stroke. The state of the compression-release brake system 512 in FIG. 30 is substantially identical to that shown in FIG. 25. The predetermined valve lash δ is taken up and the pivotal movement of the exhaust rocker arm 522 causes the foot 572 to press on the exhaust valve bridge 524 downward to simultaneously open the exhaust valves $3_1$ and $3_2$ during the exhaust stroke. The actuation piston 562 extends and retracts to remain in contact with the actuation pin 576, but does not interfere with the intended exhaust valve motion. The reset ball-valve member 544 remains in the open position, unseated by the upset pin 558 as shown in FIG. 30. The activation cavity 539 remains filled with hydraulic fluid with the reset piston 554 in its highest position and the reset trigger 550 in the trigger retracted position.

Referring back to FIGS. 21, 31A, and 31B, the hydraulic fluid flow pathway through the actuation piston 562 assists in maintaining the hydraulic circuit, in particular the piston cavity 565 and the second connecting conduit 528, filled with hydraulic fluid at all times during brake-on mode (as well as during brake-off mode). When the piston cavity 565 or the second connecting conduit 528 is not completely filled via the hydraulic fluid flow pathway associated with the reset device 543, the hydraulic fluid may enter into the piston cavity 565 through the fluid flow pathway associated with the actuation piston 562. The hydraulic fluid in the feed conduits 587 and below the ball-valve member 581 exerts an upward force that exceeds the combined downward force exerted by the actuation piston ball-valve check spring 583 and the hydraulic fluid in the piston cavity 565 (acting on the ball-valve member 581 through the stopper passage 589), causing the ball-valve member 581 to unseat from the check-valve seat 582 and thereby open the communication port 586. The hydraulic fluid flows from the feed conduits 587, through the open communication port 586 and the outlet conduits 588 (and the stopper passage 589) into the piston cavity 565 to supplement the filling of the piston cavity 565. Filling the piston cavity 565 through the reset valve 580 can occur, for example, whenever hydraulic fluid is needed in the piston cavity 565, but is particularly likely to occur when the exhaust cam lobe follower 21 of the exhaust rocker arm 522 moves from upper base circle 7 down to lower base circle 5 of the exhaust cam 2.

Maintaining the piston cavity 565 filled with the hydraulic fluid helps keep the single-valve actuation pin 576 in continuous/uninterrupted contact with both the actuation piston 562 and the exhaust valve $3_1$, as well as continuous/uninterrupted contact between the exhaust cam lobe follower 21 and the exhaust cam 2. As a consequence, opening and closing of the exhaust valve $3_1$ is not unintentionally delayed by unwanted lash, and engine brake performance is enhanced.

The description of FIG. 12 in connection with the compression-release brake system 12 above is applicable to the compression-release brake system 512 of the fifth embodiment. The reset device 532 lowers or eliminates the exhaust/intake valve overlap 90 at TDC in brake-on mode. The accumulator for supplying "make-up" hydraulic fluid may be provided in the rocker arm shaft 20 and/or or the rocker arm supports 25. The compression-release brake system 512 opens one of two exhaust valves $3_1$ during the engine compression release event and resets the exhaust valve $3_1$ prior to the normal exhaust stroke valve motion, i.e., by the end of the expansion stroke. The engine compression release single exhaust valve lift opening may be approximately 0.100 inch with lift starting just prior to TDC of the compression stroke.

The compression-release engine brake system 512 of the fifth exemplary embodiment may provide various advantages, including reduced cost and enhanced performance compared to conventional lost motion rocker brakes.

The reset device 532 and/or the actuation piston 562 may be substituted into the embodiments described above. For example, the actuation piston 562 may replace the actuation piston 62 of the first exemplary embodiment.

Figure 32:
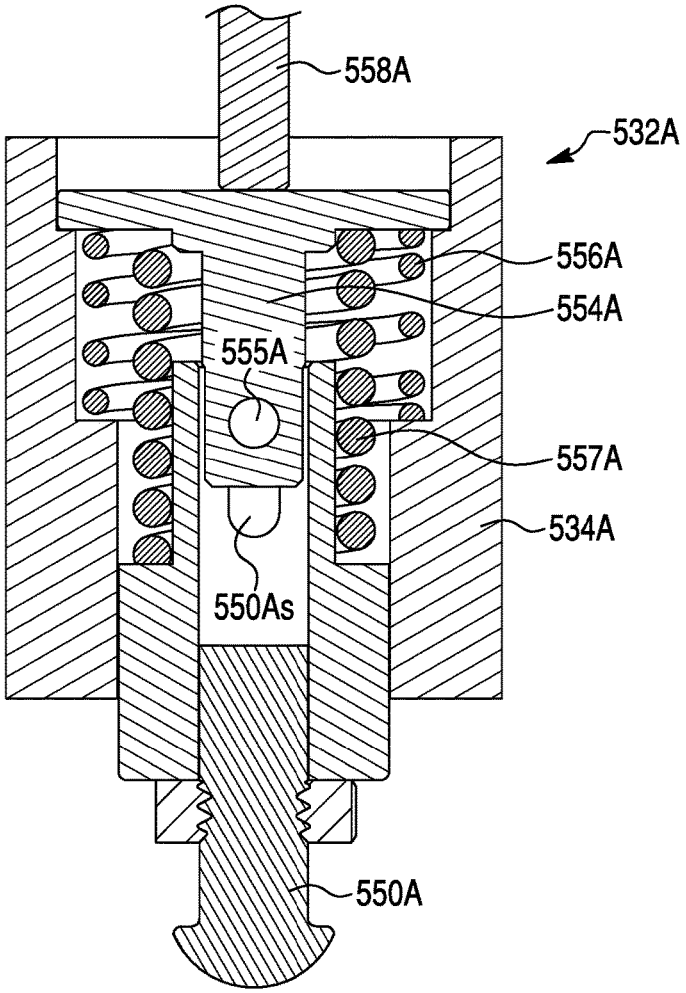
FIG. 32 is a partially fragmentary sectional view of a variation of the fifth embodiment.

FIG. 32 illustrates a variation of the fifth embodiment in which the reset device 532 of FIGS. 21-31B is modified. Components that are changed but functionally or structurally similar to the components of the fifth embodiment of FIGS. 21-31B are labeled with the same reference numerals with the addition of the suffix capital letter "A". For example, the reset device of FIG. 32 is generally designated by reference numeral 532A, and the cartridge body, the reset trigger, the reset trigger slot, the reset piston, the piston stroke limiting pin, the reset trigger return spring, the reset pressure control spring, and the upset pin are designated by reference numerals 534A, 550A, 550As, 554A, 555A, 556A, 557A, and 558A, respectively. The reset trigger return spring 556A is provided concentrically around the reset pressure control spring 557A. The reset trigger 550A does not include a flanged portion (550*f* in FIGS. 22 and 23) separating the reset trigger return spring 556A and the reset pressure control spring 557A. The reset trigger return spring 556A sits on a shoulder portion 534As of the cartridge body 534A. The design of the reset piston 550A is simplified compared to that of FIGS. 21-31B. Otherwise, the variation of the fifth embodiment illustrated in FIG. 32 is substantially identical to and operates in a similar if not identical manner to the fifth embodiment. Notably, this variation of the fifth embodiment, and in particular the concentric overlap of the springs 556A and 557A, allows for a shorter overall length of the reset device 532A.

Figure 33A:
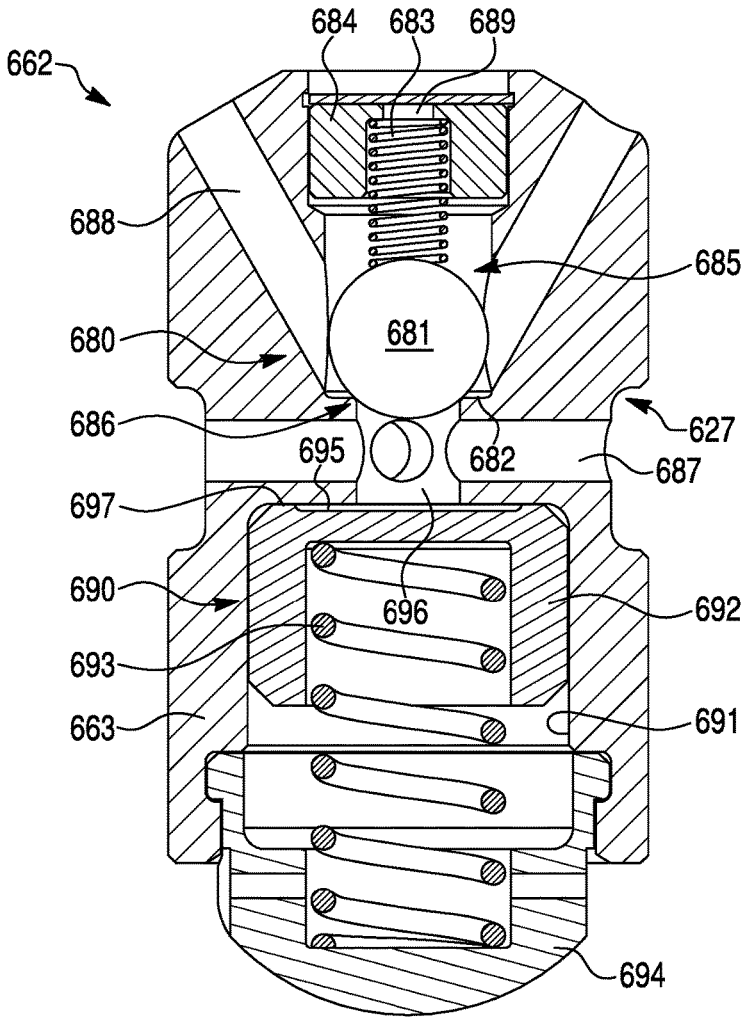
FIGS. 33A, 33B, and 33C are enlarged sectional views of an actuation piston of the brake system of a sixth embodiment in different states.
Figure 33B:
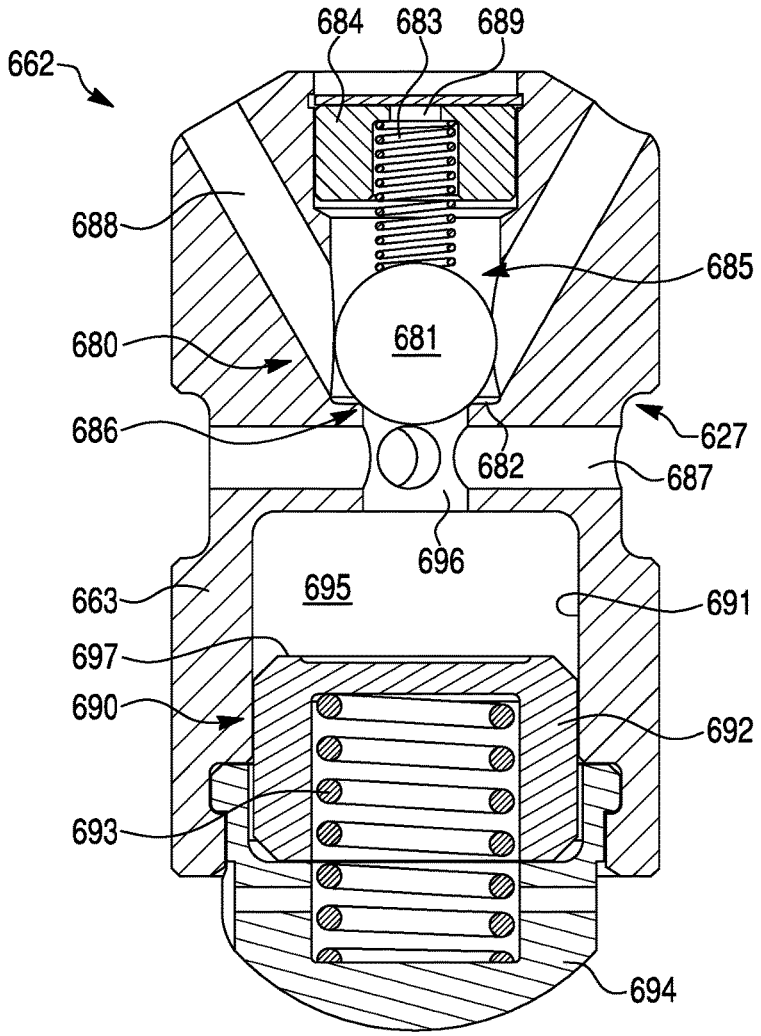
Figure 33C:
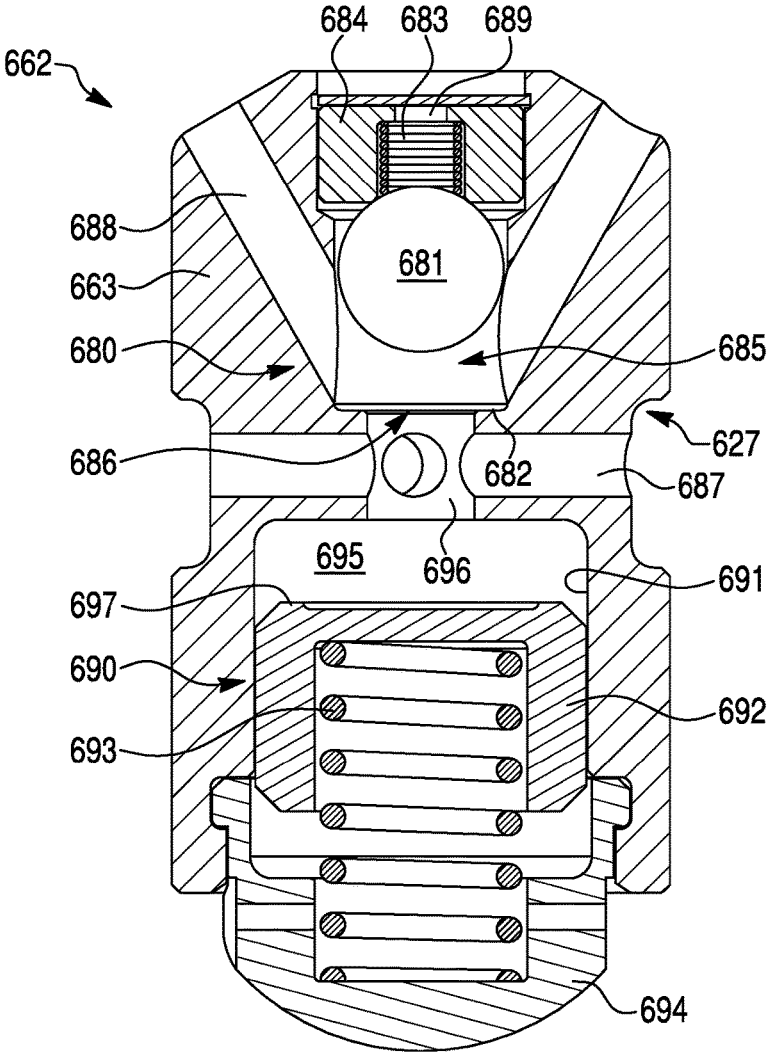

FIGS. 33A-33C illustrate a sixth exemplary embodiment in which the actuation piston 562 of FIGS. 21-31B is modified to include an accumulator. Components of the sixth exemplary embodiment illustrated in FIGS. 33A-33C corresponding to components of the fifth embodiment of FIGS. 21-31B are labeled with the same reference numerals but in the 600 series. For example, the actuation piston and the actuation piston body are designated by reference numerals 662 and 663, respectively. Internal actuation piston check valve 680, spring-loaded actuation piston ball-valve member 681, actuation piston check-valve seat 682, actuation piston ball-valve check spring 683, stopper 684, actuation piston check-valve cavity 685, actuation piston communication port 686, actuation piston feed conduits 687, actuation piston outlet conduits 688, and stopper passage 689 correspond in structure and operation to components 580-589, respectively, and therefore are not further described below except as necessary or useful in describing the additional components of the actuation piston 662. An outer surface of the actuation piston body 663 includes an annular groove 627 that is designed and operates in a manner described above in connection with the annular groove 527 of the fifth exemplary embodiment. The internal feed conduits 687 have radial outer ends that terminate at the annular groove 627 to receive hydraulic fluid from a supply conduit and feed the hydraulic fluid to a first connecting conduit (not shown in FIGS. 33A-33C).

The actuation piston 662 includes an accumulator 690 received in a lower pocket or bore 691 of the actuation piston body 663 below the one-way actuation piston check valve 680. The internal feed conduits 687 extend radially and perpendicularly to a longitudinal axis of the actuation piston body 663, rather than at the inclined angle of the feed conduits 587 of the fifth embodiment illustrated in FIGS. 21, 31A, and 31B, to increase volume available for the lower pocket 691.

The accumulator 690 includes a spring-loaded accumulator piston 692, an accumulator charge pressure control spring 693, an accumulator plug 694, a variable volume accumulator cavity 695, an accumulator port 696, and protrusion(s) 697. The accumulator port 696 provides a fluid passageway between the internal feed conduits 687 and the accumulator cavity 695. The accumulator cavity 695 has a bottom defined by the upper surface of the accumulator piston 692. The accumulator piston 692 is received within and reciprocatingly slidable relative to the lower pocket 691 of the actuation piston 662 to vary the volume of the accumulator cavity 695. The radial outer edge of the accumulator piston 692 may provide a seal with an internal wall of actuation piston body 663 defining the lower pocket 691. The accumulator plug 694 is fixed to the bottom of the actuation piston body 663. The accumulator charge pressure control spring 693 sits on the accumulator plug 694 and has an upper end engaging the accumulator piston 692 from below to bias the accumulator piston 692 upward toward the accumulator port 696 and the actuation piston check valve 680. The top surface of the accumulator piston 692 may include one or more protrusions or a protruding ring 697 similar to rear extension 63*b* described above in connection with the first exemplary embodiment.

FIG. 33A depicts the accumulator piston 692 in its uppermost position in which the accumulator cavity 695 has a minimum volume, and the actuation piston check valve 680 is in a closed state. FIG. 33B depicts the accumulator piston 692 at its lowermost position in which the accumulator cavity 695 has its maximum volume, and the actuation piston check valve 680 in the closed state. FIG. 33C depicts the accumulator cavity 695 approximately half full, and the actuation piston check valve 680 in an open state. The accumulator port 696 permits hydraulic fluid to flow into and out of the accumulator cavity 695. Hydraulic fluid flowing out of the accumulator cavity 695 though the accumulator port 696 may raise the actuation piston ball-valve member 681 and thereby open the actuation piston communication port 686. The hydraulic fluid flowing through the communication port 686 can travel through the outlet conduits 688 or the stopper passage 689 into the piston cavity.

The actuation piston 662 of the sixth exemplary embodiment illustrated in FIGS. 33A-33C may be substituted for the actuation piston 562 to operate in the compression-release engine brake system 512 of the fifth embodiment of the invention shown in FIGS. 21-31B. The accumulator 690 operates similar to the accumulator discussed above and illustrated in FIGS. 11A-11C to store and release hydraulic fluid when needed. In start-up, the hydraulic fluid is supplied to the accumulator cavity 695 from the supply conduit 526 through the accumulator port 696 to move the accumulator piston 692 from the raised position shown in FIG. 33A to the lowered position shown in FIG. 33B. The hydraulic fluid overcomes the biasing force of the accumulator charge pressure control spring 693 to move the accumulator piston 692 downward and fill the accumulator cavity 695. The accumulator cavity 695 may be designed so that the volume of hydraulic fluid captured in the accumulator cavity 695 when the accumulator 690 is fully charged equals the volume of hydraulic fluid needed to move the actuation piston 662 from the piston retracted position to the piston extended position.

In operation, when hydraulic fluid is needed in the piston cavity 565, such as due to delayed filling of the piston cavity 565 through the connecting conduits 528 and 529, a pressure differential across the actuation piston ball-valve member 681 causes the hydraulic fluid to travel from the accumulator cavity 695 up through the accumulator port 696 and the actuation piston communication port 686 by opening the ball-valve member 681, as shown in FIG. 33C. The hydraulic fluid then flows through the outlet conduits 688 and the stopper passage 689 into the piston cavity 565. Such flow of the hydraulic fluid from the accumulator cavity 695 through the actuation piston communication port 686 to the piston cavity 565 may occur, for example, when the exhaust cam lobe follower 21 moves to the lower base circle 5 of the exhaust cam 2. The supply of hydraulic fluid to the piston cavity 565 through this secondary flow path supplements the hydraulic fluid flow through the connecting conduits 528 and 529. This additional flow path through the actuation piston communication port 686 ensures that the hydraulic circuit, and in particular the piston cavity 565, is full prior to an engine braking event. During engine braking reset operation, the pressurized hydraulic fluid is returned to the accumulator cavity 695, such as during the expansion stroke, by passing through the connecting conduits 528 and 529 and the open reset check valve 543. The actuation piston check valve 680 closes to prevent the backflow of the hydraulic fluid through the communication port 686.

Advantageously, the closer proximity of the accumulator 690 to the piston cavity 565 allows hydraulic fluid to be charged to and returned from the piston cavity 565 more quickly than when the accumulator is located in the rocker shaft 20, thereby improving operation of the overall system.

Figure 34:
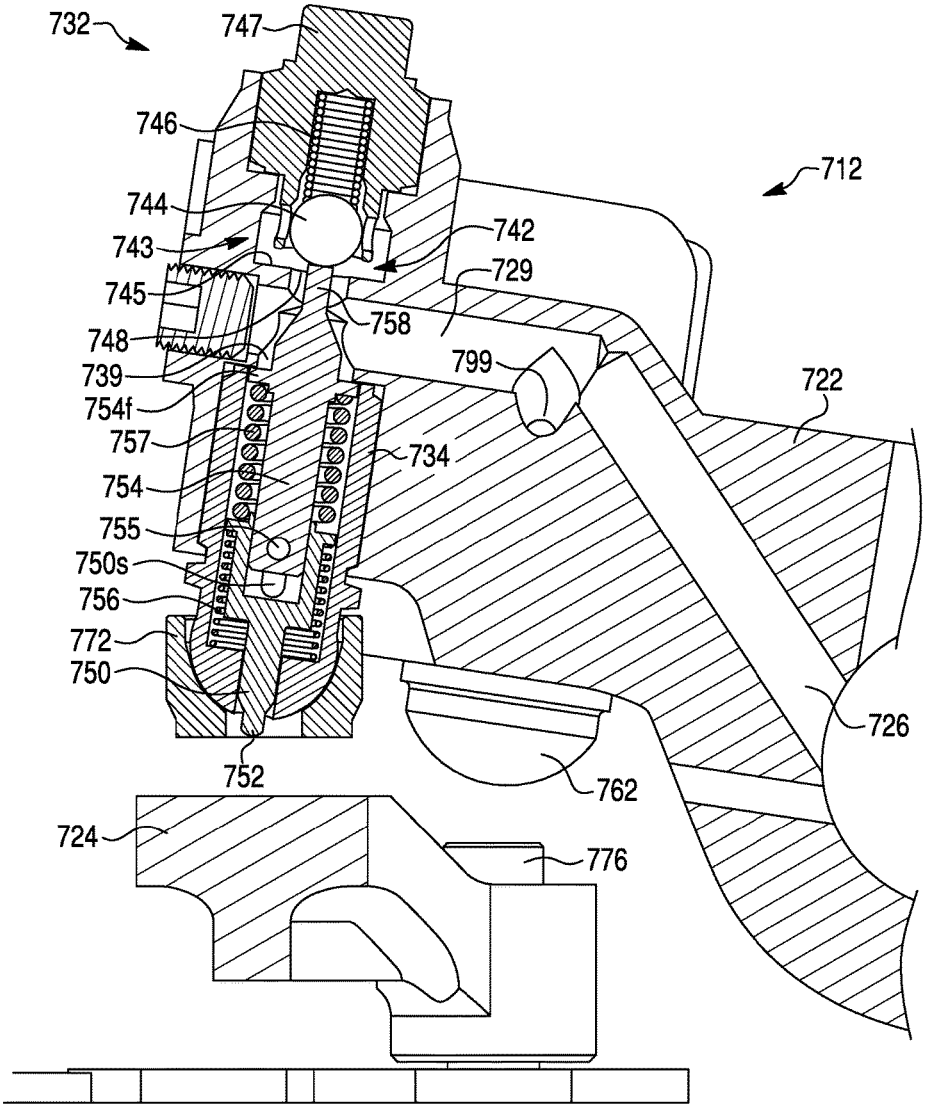
FIG. 34 is a fragmentary sectional view of the rocker arm compression-release engine brake system according to a seventh exemplary embodiment of the present invention.
Figure 35:
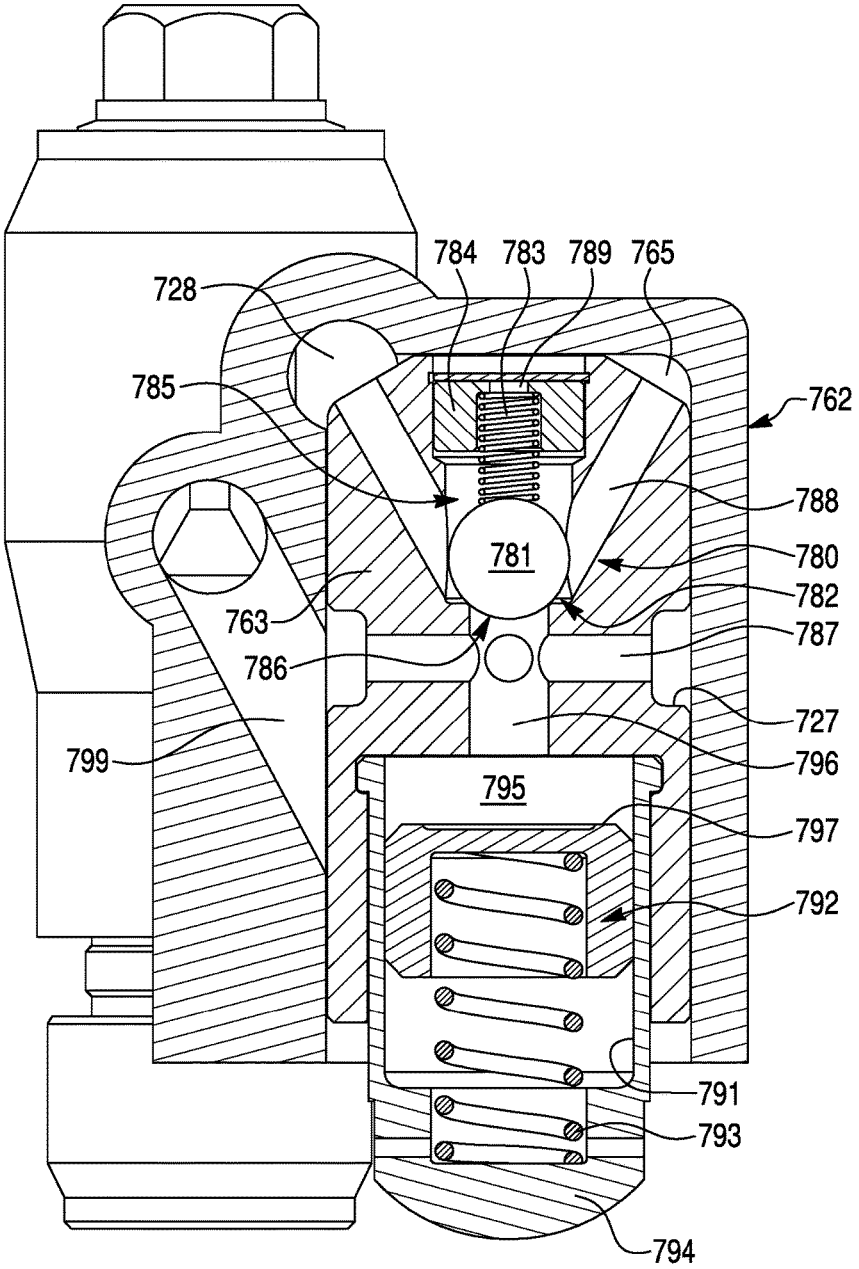
FIG. 35 is another fragmentary sectional view of the rocker arm compression-release engine brake system of the seventh exemplary embodiment of the invention.

FIGS. 34 and 35 illustrate a compression-release brake system 712 of a seventh exemplary embodiment, in which the hydraulic circuit is modified to be a single-source (or common-source) hydraulic circuit in which hydraulic fluid from a single source (or common source) is supplied to both the piston cavity and the activation cavity for activating the reset device. Components of FIGS. 34 and 35 that are unchanged from the above-described embodiments are labeled with the same reference numerals. Components of FIGS. 34 and 35 that correspond to the above-discussed components of the fifth embodiment of FIGS. 21-31B and the sixth embodiment of FIGS. 33A-33C are labeled with the same reference numerals but in the 700 series.

The compression-release brake system 712 of the seventh exemplary embodiment includes an exhaust valve reset device 732 that is similar in construction and operation to the exhaust valve reset device 532 of the fifth embodiment.

The reset device 732 includes a substantially cylindrical, hollow cartridge body 734 with an attached swivelable foot (or "elephant foot") 772. A reset trigger 750 and a reset piston 754 are received in and reciprocatingly slidable relative to cartridge body 734. The reset trigger 750 has a distal end 752 protruding through a bottom opening in the cartridge body 734. A reset trigger return spring 756 inside the cartridge body 734 biases the reset trigger 750 towards a trigger retracted position. A piston stroke limiting pin 755 connects the reset trigger 750 to the reset piston 754 while permitting relative movement there between. An upset pin 758 integrally formed with the reset piston 754 extends upward through an activation cavity 739 sitting above an annular flange portion 754*f* of the reset piston 754. A reset pressure control spring 757 inside the cartridge body 734 biases the reset piston 754 (and the upset pin 758) upward. The activation cavity 739 communicates with the connecting conduit 729 to receive hydraulic fluid to activate the reset device 732.

Above the upset pin 758, the reset device 732 also includes a reset check valve 743 embodied as including a reset ball-valve member 744 contained in a reset check-valve cavity 742 having a reset check-valve seat 745 defined by inner walls of the exhaust rocker arm 722. The reset ball-valve member 744 is movable relative to the reset check-valve seat 745 between an open position (shown in FIG. 34) and a closed position. In the open position, the reset ball-valve member 744 is raised above the reset check-valve seat 745 by the upset pin 758 to open reset communication port 748 in the same manner as described above in connection with the reset check valve 543 of the fifth exemplary embodiment. In the closed position, the upset pin 758 is positioned downward to allow the reset ball-valve member 744 to sit on the reset check-valve seat 745 and prevent the backflow of hydraulic fluid through the reset communication port 748. A retaining plug 747 fitted in an opening of the exhaust rocker arm 722 above the reset check-valve cavity 742 is provided with a reset ball-valve check spring 746 that remains in constant contact with the upper part of the reset ball-valve member 744. The reset ball-valve check spring 746 exerts a downward biasing force on the reset ball-valve member 744 to urge the reset ball-valve member 744 towards the closed position in which the reset ball-valve member 744 sits on the reset check-valve seat 745 to close the reset communication port 748.

The reset trigger 750 is axially slidable within and relative to the cartridge body 734 between a trigger retracted position and a trigger extended position. In the trigger retracted position shown in FIG. 34, the upset pin 758 contacts the bottom of the reset ball-valve member 744 and lifts the reset ball-valve member 744 off the reset check-valve seat 745. In the trigger extended position, the distal end 752 of the reset trigger 750 is extended farther downward to protrude through the bottom opening of the foot 772 and, depending upon the pivotal location of the rocker arm 722, to contact the exhaust valve bridge 724.

It should be understood that the reset check valve 743 illustrated in this exemplary embodiment may be replaced with other suitable check valves, and that such modifications are within the scope of the invention.

The hydraulic circuit will now be discussed in greater detail. The various conduits of the hydraulic circuit may be positioned in locations other than those shown in the drawings.

The hydraulic circuit includes a supply conduit 726 (FIG. 34) that feeds hydraulic fluid into the exhaust arm 722. The supply conduit 726 may have on/off capability, such as by solenoid valve control (not shown in FIGS. 34 and 35), controlled from the vehicle cab, such as through a switch. The supply conduit 726 forks into a first connecting conduit 729 and an accumulator feed conduit 799. The first connecting conduit 729 provides a fluid pathway for exchanging the hydraulic fluid between the supply conduit 726 and the activation cavity 739. A vertical fluid pathway above the activation cavity 739 allows for the exchange of the hydraulic fluid between the activation cavity 739 and the reset check-valve cavity 742 when the reset check valve 743 is open. As best shown in FIG. 35, a second connecting conduit 728 provides a fluid pathway for exchanging the hydraulic fluid between the reset check-valve cavity 742 and the piston cavity 765. The second connecting conduit 728 is positioned and operates similar to the second connecting conduit 528 of the fifth embodiment.

The accumulator feed conduit 799 connects the supply conduit 726 with an annular groove 727 in an actuation piston body 763 of an actuation piston 762, which is identical in structure to the actuation piston 662 of the sixth exemplary embodiment illustrated in FIGS. 33A-33C. Components 780-796 have the same structure and operation as components 680-688 and 690-696, respectively, except as otherwise indicated below.

The positive power operation (brake-off mode) of the IC engine of the seventh exemplary embodiment is similar to the brake-off mode operation described above in connection with the fifth exemplary embodiment and FIGS. 24-26, with the following exception. In the dual-supply hydraulic circuit of the fifth exemplary embodiment, the supply conduit 526 and connecting conduits 528 and 529 are fed with hydraulic fluid in both the brake-off and brake-on modes, while the separate brake-on supply conduit 530 is fed with hydraulic fluid in the brake-on mode but not the brake-off mode. As discussed above, in both modes, the hydraulic fluid supplied through the supply conduit 526 fills the actuation piston cavity 565, moving the actuation piston 562 into its piston extended position and eliminating the valve train lash, except for the predetermined valve lash δ set between the foot 572 and the exhaust valve bridge 524, including between the cam follower 21 and the lobe of the exhaust cam 2. In the single-supply hydraulic circuit of the seventh embodiment, because the supply conduit 726 feeds the activation cavity 739, the hydraulic fluid preferably is not supplied through the supply conduit 726 during brake-off mode to avoid unintended activation of the reset trigger 750. To eliminate valve lash between the cam follower 21 and the lobe of the exhaust cam 2 in the brake-off mode, one or more springs are provided over the driven end of the exhaust rocker arm 722 to urge the cam follower 21 downward into constant engagement with the lobe of the exhaust cam 2. A stamped metal bar fastened to the rocker shaft supports the springs from above and acts as a stop member.

During positive power operation, the reset trigger 750 is maintained in the trigger retracted position shown in FIG. 34 by reducing or eliminating hydraulic fluid pressure in the activation cavity 739 so that the biasing forces of the reset trigger return spring 756 and the reset pressure control spring 757 exceed the force, if any, exerted by hydraulic fluid in the activation cavity 739 above the reset piston 754. In the trigger retracted position shown in FIG. 34, the reset piston 754 is in a fully raised position so that the upper end of the upset pin 758 lifts and maintains the reset ball-valve member 744 in an open position for the entirety of the brake-off mode. With the reset check valve 743 in the open position, the open reset communication port 748 maintains the supply conduit 726 in constant open communication with the piston cavity 765 through the first and second connecting conduits 729 and 728. The hydraulic fluid (e.g., motor oil) fills the actuation piston cavity 765, moving the actuation piston 762 into its piston extended position and (together with the spring(s) provided over the driven end of the exhaust rocker arm 722) eliminating the valve train lash, except for the predetermined valve lash δ set between the foot 772 and the exhaust valve bridge 724.

Operation of the seventh exemplary embodiment in the brake-on mode is similar to the operation shown in FIGS. 27-30. The exhaust cam lobe follower 21 of the driven end **22*b* (FIG. 2) of the exhaust rocker arm 722 is positioned on the lower base circle 5 of the exhaust cam 2. The compression-release brake system 712 feeds additional hydraulic fluid through the supply conduit 726 into the already filled hydraulic circuit. The hydraulic fluid flowing through the first connecting conduit 729 pressurizes the activation cavity 739 to exert a downward force on the top surface of the reset piston 754. The biasing force exerted by the reset trigger return spring 756 is overcome to compress the trigger return spring 756 and drive the reset trigger 750 downward from the trigger retracted position to the trigger extended position. The reset trigger return spring 756** may be provided with a lower spring constant than the reset pressure control spring 757 so that the downward movement of the reset piston 754 primarily compresses the reset trigger return spring 756 and not the reset pressure control spring 757. Because of the higher spring constant of the reset pressure control spring 757, the height of the reset pressure control spring 757 remains fixed at the piston stroke limiting pin 755, i.e., the piston stroke limiting pin 755 does not slide within the slot 750*s* of the reset trigger 750 at this time. In the trigger extended position, a jut of the reset trigger 750 abuts against a lower shoulder portion of the cartridge body 734 to limit the downward movement of the reset trigger 750.

The downward movement of the reset piston 754 lowers the upset pin 758 below the reset communication port 748 so that the reset ball-valve member 744, which is urged downward by the reset ball-valve check spring 746, can sit on the reset ball-check seat 745 to permit closure of the reset check valve 743. The reset check valve 743 closes after the hydraulic fluid has pressurized the piston cavity 765 to extend the actuation piston 762 into the piston extended position to retain contact with the actuation pin 776. The hydraulic fluid fed through the reset communication port 748 fills the connecting conduit 728 and the piston cavity 765 with the actuation piston 762 in the piston extended position. All valve train lash between the single-valve actuation pin 776 and the actuation piston 762, and the cam follower 21 and the lobe of the exhaust cam 2, is eliminated. In this closed position, the reset check valve 743 prevents the reverse flow of the hydraulic fluid from the piston cavity 765 through the reset communication port 748 back into the first connecting conduit 729 and the supply conduit 726.

At the same time, the hydraulic fluid travels from the accumulator cavity 795 up through the accumulator port 796 and the actuation piston communication port 786, overcoming the biasing force of the actuation piston biasing member 783 of the one-way actuation piston check valve 780, to the piston cavity 765, thereby supplementing the feed of hydraulic fluid to the piston cavity 765 and ensuring that the hydraulic circuit is filled with the hydraulic fluid prior to an engine braking event. The filling of the piston cavity 765 moves the actuation piston 762 into the piston extended position.

Next, the cam follower 21 of the driven end 22*b* (FIG. 2) of the exhaust rocker arm 722 proceeds from the lower base circle 5 on the exhaust cam 2 towards the upper base circle (i.e., the brake lift profile 7 of FIG. 2). The downward motion of the exhaust rocker arm 722 drives the actuation piston 762 against the single-valve actuation pin 776, exerting an upward force on the actuation piston 762. With the actuation piston 762 in the piston extended position and the piston cavity 765 and the second connecting conduit 728 filled with the hydraulic fluid, the hydraulic fluid acts on the reset ball-valve member 744 to hydraulically lock the reset check valve 743 in the closed position with the reset ball-valve member 744 retained on the reset check-valve seat 745. At the same time, the distal end 752 of the reset trigger 750 in the trigger extended position comes into contact with the exhaust valve bridge 724. The downward motion of the exhaust rocker arm 722 drives the distal end 752 into the exhaust valve bridge 724, moving the reset trigger 750 upward relative to the cartridge body 734.

As the exhaust rocker arm 722 continues toward the upper base circle 7 to move the exhaust rocker arm 522 farther downward towards the exhaust valve bridge 724, the reset trigger 750 continues its upward movement relative to the cartridge body 734 until the reset trigger 750 is in the trigger retracted position.

Upward movement of the reset piston 754 is prevented by the upset pin 758 contacting the bottom of the reset ball-valve member 744, which is hydraulically locked in the closed position by the high pressure in the second connecting conduit 728 and the piston cavity 765. As the reset trigger 750 moves upwardly relative to the reset piston 754, the slot 750*s* of the reset trigger 750 is guided by the piston stroke limiting pin 755 of the reset piston 754. The reset pressure control spring 757 compresses between the flange portion 750*f* of the reset trigger 750 and the flange portion of the reset piston 754, building potential energy in the reset pressure control spring 757.

The continued downward rotational movement of the distal end of the exhaust rocker arm 722 as the exhaust rocker arm 722 moves towards the upper base circle 7 causes the actuation piston 762 in its piston extended position to drive the single-valve actuation pin 776 downward and open the first exhaust valve $3_1$ just prior to or at TDC of the compression stroke during the compression-release engine braking event. Due to the predetermined valve lash δ, the foot 772 does not press the exhaust valve bridge 724 downward, and consequently the bridge 724 remains stationary and the second exhaust valve $3_2$ remains closed. The opening of the first exhaust valve $3_1$ at or near TDC compression causes the engine cylinder pressure to rapidly drop, thereby relieving the upward force acting on the actuation piston 762 through the actuation pin 774, and decreasing the pressure in the piston cavity 765 and the second connecting conduit 728 connected to the piston cavity 765.

When the biasing force applied by the compressed reset pressure control spring 757 exceeds the force exerted by the decreasing hydraulic pressure above the reset ball-valve member 744 (the negligible force of the reset ball-valve check spring 746 may be ignored), the compressed reset pressure control spring 757 drives the reset piston 754 and the upset pin 758 upward and thereby unseats the reset ball-valve member 744 from the reset check-valve seat 745, opening the reset check valve 743 at or near the beginning of the expansion stroke.

A portion of the hydraulic fluid in the piston cavity 765 and the second connecting conduit 728 is released through the reset communication port 748 and the conduits 729 and 799 to the accumulator cavity 795, where the hydraulic fluid is stored for the next braking event. The release of the hydraulic fluid from the piston cavity 765 allows the actuation piston 762 to move into the piston retracted position as the closing force of the exhaust valve return spring $9_1$ resets the exhaust valve $3_1$ into the seated state by the end of the expansion stroke, that is, prior to the exhaust stroke. Because both exhaust valves $3_1$ and $3_2$ are seated before the exhaust stroke, the exhaust rocker arm 722 can act on the exhaust valve bridge 724 to simultaneously open the exhaust valves $3_1$ and $3_2$ in a balanced condition during the exhaust stroke.

The hydraulic fluid flow pathway through the actuation piston 762 assists in maintaining the hydraulic circuit, in particular the piston cavity 765 and the second connecting conduit 728, filled with hydraulic fluid at all times during brake-on mode (as well as during brake-off mode). When the piston cavity 765 or the second connecting conduit 728 is not completely filled via the hydraulic fluid flow pathway associated with the reset device 743, the hydraulic fluid may enter into the piston cavity 765 through the hydraulic fluid flow pathway associated with the actuation piston 762. The hydraulic fluid in the feed conduits 787 and below the ball-valve member 781 exerts an upward force that exceeds the combined downward force exerted by the actuation piston ball-valve check spring 783 and the hydraulic fluid in the piston cavity 765, which fluid acts on the ball-valve member 781 through the stopper passage 789, causing the ball-valve member 781 to unseat from the check-valve seat 782 and thereby open the communication port 786. The hydraulic fluid flows from the feed conduits 787, through the open communication port 786, the outlet conduits 788, and the stopper passage 789 into the piston cavity 765 to supplement the filling of the piston cavity 765. Filling the piston cavity 765 through the reset valve 780 can occur, for example, whenever hydraulic fluid is needed in the piston cavity 765, but is particularly likely to occur when the exhaust cam lobe follower 21 of the exhaust rocker arm 722 moves from upper base circle 7 down to lower base circle 5 of the exhaust cam 2.

The description of FIG. 12 in connection with the compression-release brake system 12 above is applicable to the compression-release brake system 712 of the seventh exemplary embodiment. The reset device 732 lowers or eliminates the exhaust/intake valve overlap 90 at TDC in brake-on mode. The accumulator for supplying "make-up" hydraulic fluid may be provided in the actuation piston 762, the rocker arm shaft 20 and/or or the rocker arm supports 25. The compression-release brake system 712 opens one of two exhaust valves $3_1$ during the engine compression release event and resets the exhaust valve $3_1$ prior to the normal exhaust stroke valve motion, i.e., by the end of the expansion stroke. The engine compression release single exhaust valve lift opening may be approximately 0.100 inch with lift starting just prior to TDC of the compression stroke.

The compression-release engine brake system 712 of the seventh exemplary embodiment may provide various advantages, including reduced cost and enhanced performance compared to conventional lost motion rocker brakes.

The embodiment of FIGS. 34 and 35 may be modified to substitute the actuation piston 562 of the fifth exemplary embodiment for the accumulator-containing actuation piston 762. The embodiment of FIGS. 34 and 35 also may be modified to include additional or alternative accumulators, such as in the rocker shaft 20 and/or the rocker arm supports 25 as described above in connection with FIGS. 11A-11C and the solenoid valve system of FIG. 11D.

The various components and features of the above-described embodiments may be substituted into one another in any combination. It is within the scope of the invention to make the modifications necessary or desirable to incorporate one or more components and features of any one embodiment into any other embodiment.

The foregoing description of the exemplary embodiments of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A compression-release brake system for effectuating a compression-release engine braking operation in connection with an internal combustion engine comprising an engine cylinder that is associated with a four-stroke piston cycle comprising a compression stroke and an expansion stroke and is provided with at least one intake valve, at least one exhaust valve, and at least one exhaust valve return spring exerting a closing force on the exhaust valve to urge the exhaust valve into a seated state, the compression-release brake system comprising:

a lost motion exhaust rocker assembly comprising a rocker arm;

an actuation piston comprising an actuation piston body slidably received by a first pocket of the rocker arm, the first pocket defining a piston cavity in the rocker arm, movable between a piston retracted position and a piston extended position, the actuation piston configured to be operatively associated with an exhaust valve to permit unseating of the exhaust valve from the seated state, the first pocket having an actuation piston port configured to supply pressurized fluid to move the actuation piston between the retracted position and the extended position; and a reset device, received by a substantially cylindrical second pocket reset bore of the rocker arm, the reset device operatively associated with the first pocket through at least one connecting conduit, and comprising a reset check valve configured to move between a closed position and an open position to provide regulation of a fluid flow to and from the piston cavity, the reset device further comprising a reset pressure control spring for applying a biasing force to the reset check valve to urge the reset check valve toward the open position.

2. The compression-release brake system of claim 1, wherein the compression-release brake system is configured for installation on the internal combustion engine and operation in a brake-on mode in which the reset device is operatively associated with the actuation piston through the at least one connecting conduit to release a portion of hydraulic fluid from the piston cavity so that the exhaust valve return spring resets the exhaust valve to the seated state by the end of the expansion stroke.

3. The compression-release brake system of claim 1, wherein said actuation piston cavity is joined by a secondary check valve, configured to move between an open and a closed position, wherein in the open position the secondary check valve is operable to open the actuation piston communication port to place the continuous supply conduit in fluid communication with the piston cavity through the actuation piston communication port, and wherein the secondary check valve is operable to close the actuation piston communication port to prevent backflow of the hydraulic fluid from the piston cavity through the actuation piston communication port when said actuation piston makes contact with said exhaust valve.

4. The compression-release brake system of claim 3, wherein the actuation piston is comprised of an actuation piston body, and said secondary check valve.

5. The compression-release brake system of claim 1, wherein:

the reset check valve is movable between the open position and the closed position relative to a reset communication port of the reset device, wherein in the open position the reset check valve opens the reset communication port to place a continuous supply conduit in fluid communication with the piston cavity through said at least one connecting conduit and the reset communication port, and wherein in the closed position the reset check valve closes the reset communication port; and the reset device further comprises a reset trigger and a reset piston, the reset trigger being operatively connected to the reset check valve and the reset pressure control spring and movable between a trigger retracted position and a trigger extended position.

6. The compression-release brake system of claim 5, wherein the supply conduit is configured to supply the hydraulic fluid to the reset device to move the reset trigger from the trigger retracted position to the trigger extended position, and wherein the supply conduit is also configured to supply the hydraulic fluid to the piston cavity.

7. The compression-release brake system of claim 5, wherein the compression-release brake system is configured for installation on the internal combustion engine and operation in a brake-on mode so that:

the lost motion exhaust rocker assembly is operatively associated with the reset device to cause, during the compression stroke, the reset trigger to be moved from the trigger extended position into the trigger retracted position by relative movement between the pivoting rocker arm and a stop member to compress the reset pressure control spring while maintaining the reset check valve in the closed position, the lost motion exhaust rocker assembly is operatively associated with the actuation piston to cause, during the compression stroke, the actuation piston in the piston extended position to exert sufficient force on the exhaust valve to unseat the exhaust valve, and the reset device is operatively associated with the actuation piston so that after unseating of the exhaust valve, and as the hydraulic pressure within the piston cavity decreases, the biasing force of the reset pressure control spring compressed by the reset trigger and the reset piston moves the reset check valve into the open position to thereby release a portion of the hydraulic fluid in the piston cavity through the reset communication port so that the closing force of the exhaust valve return spring resets the exhaust valve to the seated state by the end of the expansion stroke.

8. An internal combustion engine, comprising:

an engine cylinder associated with a four-stroke piston cycle comprising a compression stroke and an expansion stroke, the engine cylinder comprising at least one intake valve, at least one exhaust valve, and at least one exhaust valve return spring exerting a closing force on the exhaust valve to urge the exhaust valve into a seated state; and the compression-release brake system of claim 1.

9. A compression-release brake system for effectuating a compression-release engine braking operation in connection with an internal combustion engine comprising an engine cylinder that is associated with a four-stroke piston cycle comprising a compression stroke and an expansion stroke and is provided with at least one intake valve, at least one exhaust valve, and at least one exhaust valve return spring exerting a closing force on the exhaust valve to urge the exhaust valve into a seated state, the compression-release brake system comprising:

a lost motion exhaust rocker assembly comprising a rocker arm;

an actuation piston slidably received by the rocker arm to define a piston cavity in the rocker arm and movable via hydraulic pressure between a piston retracted position and a piston extended position, the actuation piston being configured to be operatively associated with the exhaust valve to permit unseating of the exhaust valve from the seated state during said compression stroke; and a reset device received by the rocker arm, said reset device including a compression release cartridge, including a threaded cartridge body, provided with a continuous hydraulic fluid pressure supply port, in fluid communication with said actuation piston, and said reset device is adjustable via said threaded body for valve lash in said lost motion rocker, wherein, when said piston is in said extended position, said reset device is urged, via contact with said exhaust valve following said compression release, to release hydraulic fluid in said piston cavity enabling said actuation piston to return to said retracted position.

10. The compression-release brake system of claim 9, wherein the compression-release brake system is configured for installation on the internal combustion engine and operation in a brake-on mode, in which the reset device is operatively associated with the actuation piston through at least one connecting conduit of the rocker arm, and releases said hydraulic fluid from the piston cavity, the exhaust valve return spring resets the exhaust valve to the seated state by the end of the expansion stroke.

11. An internal combustion engine, comprising:

an engine cylinder associated with a four-stroke piston cycle comprising a compression stroke and an expansion stroke and provided with at least one intake valve, at least one exhaust valve, and at least one exhaust valve return spring exerting a closing force on the exhaust valve to urge the exhaust valve into a seated state; and the compression-release brake system of claim 9.

12. The compression-release brake system of claim 9, wherein the actuation piston is comprised of an actuation piston body, and an actuation piston check valve, configured to move between an open and a closed position, wherein in the open position the actuation piston check valve is operable to open the actuation piston communication port to place the continuous supply conduit in fluid communication with the piston cavity through the actuation piston communication port, and wherein the actuation piston check valve is operable to close the actuation piston communication port to prevent backflow of the hydraulic fluid from the piston cavity through the actuation piston communication port when said actuation piston makes contact with said exhaust valve.

13. The compression-release brake system of claim 9, wherein:

the reset check valve is movable between the open position and the closed position relative to a reset communication port of the reset device, wherein in the open position the reset check valve opens the reset communication port to place a continuous supply conduit in fluid communication with the piston cavity through said at least one connecting conduit and the reset communication port, and wherein in the closed position the reset check valve closes the reset communication port; and the reset device further comprises a reset trigger and a reset piston, the reset trigger being operatively connected to the reset check valve and the reset pressure control spring and movable between a trigger retracted position and a trigger extended position.

14. The compression-release brake system of claim 13, wherein the supply conduit is configured to supply the hydraulic fluid to the reset device to move the reset trigger from the trigger retracted position to the trigger extended position, and wherein the supply conduit is also configured to supply the hydraulic fluid to the piston cavity.

15. The compression-release brake system of claim 13, wherein the compression-release brake system is configured for installation on the internal combustion engine and operation in a brake-on mode so that:

the lost motion exhaust rocker assembly is operatively associated with the reset device to cause, during the compression stroke, the reset trigger to be moved from the trigger extended position into the trigger retracted position by relative movement between the pivoting rocker arm and a stop member to compress the reset pressure control spring while maintaining the reset check valve in the closed position, the lost motion exhaust rocker assembly is operatively associated with the actuation piston to cause, during the compression stroke, the actuation piston in the piston extended position to exert sufficient force on the exhaust valve to unseat the exhaust valve, and the reset device is operatively associated with the actuation piston so that after unseating of the exhaust valve, and as the hydraulic pressure within the piston cavity decreases, the biasing force of the reset pressure control spring compressed by the reset trigger and the reset piston moves the reset check valve into the open position to thereby release a portion of the hydraulic fluid in the piston cavity through the reset communication port so that the closing force of the exhaust valve return spring resets the exhaust valve to the seated state by the end of the expansion stroke.

* * * * *